US008323861B2

(12) United States Patent
Mitsumori et al.

(10) Patent No.: US 8,323,861 B2
(45) **Date of Patent: *Dec. 4, 2012**

(54) ELECTROPHOTOGRAPHIC PHOTORECEPTOR, IMAGE-FORMING APPARATUS, AND ELECTROPHOTOGRAPHIC CARTRIDGE

(75) Inventors: Teruyuki Mitsumori, Yokohama (JP); Kozo Ishio, Odawara (JP); Hiroe Fuchigami, Odawara (JP)

(73) Assignee: Mitsubishi Chemical Corporation, Tokyo (JP)

( * ) Notice: Subject to any disclaimer, the term of this patent is extended or adjusted under 35 U.S.C. 154(b) by 363 days.

This patent is subject to a terminal disclaimer.

(21) Appl. No.: 12/301,109

(22) PCT Filed: May 18, 2007

(86) PCT No.: PCT/JP2007/060225

§ 371 (c)(1),
(2), (4) Date: Jan. 27, 2009

(87) PCT Pub. No.: WO2007/135987

PCT Pub. Date: Nov. 29, 2007

(65) Prior Publication Data

US 2009/0136861 A1 May 28, 2009

(30) Foreign Application Priority Data

May 18, 2006 (JP) ..... 2006-139529
May 18, 2006 (JP) ..... 2006-139533

(51) Int. Cl.
*G03G 15/04* (2006.01)
*G03G 5/14* (2006.01)

(52) U.S. Cl. ..... 430/60; 430/56; 430/59.4

(58) Field of Classification Search ..... 430/57.1, 430/59.1, 59.4, 60, 66, 96

See application file for complete search history.

(56) References Cited

U.S. PATENT DOCUMENTS 5,106,536 A 4/1992 Miyamoto et al.
5,132,197 A 7/1992 Iuchi et al.
5,391,448 A 2/1995 Katayama et al.
5,882,246 A 3/1999 Inkyo et al.

(Continued)

FOREIGN PATENT DOCUMENTS

JP 1 142658 6/1989

(Continued)

OTHER PUBLICATIONS

Office Action issued Dec. 31, 2010, in China Patent Application No. 200780018142.9 (with English translation).

(Continued)

*Primary Examiner* — Christopher Rodee
*Assistant Examiner* — Stewart Fraser
(74) *Attorney, Agent, or Firm* — Oblon, Spivak, McClelland, Maier & Neustadt, L.L.P.

(57) ABSTRACT

An electrophotographic photoreceptor having high sensitivity and low residual potential is provided. The electrophotographic photoreceptor includes an undercoat layer containing metal oxide particles and a binder resin on an electroconductive substrate, and a photosensitive layer disposed on the undercoat layer, wherein the metal oxide particles have a volume average particle diameter of 0.1 μm or less and a 90% cumulative particle diameter of 0.3 μm or less which are measured by a dynamic light-scattering method in a liquid of the undercoat layer dispersed in a solvent mixture of methanol and 1-propanol at a weight ratio of 7:3; and the photosensitive layer contains crystalline phthalocyanine showing at least one distinct main diffraction peak at a Bragg angle (2θ±0.2°) of 27.0° to 29.0° in an X-ray diffraction spectrum.

19 Claims, 5 Drawing Sheets

U.S. PATENT DOCUMENTS

| | | | | |
|---|---|---|---|---|
| 6,214,506 | B1 * | 4/2001 | Kurihara et al. | 430/65 |
| 6,824,938 | B2 * | 11/2004 | Kizaki et al. | 430/60 |
| 7,727,693 | B2 | 6/2010 | Ishida et al. | |
| 2005/0037274 | A1 * | 2/2005 | Shida et al. | 430/60 |
| 2006/0088778 | A1 | 4/2006 | Itami et al. | |
| 2009/0162097 | A1 * | 6/2009 | Fuchigami | 399/159 |
| 2010/0158561 | A1 * | 6/2010 | Mitsumori et al. | 399/111 |

FOREIGN PATENT DOCUMENTS

| | | | |
|---|---|---|---|
| JP | 2 8256 | | 1/1990 |
| JP | 3 128973 | | 5/1991 |
| JP | 4-353860 | | 12/1992 |
| JP | 6 202366 | | 7/1994 |
| JP | 6 273962 | | 9/1994 |
| JP | 7 271078 | | 10/1995 |
| JP | 2502404 | | 3/1996 |
| JP | 9-096916 | | 4/1997 |
| JP | 10 67946 | | 3/1998 |
| JP | 10 69116 | | 3/1998 |
| JP | 10 260545 | | 9/1998 |
| JP | 2881921 | | 2/1999 |
| JP | 11 202519 | | 7/1999 |
| JP | 2000 7933 | | 1/2000 |
| JP | 2000 242016 | | 9/2000 |
| JP | 2000 258939 | | 9/2000 |
| JP | 2001 115054 | | 4/2001 |
| JP | 2001115054 | A * | 4/2001 |
| JP | 2001 290292 | | 10/2001 |
| JP | 2002-341569 | | 11/2002 |
| JP | 2003-084472 | | 3/2003 |
| JP | 2003-233206 | | 8/2003 |
| JP | 2004 78140 | | 3/2004 |
| JP | 2004-133018 | | 4/2004 |
| JP | 2004-240027 | | 8/2004 |
| JP | 2005 181467 | | 7/2005 |
| JP | 2005 292782 | | 10/2005 |
| JP | 2005 292810 | | 10/2005 |
| JP | 2005 338445 | | 12/2005 |
| JP | 2005-338446 | | 12/2005 |
| JP | 2006 10918 | | 1/2006 |
| JP | 2006 154753 | | 6/2006 |
| WO | 96 39251 | | 12/1996 |
| WO | WO 2004/095144 | A1 | 11/2004 |
| WO | 2006 054397 | | 5/2006 |

OTHER PUBLICATIONS

U.S. Appl. No. 12/612,982, filed Nov. 5, 2009, Fuchigami.
U.S. Appl. No. 12/613,023, filed Nov. 5, 2009, Fuchigami.
U.S. Appl. No. 12/301,121, filed Nov. 17, 2008, Mitsumori, et al.
U.S. Appl. No. 12/300,943, filed Nov. 14, 2008, Mitsumori, et al.
U.S. Appl. No. 12/301,088, filed Nov. 17, 2008, Mitsumori, et al.
U.S. Appl. No. 12/301,376, filed Nov. 18, 2008, Mitsumori, et al.
U.S. Appl. No. 12/300,853, filed Nov. 14, 2008, Fuchigami, et al.
U.S. Appl. No. 12/301,361, filed Nov. 18, 2008, Mitsumori, et al.
U.S. Appl. No. 13/188,743, filed Jul. 22, 2011, Fuchigami.
Office Action issued Nov. 30, 2011, in Japanese Patent Application No. 2007-133457 (with English-language Translation).
Office Action issued Nov. 30, 2011, in Japanese Patent Application No. 2007-133461 (with English-language Translation).
Office Action issued Sep. 4, 2012, in Japanese Patent Application No. 2007-133461 (with English-language Translation).

* cited by examiner

ELECTROPHOTOGRAPHIC PHOTORECEPTOR, IMAGE-FORMING APPARATUS, AND ELECTROPHOTOGRAPHIC CARTRIDGE

CROSS REFERENCE TO RELATED APPLICATION

This application is a 371 of PCT/JP07/060,225, filed on May 18, 2007, and claims priority to the following Japanese Patent Applications: JP 2006-139529, filed on May 18, 2006; and JP 2006-139533, filed on May 18, 2006.

TECHNICAL FIELD

The present invention relates to an electrophotographic photoreceptor having an undercoat layer, and an image-forming apparatus and an electrophotographic cartridge that include the photoreceptor.

BACKGROUND ART

Electrophotographic technology has been widely applied to the field of printers, as well as the field of copiers, due to its immediacy and formation of high-quality images. Electrophotographic photoreceptors (hereinafter, optionally, referred to as "photoreceptor") lie in the core technology of electrophotography, and organic photoreceptors using organic photoconductive materials have been developed, since they have advantages such as non-pollution and ease in production in comparison with inorganic photoconductive materials.

In general, an organic photoreceptor is composed of an electroconductive substrate and a photosensitive layer disposed thereon. Photoreceptors are classified into a so-called single-layer photoreceptor having a single photosensitive layer (single photosensitive layer) containing a binder resin dissolving or dispersing a photoconductive material therein; and a so-called multilayered photoreceptor composed of a plurality of laminated layers (laminated photosensitive layer) including a charge-generating layer containing a charge-generating material and a charge-transporting layer containing a charge-transporting material.

In the organic photoreceptor, changes in use environment of the photoreceptor or changes in electric characteristics during repeated use may cause various defects in an image formed with the photoreceptor. In a method as one technique for solving such disadvantages, an undercoat layer containing a binder resin and titanium oxide particles is provided between an electroconductive substrate and a photosensitive layer in order to stably form a good image (for example, refer to Patent Document 1).

The layer of the organic photoreceptor is generally formed by applying and drying a coating liquid prepared by dissolving or dispersing a material in a solvent, because of its high productivity. In such a case, since the titanium oxide particles and the binder resin are incompatible with each other in the undercoat layer, the coating liquid for forming the undercoat layer containing titanium oxide particles and the binder resin is provided in the form of a dispersion of titanium oxide particles.

Such a coating liquid has generally been produced by wet-dispersing titanium oxide particles in an organic solvent using a known mechanical pulverizer, such as a ball mill, a sand grind mill, a planetary mill, or a roll mill, by spending a long period of time (for example, refer to Patent Document 1). Furthermore, it is disclosed that when titanium oxide particles are dispersed in a coating liquid for forming an undercoat layer using a dispersion medium, an electrophotographic photoreceptor that exhibits excellent characteristics in repeated charging-exposure cycles even under conditions of low temperature and low humidity can be provided using titania or zirconia as the dispersion medium (for example, refer to Patent Document 2).

Phthalocyanines having photoconductive characteristics exhibiting highly sensitive to light with a long wavelength have been extensively studied as an excellent photoconductive material. In particular, phthalocyanines can be suitably applied to electrophotographic photoreceptors, plate-making materials in electrophotographic systems, or photoelectric transducers such as an image sensor, and are used as charge-generating materials of electrophotographic photoreceptors for long-wavelength semiconductor lasers or light-emitting diodes.

With phthalocyanines, it is known that physical properties such as absorption spectrum and photoconductivity vary depending on the type of the central metal and the physical properties significantly vary depending on its crystal form. Among phthalocyanines, for example, oxytitanium phthalocyanine and hydroxygallium phthalocyanine have highly sensitive photoconductive characteristics and are present in various crystal forms.

Among them, type V hydroxygallium phthalocyanine and type D crystalline oxytitanium phthalocyanine, which show distinct peaks near a Bragg angle ($2\theta \pm 0.2°$) of 27° to 29° in a powder X-ray diffraction spectrum to CuK$\alpha$ characteristic X-rays, exhibit high sensitivity (for example, refer to Patent Documents 3 and 4).

It is also known that so-called type D crystalline oxytitanium phthalocyanine exhibits significantly high sensitivity (for example, refer to Patent Document 3).

Furthermore, it is known that type D oxytitanium phthalocyanine shows a strong diffraction peak in a Bragg angle ($2\theta \pm 0.2°$) of 9.0° to 9.8° in a thin-layer X-ray diffraction spectrum to CuK$\alpha$ characteristic X-rays (for example, refer to Patent Documents 5 to 7).

In some production processes of oxytitanium phthalocyanine, titanium chloride or a chlorinated organic compound is used. As a result, the obtained oxytitanium phthalocyanine crystals may contain chlorine (for example, Patent Document 8).

[Patent Document 1] Japanese Unexamined Patent Application Publication No. 11-202519

[Patent Document 2] Japanese Unexamined Patent Application Publication No. 6-273962

[Patent Document 3] Japanese Unexamined Patent Application Publication No. 10-67946

[Patent Document 4] Japanese Unexamined Patent Application Publication No. 2-8256

[Patent Document 5] Japanese Patent No. 2881921

[Patent Document 6] Japanese Patent No. 2502404

[Patent Document 7] Japanese Unexamined Patent Application Publication No. 2000-7933

[Patent Document 8] Japanese Unexamined Patent Application Publication No. 2001-115054

DISCLOSURE OF INVENTION

Problems to be Solved by the Invention

There are demands for formation of a higher-quality image and a longer service life of an image-forming apparatus, but, in conventional technology such those described in Patent Documents 1 and 2, image defects such as black spots and fogs are noticeable, and these image defects increase during repeated use.

The phthalocyanines having crystal structures described in Patent Documents 3 to 8 are useful as charge-generating materials for electrophotographic photoreceptors. In particular, when oxytitanium phthalocyanine, called type D, which has a crystal structure that generally shows a distinct peak near a Bragg angle (2θ±0.2°) of 27.3° in a powder X-ray diffraction spectrum, is used in a photosensitive layer of an electrophotographic photoreceptor, the photoreceptor can have significantly high sensitivity. However, even in electrophotographic photoreceptors containing these phthalocyanines, the charging ability may decrease during repeated use of the electrophotographic photoreceptor.

In particular, since fogs and black spots increase in the case of use of the above-mentioned electrophotographic photoreceptor in a reverse-development image-forming apparatus, stabilization of electric characteristics and an improvement in image quality (for example, decreases in black spots and fogs and stability in repeated use) that are demanded in association with a recent speed-up of image-forming and higher-quality image are insufficient in some cases.

The present invention has been made for solving the above-described problems, and it is an object to provide an electrophotographic photoreceptor that exhibits excellent electric characteristics and can form a high-quality image, an image-forming apparatus and an electrophotographic cartridge that include the electrophotographic photoreceptor.

Means for Solving the Problems

The present inventors have conducted intensive studies in view of a combination of an undercoat layer and phthalocyanine and, as a result, have found the fact that a photoreceptor exhibiting particularly high sensitivity and superior characteristics in repeated use and low residual potential and reduced image defects can be obtained by a combination of a specific undercoat layer and a phthalocyanine showing at least one distinct main diffraction peak at a Bragg angle (2θ±0.2°) of 27.0° to 29.0° in a powder X-ray diffraction spectrum. The present invention has been thus completed.

Accordingly, an aspect of the present invention provides an electrophotographic photoreceptor including an undercoat layer containing metal oxide particles and a binder resin on an electroconductive substrate, and a photosensitive layer disposed on the undercoat layer, wherein the metal oxide particles have a volume average particle diameter of 0.1 μm or less and a 90% cumulative particle diameter of 0.3 μm or less which are measured by a dynamic light-scattering method in a liquid of the undercoat layer dispersed in a solvent mixture of methanol and 1-propanol at a weight ratio of 7:3; and the photosensitive layer contains crystalline phthalocyanine showing at least one distinct main diffraction peak at a Bragg angle (2θ±0.2°) of 27.0° to 29.0° in an X-ray diffraction spectrum (Claim 1).

In the electrophotographic photoreceptor of the present invention, the photosensitive layer preferably contains an oxytitanium phthalocyanine showing a distinct main diffraction peak at a Bragg angle (2θ±0.2°) of 27.3° in an X-ray diffraction spectrum (Claim 2).

Alternatively, in the electrophotographic photoreceptor of the present invention, the photosensitive layer preferably contains an oxytitanium phthalocyanine showing a distinct diffraction peak at a Bragg angle (2θ±0.2°) of 9.0° in an X-ray diffraction spectrum (Claim 3).

Alternatively, in the electrophotographic photoreceptor of the present invention, the photosensitive layer preferably contains an oxytitanium phthalocyanine showing a distinct diffraction peak at a Bragg angle (2θ±0.2°) of 9.6° in an X-ray diffraction spectrum (Claim 4).

Alternatively, in the electrophotographic photoreceptor of the present invention, the photosensitive layer preferably contains an oxytitanium phthalocyanine showing distinct diffraction peaks at Bragg angles (2θ±0.2°) of 9.5° and 9.7° in an X-ray diffraction spectrum (Claim 5).

Furthermore, the oxytitanium phthalocyanine preferably contains 1.5 wt % or less of chlorine (Claim 6).

The ratio of mass spectral intensity of chlorinated oxytitanium phthalocyanine in the oxytitanium phthalocyanine to that of non-substituted oxytitanium phthalocyanine is preferably 0.070 or less (Claim 7).

Furthermore, in the electrophotographic photoreceptor of the present invention, the photosensitive layer preferably contains a compound represented by the following Formula (I):

[Chemical Formula 1]

(I)

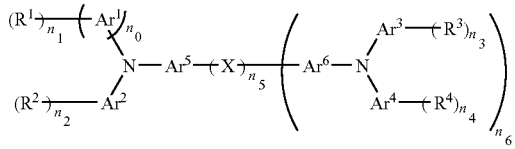

(in Formula (I), $Ar^1$ to $Ar^6$ each independently represent an aromatic moiety that may have a substituent; X represents an organic moiety that may have a substituent; $R^1$ to $R^4$ each independently represent an unsaturated group that may have a substituent; $n_1$ represents 1 or 2; and $n_0$ and $n_2$ to $n_6$ represent integers of 0 to 2) (Claim 8).

Furthermore, in Formula (I), all of $Ar^1$ to $Ar^6$ are preferably benzene moieties (Claim 9).

Furthermore, in Formula (I), $R^1$ to $R^4$ are preferably represented by the following Formula (II):

[Chemical Formula 2]

(II)

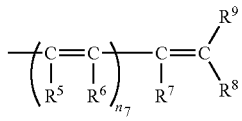

(in Formula (II), $R^5$ to $R^9$ each independently represent a hydrogen atom or an alkyl group or aryl group that may have a substituent; and $n_7$ represents an integer of 0 to 5) (Claim 10).

Another aspect of the present invention lies in an image-forming apparatus including the electrophotographic photoreceptor, charging means for charging the electrophotographic photoreceptor, image exposing means for forming an electrostatic latent image by conducting image exposure to the charged electrophotographic photoreceptor, development means for developing the electrostatic latent image with toner, and transfer means for transferring the toner to a transfer object (Claim 11).

Another aspect of the present invention lies in an electrophotographic cartridge including the electrophotographic photoreceptor and at least one of charging means for charging the electrophotographic photoreceptor, image exposing means for forming an electrostatic latent image by conducting image exposure to the charged electrophotographic photoreceptor, developing means for developing the electrostatic latent image with toner, transferring means for transferring the toner to a transfer object, fixing means for fixing the toner transferred to the transfer object, and cleaning means for recovering the toner adhering to the electrophotographic photoreceptor (Claim 12).

Advantages

The present invention can provide an electrophotographic photoreceptor that is excellent in electric characteristics and can form a high-quality image, and an image-forming apparatus and an electrophotographic cartridge that include the electrophotographic photoreceptor.

REFERENCE NUMERALS

Figure 1:
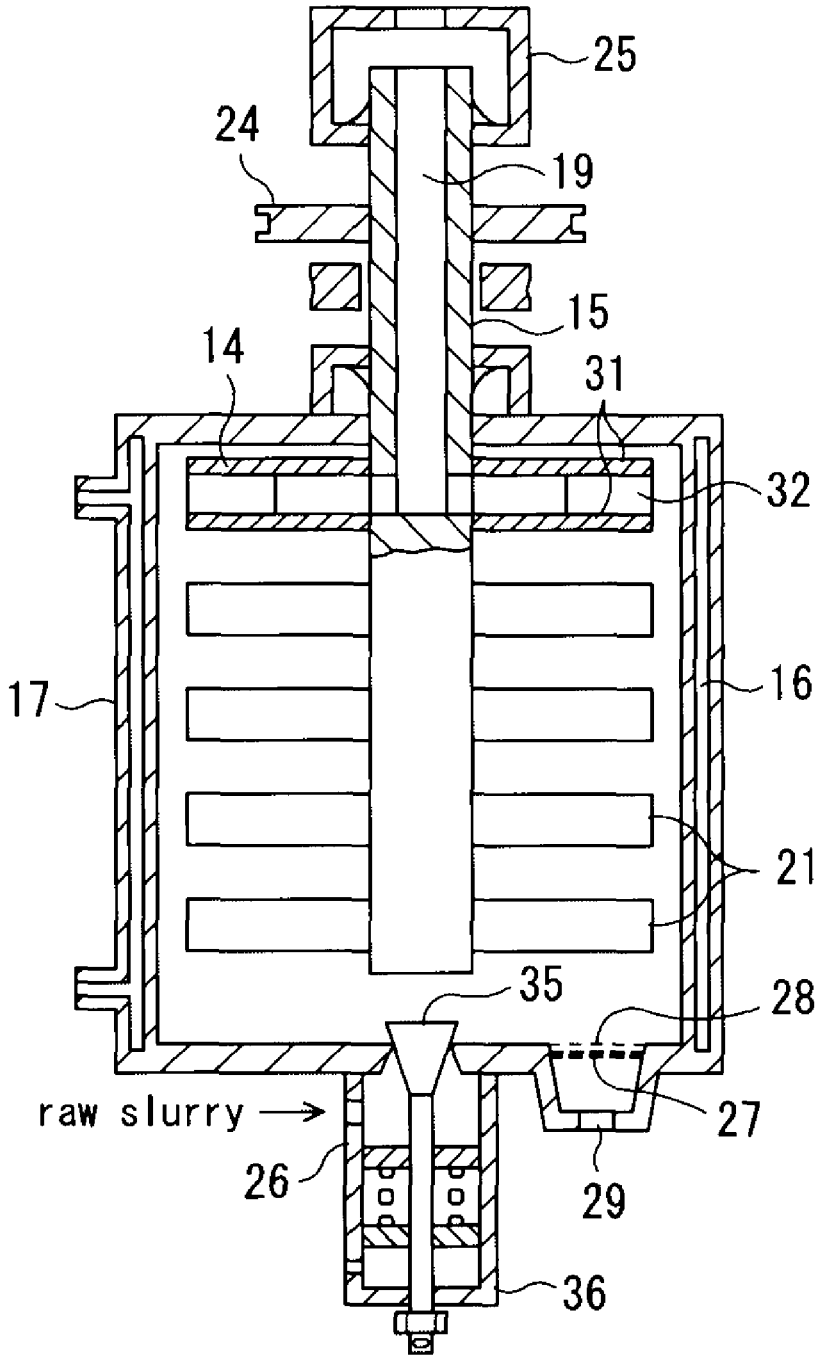
FIG. 1 is a longitudinal cross-sectional view schematically illustrating a structure of a wet agitating ball mill according to an embodiment of the present invention.

1 photoreceptor
2 charging device (charging roller)
3 exposure device
4 development device
5 transfer device
6 cleaning device
7 fixing device
14 separator
15 shaft
16 jacket
17 stator
19 discharging path
21 rotor
24 pulley
25 rotary joint
26 raw slurry supplying port
27 screen support
28 screen
29 product slurry outlet
31 disk
32 blade
35 valve element
41 development bath
42 agitator
43 supply roller
44 development roller
45 regulation member
71 upper fixing member (fixing roller)
72 lower fixing member (fixing roller)
73 heating device
100 sealing
101 mating ring
102 spring
103 fitting groove
104 O-ring
105 shaft
106 separator
107 spacer
108 rotor
109 stopper
110 screw
111 discharging path
112 hole
113 spacer
114 blade fitting groove
115 disk
116 blade
T toner
P transfer material (paper, medium)

BEST MODES FOR CARRYING OUT THE INVENTION

Embodiments of the present invention will now be described in detail, but the description of components below is merely exemplary embodiments of the present invention. Accordingly, various modifications can be made within the scope of the present invention.

An electrophotographic photoreceptor of the present invention includes an undercoat layer containing metal oxide particles and a binder resin on an electroconductive substrate, and a photosensitive layer disposed on the undercoat layer. Furthermore, in the electrophotographic photoreceptor of the present invention, the metal oxide particles contained in the undercoat layer have a predetermined particle diameter distribution, and the photosensitive layer contains a specific crystalline phthalocyanine. The term "crystalline phthalocyanine" represents phthalocyanine having crystallinity.

[I. Electroconductive Substrate]

Any electroconductive substrate can be used without particular limitation, and mainly formed of metal materials such as aluminum, aluminum alloys, stainless steel, copper, and nickel; resin materials provided with conductivity by being mixed with an electroconductive powder, such as a metal, carbon, or tin oxide powder; and resins, glass, and paper on which the surfaces are coated with an electroconductive material, such as aluminum, nickel, or ITO (indium oxide-tin oxide alloy), by vapor deposition or coating.

In addition, the shape of the electroconductive substrate may be, for example, a drum, a sheet, or a belt. Furthermore, an electroconductive material having an appropriate resistance value may be coated on an electroconductive substrate of a metal material for controlling conductivity or surface properties or for covering defects.

Furthermore, in the case of the electroconductive substrate composed of a metal material such as an aluminum alloy, the metal material may be used after anodization treatment. If the anodization treatment is performed, it is desirable to conduct pore sealing treatment by a known method.

For example, an anodic oxide coating is formed by anodization in an acidic bath of, for example, chromic acid, sulfuric acid, oxalic acid, boric acid, or sulfamic acid. Among these acidic baths, anodization in sulfuric acid gives a particularly effective result. In the case of the anodization in sulfuric acid, preferred conditions are a sulfuric acid concentration of 100 to 300 g/L (gram/liter, hereinafter, optionally, liter is abbreviated to "L"), a dissolved aluminum concentration of 2 to 15 g/L, a liquid temperature of 15 to 30° C., a bath voltage of 10 to 20 V, and a current density of 0.5 to 2 A/dm$^2$, but the conditions are not limited thereto.

It is preferable to conduct pore sealing to the resulting anodic oxide coating. The pore sealing may be conducted by a known method and is preferably performed by, for example, low-temperature pore sealing treatment, dipping in an aqueous solution containing nickel fluoride as a main component, or high-temperature pore sealing treatment, dipping in an aqueous solution containing nickel acetate as a main component.

The concentration of the nickel fluoride aqueous solution used in the low-temperature pore sealing treatment may be appropriately determined, but the concentration in the range of 3 to 6 g/L can give a better result. Furthermore, in order to smoothly carry out the pore sealing treatment, the treatment temperature range is usually 25° C. or higher and preferably 30° C. or higher and usually 40° C. or lower and preferably 35° C. or lower. In addition, from the same viewpoint, the pH range of the nickel fluoride aqueous solution is usually 4.5 or higher and preferably 5.5 or higher and usually 6.5 or lower and preferably 6.0 or lower. Examples of a pH regulator include oxalic acid, boric acid, formic acid, acetic acid, sodium hydroxide, sodium acetate, and aqueous ammonia. The treating time is preferably in the range of one to three minutes per micrometer of coating thickness. Furthermore, the nickel fluoride aqueous solution may contain, for example, cobalt fluoride, cobalt acetate, nickel sulfate, or a surfactant in order to further improve the coating physical properties. Then, washing with water and drying complete the low-temperature pore sealing treatment.

On the other hand, examples of the pore sealing agent for high-temperature pore sealing treatment can include metal salt aqueous solutions of nickel acetate, cobalt acetate, lead acetate, nickel-cobalt acetate, and barium nitrate, and a nickel acetate aqueous solution is particularly preferred. The nickel acetate aqueous solution is preferably used in the concentration range of 5 to 20 g/L. The treatment temperature range is usually 80° C. or higher and preferably 90° C. or higher and usually 100° C. or lower and preferably 98° C. or lower. In addition, the pH of the nickel acetate aqueous solution is preferably in the range of 5.0 to 6.0. Here, examples of the pH regulator can include aqueous ammonia and sodium acetate. The treating time is usually 10 minutes or longer and preferably 20 minutes or longer. Furthermore, the nickel acetate aqueous solution may also contain, for example, sodium acetate, organic carboxylic acid, or an anionic or nonionic surfactant in order to improve physical properties of the coating. In addition, high-temperature water or high-temperature water vapor substantially not containing salts may be used for the treatment. Then, washing with water and drying complete the high-temperature pore sealing treatment.

When the anodic oxide coating has a large average thickness, severer pore sealing conditions may be required for treatment in a higher concentration of pore sealing solution at higher temperature for a longer period of time. In such a case, the productivity is decreased, and also surface defects, such as stains, blot, or blooming, may tend to occur on the coating surface. From these viewpoints, the anodic oxide coating is preferably formed so as to have an average thickness of usually 20 μm or less and particularly 7 μm or less.

The surface of the electroconductive substrate may be smooth or may be roughened by specific milling or by grinding treatment. In addition, the surface may be roughened by mixing particles having an appropriate particle diameter to the material constituting the support. Furthermore, a drawing tube can be directly used, without conducting milling treatment, for cost reduction. In particular, in the case of use of an aluminum support by non-milling treatment, such as drawing, impacting, or die processing, blot or adherents such as foreign materials present on the surface or small scratches are eliminated by the treatment to give a uniform and clean support, and it is therefore preferred.

[II. Undercoat Layer]

The undercoat layer contains metal oxide particles and a binder resin. In addition, the undercoat layer may contain other components that do not significantly impair the effects of the present invention.

The undercoat layer according to the present invention is provided between the electroconductive substrate and the photosensitive layer and has at least one function selected from the group including an improvement in adhesion between the electroconductive substrate and the photosensitive layer, covering of blot and scratches of the electroconductive substrate, prevention of carrier injection due to impurities or nonuniformity in surface physical property, an improvement in uniformity of electric characteristics, prevention of a decrease in surface potential during repeated use, and prevention of a change in local surface potential, which causes image defects. The undercoat layer is not essential for achieving photoelectric characteristics.

[II-1. Metal Oxide Particles]

[II-1-1. Type of Metal Oxide Particles]

Any metal oxide particle that can be used in an electrophotographic photoreceptor can be used as the metal oxide particles according to the present invention.

Examples of metal oxides that form the metal oxide particles include metal oxides containing single metal elements, such as titanium oxide, aluminum oxide, silicon oxide, zirconium oxide, zinc oxide, and iron oxide; and metal oxides containing multiple metal elements, such as calcium titanate, strontium titanate, and barium titanate. In particular, metal oxide particles composed of a metal oxide having a band gap of 2 to 4 eV are preferred. A significantly low band gap accelerates carrier injection from the electroconductive substrate, resulting in image defects such as black spots and color spots. A significantly high band gap precludes charge transfer due to electron trapping, resulting in poor electric characteristics.

Furthermore, the metal oxide particles may be composed of one type of particles or any combination of different types of particles in any ratio. In addition, the metal oxide particles may be composed of one metal oxide or any combination of two or more metal oxides in any ratio.

The metal oxide forming the metal oxide particles is preferably titanium oxide, aluminum oxide, silicon oxide, or zinc oxide, more preferably titanium oxide or aluminum oxide, and most preferably titanium oxide.

Furthermore, the metal oxide particles may have any crystal form that does not significantly impair the effects of the present invention. For example, the crystal form of the metal oxide particles composed of titanium oxide (i.e., titanium oxide particles) is not limited and may be any of rutile, anatase, brookite, or amorphous. In addition, these crystal forms of the titanium oxide particles may be present together.

Furthermore, the metal oxide particles may be subjected to various kinds of surface treatment, for example, treatment with a treating agent such as an inorganic material, e.g., tin oxide, aluminum oxide, antimony oxide, zirconium oxide, or silicon oxide or an organic material, e.g., stearic acid, a polyol, or an organic silicon compound.

In particular, when titanium oxide particles are used as the metal oxide particles, surface treatment is preferably conducted with an organic silicon compound. Examples of the organic silicon compound include silicone oils such as dimethylpolysiloxane and methylhydrogenpolysiloxane; organosilanes such as methyldimethoxysilane and diphenyldimethoxysilane; silazanes such as hexamethyldisilazane; and silane coupling agents such as vinyltrimethoxysilane, γ-mercaptopropyltrimethoxysilane, and γ-aminopropyltriethoxysilane.

Furthermore, the metal oxide particles are preferably treated with a silane treating agent represented by the following Formula (i):

[Chemical Formula 3]

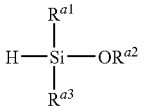

(i)

This silane treating agent has high reactivity with metal oxide particles and is a favorable treating agent.

In Formula (i), $R^{a1}$ and $R^{a2}$ each independently represent an alkyl group. The carbon numbers of $R^{a1}$ and $R^{a2}$ are not limited, but are each usually one or more and usually 18 or less, preferably 10 or less, and more preferably 6 or less. Preferable examples of $R^{a1}$ and $R^{a2}$ include a methyl group and an ethyl group.

In addition, in Formula (i), $R^{a3}$ represents an alkyl group or an alkoxy group. The carbon number of $R^{a3}$ is not limited, but is usually one or more and usually 18 or less, preferably 10 or less, and more preferably 6 or less. Preferable examples of $R^{a3}$ include a methyl group, an ethyl group, a methoxy group, and an ethoxy group.

Larger carbon numbers of $R^{a1}$ to $R^{a3}$ may cause less reactivity with metal oxide particles, or lower dispersion stability of the metal oxide particles in a coating liquid for forming an undercoat layer, after treatment.

The outermost surfaces of these surface-treated metal oxide particles are usually treated with a treating agent described above. In such a case, the above-described surface treatment may be one type of treatment or may be any combination of two or more types of treatment. For example, before the surface treatment with a silane treating agent represented by Formula (i), treatment with a treating agent, such as aluminum oxide, silicon oxide, or zirconium oxide, may be conducted. Furthermore, any combination of metal oxide particles subjected to different types of surface treatment in any ratio may be employed.

Examples of commercial products of the metal oxide particles according to the present invention are shown below, but the metal oxide particles according to the present invention are not limited to the products shown below.

Commercially available examples of the titanium oxide particles include ultrafine titanium oxide particles without surface treatment, "TTO-55 (N)"; ultrafine titanium oxide particles coated with $Al_2O_3$, "TTO-55 (A)" and "TTO-55 (B)"; ultrafine titanium oxide particles surface-treated with stearic acid, "TTO-55 (C)"; ultrafine titanium oxide particles surface-treated with $Al_2O_3$ and organosiloxane, "TTO-55 (S)"; high-purity titanium oxide "CR-EL"; titanium oxide produced by a sulfate process, "R-550", "R-580", "R-630", "R-670", "R-680", "R-780", "A-100", "A-220", and "W-10"; titanium oxide produced by a chlorine process, "CR-50", "CR-58", "CR-60", "CR-60-2", and "CR-67"; and electroconductive titanium oxide, "SN-100P", "SN-100D", and "ET-300 W" (these are manufactured by Ishihara Industry Co., Ltd.); titanium oxide such as "R-60", "A-110", and "A-150"; titanium oxide coated with $Al_2O_3$, "SR-1", "R-GL", "R-5N", "R-5N-2", "R-52N", "RK-1", and "A-SP"; titanium oxide coated with $SiO_2$ and $Al_2O_3$, "R-GX" and "R-7E"; titanium oxide coated with ZnO, $SiO_2$, and $Al_2O_3$, "R-650"; titanium oxide coated with $ZrO_2$ and $Al_2O_3$, "R-61N" (these are manufactured by Sakai Chemical Industry Co., Ltd.); and titanium oxide surface-treated with $SiO_2$ and $Al_2O_3$, "TR-700"; titanium oxide surface-treated with ZnO, $SiO_2$, and $Al_2O_3$, "TR-840" and "TA-500"; titanium oxide without surface treatment, "TA-100", "TA-200", and "TA-300"; titanium oxide surface-treated with $Al_2O_3$, "TA-400" (these are manufactured by Fuji Titanium Industry Co., Ltd.); titanium oxide without surface treatment, "MT-150 W" and "MT-500B"; titanium oxide surface-treated with $SiO_2$ and $Al_2O_3$, "MT-100SA" and "MT-500SA"; and titanium oxide surface-treated with $SiO_2$, $Al_2O_3$ and organosiloxane, "MT-100SAS" and "MT-500SAS" (these are manufactured by Tayca Corp.).

Commercially available examples of the aluminum oxide particles include "Aluminium Oxide C" (manufactured by Nippon Aerosil Co., Ltd.).

Commercially available examples of the silicon oxide particles include "200CF" and "R972" (manufactured by Nippon Aerosil Co., Ltd.) and "KEP-30" (manufactured by Nippon Shokubai Co., Ltd.).

Commercially available examples of the tin oxide particles include "SN-100P" (manufactured by Ishihara Industry Co., Ltd.).

Commercially available examples of the zinc oxide particles include "MZ-305S" (manufactured by Tayca Corp.).

[II-1-2. Physical Properties of Metal Oxide Particles]

The metal oxide particles according to the present invention satisfy the following requirements for the particle diameter distribution. That is, the metal oxide particles have a volume average particle diameter of 0.1 μm or less and a 90% cumulative particle diameter of 0.3 μm or less which are measured by a dynamic light-scattering method in a liquid of the undercoat layer of the present invention dispersed in a solvent mixture of methanol and 1-propanol at a weight ratio of 7:3 (hereinafter, optionally, referred to as "dispersion for undercoat layer measurement").

This point will be described in detail below.

[Regarding Volume Average Particle Diameter of Metal Oxide Particles]

The metal oxide particles according to the present invention have a volume average particle diameter of 0.1 μm or less, preferably 95 nm or less, and more preferably 90 nm or less which is measured in a dispersion for undercoat layer measurement by the dynamic light-scattering method. The volume average particle diameter has no lower limit, but is generally 20 nm or more. The electrophotographic photoreceptor of the present invention, which satisfies the above-mentioned range, is stabilized in repeated exposure-charge characteristics under low temperature and low humidity, and the occurrence of image defects, such as black spots and color spots, in the obtained image can be prevented.

[Regarding 90% Cumulative Particle Diameter of Metal Oxide Particles]

The metal oxide particles according to the present invention have a 90% cumulative particle diameter of 0.3 μm or less, preferably 0.25 μm or less, and more preferably 0.2 μm or less which is measured in a dispersion for undercoat layer measurement by the dynamic light-scattering method. The 90% cumulative particle diameter has no lower limit, but is generally 10 nm or more, preferably 20 nm or more, and more preferably 50 nm or more. In conventional electrophotographic photoreceptors, the undercoat layer contains huge metal oxide particle agglomerates that are formed by agglomeration of the metal oxide particles and extend across the undercoat layer from one surface to the other. Such huge metal oxide particle agglomerates may cause a defect in an image formed. Furthermore, in the case using contact-type charging means, charge may migrate from the charged photosensitive layer to an electroconductive substrate through the metal oxide particles, and thereby the charging cannot be properly achieved. However, in the electrophotographic photoreceptor of the present invention, since the 90% cumulative particle diameter is very small, the number of metal oxide particles having a large size such as to cause the above-described defect is significantly reduced. As a result, in the electrophotographic photoreceptor of the present invention, occurrence of the defect and improper charging can be prevented, and thereby a high-quality image can be formed.

[Methods for Measuring Volume Average Particle Diameter and 90% Cumulative Particle Diameter]

The volume average particle diameter and the 90% cumulative particle diameter of the metal oxide particles according to the present invention are determined by preparing a dispersion for undercoat layer measurement by dispersing the undercoat layer in a solvent mixture of methanol and 1-propanol at a weight ratio of 7:3 (this functions as a dispersion medium in the measurement of the particle size); and measuring particle size distribution of the metal oxide particles in the dispersion for undercoat layer by a dynamic light-scattering method.

In the dynamic light-scattering method, the particle size distribution is determined by irradiating finely dispersed particles with laser light to detect the scattering (Doppler shift) of light beams having different phases depending on the velocity of the Brownian motion of these particles. Values of the volume average particle diameter and 90% cumulative particle diameter in the dispersion for undercoat layer measurement are those when the metal oxide particles are stably dispersed in the dispersion for undercoat layer measurement and do not mean particle diameters in the formed undercoat layer. Specifically, actual measurements of the volume average particle diameter and 90% cumulative particle diameter are conducted with a dynamic light-scattering particle size analyzer (MICROTRAC UPA, model: 9340-UPA, manufactured by Nikkiso Co., Ltd., hereinafter abbreviated to UPA) under the conditions shown below. The actual measurement is conducted according to the instruction manual of the particle size analyzer (Nikkiso Co., Ltd., Document No. T15-490A00, revision No. E).

Setting of the Dynamic Light-Scattering Particle Size Analyzer

Upper measurement limit: 5.9978 μm
Lower measurement limit: 0.0035 μm
Number of channels: 44
Measurement time: 300 sec
Particle transparency: absorptive
Particle refractive index: N/A (not available)
Particle shape: non-spherical
Density: 4.20 g/cm$^3$ (*)
Dispersion medium: methanol/1-propanol=7/3
Refractive index of dispersion medium: 1.35

(*) This density value is applicable to titanium dioxide particles, and, for other particles, values described in the instruction manual are used.

The amount of the solvent mixture used, as a dispersion medium, of methanol and 1-propanol (weight ratio: methanol/1-propanol=7/3, refractive index=1.35) is adjusted such that the sample concentration index (SIGNAL LEVEL) of the dispersion for undercoat layer measurement ranges from 0.6 to 0.8.

The particle size by dynamic light-scattering is measured at 25° C.

The volume average particle diameter and the 90% cumulative particle diameter of the metal oxide particles according to the present invention are defined as follows: When the particle size distribution is measured by the dynamic light-scattering method described above, and when the cumulative curve of the volume particle size distribution is plotted from the minimum particle size by the dynamic light-scattering method where the total volume of the metal oxide particles is 100%, the particle size at a point of 50% in the cumulative curve is defined as the volume average particle diameter (median diameter), and the particle size at a point of 90% in the cumulative curve is defined as the 90% cumulative particle diameter.

[Other Physical Properties]

The metal oxide particles according to the present invention may have any average primary particle diameter that does not significantly impair the effects of the present invention. However, the average primary particle diameter of the metal oxide particles according to the present invention is usually 1 nm or more and preferably 5 nm or more and usually 100 nm or less, preferably 70 nm or less, and more preferably 50 nm or less.

Furthermore, this average primary particle diameter can be determined based on the arithmetic mean value of the diameters of particles that are directly observed with a transmission electron microscope (hereinafter, optionally, referred to as "TEM").

Also, the refractive index of the metal oxide particles according to the present invention does not have any limitation, and those that can be used in electrophotographic photoreceptors can be used. The refractive index of the metal oxide particles according to the present invention is usually 1.3 or more and preferably 1.4 or more and usually 3.0 or less, preferably 2.9 or less, and most preferably 2.8 or less.

In addition, as the refractive index of metal oxide particles, reference values described in various publications can be used. For example, they are shown in the following Table 1 according to Filler Katsuyo Jiten (Filler Utilization Dictionary, edited by Filler Society of Japan, Taiseisha LTD., 1994).

TABLE 1

| | Refractive index |
|---|---|
| Titanium oxide (rutile) | 2.76 |
| Lead titanate | 2.70 |
| Potassium titanate | 2.68 |
| Titanium oxide (anatase) | 2.52 |
| Zirconium oxide | 2.40 |
| Zinc sulfide | 2.37 to 2.43 |
| Zinc oxide | 2.01 to 2.03 |
| Magnesium oxide | 1.64 to 1.74 |
| Barium sulfate (precipitated) | 1.65 |
| Calcium sulfate | 1.57 to 1.61 |
| Aluminum oxide | 1.56 |
| Magnesium hydroxide | 1.54 |
| Calcium carbonate | 1.57 to 1.60 |
| Quartz glass | 1.46 |

The undercoat layer of the present invention can contain the metal oxide particles and the binder resin at any ratio that does not significantly impair the effects of the present invention. However, in the undercoat layer of the present invention, the amount of the metal oxide particles to one part by weight of the binder resin is usually 0.5 part by weight or more, preferably 0.7 part by weight or more, and more preferably 1.0 part by weight or more and usually 4 parts by weight or less, preferably 3.8 parts by weight or less, and more preferably 3.5 parts by weight or less. A smaller ratio of the metal oxide particles to the binder resin may cause unsatisfactory electric characteristics of the resulting electrophotographic photoreceptor, in particular, an increase in the residual potential. A larger ratio may cause noticeable image defects, such as black spots and color spots, in an image formed with the electrophotographic photoreceptor.

[II-2. Binder Resin]

The undercoat layer of the present invention can contain any binder resin that does not significantly impair the effects of the present invention. In general, a binder resin that can be used is soluble in a solvent such as an organic solvent and is insoluble or hardly soluble in and substantially immiscible with a solvent such as an organic solvent that is used in a coating liquid for forming a photosensitive layer.

Examples of such a binder resin include phenoxy resins, epoxy resins, polyvinylpyrrolidone, polyvinyl alcohol, casein, polyacrylic acid, celluloses, gelatin, starch, polyurethane, polyimide, and polyamide. These resins may be used alone or in the cured form with a curing agent. In particular, polyamide resins such as alcohol-soluble copolymerized polyamides and modified polyamides exhibit favorable dispersibility and coating characteristics, and are preferred.

Examples of the polyamide resin include so-called copolymerized nylons, such as copolymers of 6-nylon, 66-nylon, 610-nylon, 11-nylon, and 12-nylon; and alcohol-soluble nylon resins, such as chemically modified nylons, e.g., N-alkoxymethyl-modified nylon and N-alkoxyethyl-modified nylon. Examples of commercially available products include "CM4000" and "CM8000" (these are manufactured by Toray Industries, Inc.), "F-30K", "MF-30", and "EF-30T" (these are manufactured by Nagase Chemtex Corporation).

Among these polyamide resins, particularly preferred is a copolymerized polyamide resin containing a diamine component corresponding to a diamine represented by the following Formula (ii):

[Chemical Formula 4]

(ii)

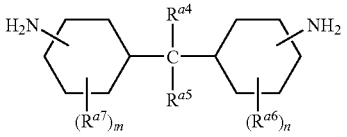

(hereinafter, the diamine component is optionally referred to as "diamine component corresponding to Formula (ii)").

In Formula (ii), each of $R^{a4}$ to $R^{a7}$ represents a hydrogen atom or an organic substituent, and m and n each independently represent an integer of 0 to 4. When a plurality of the substituents are present, these substituents may be the same or different from each other.

Preferable examples of the organic substituent represented by $R^{a4}$ to $R^{a7}$ include hydrocarbon groups that may contain hetero atoms. Among them, preferred examples are alkyl groups such as a methyl group, an ethyl group, a n-propyl group, and an isopropyl group; alkoxy groups such as a methoxy group, an ethoxy group, a n-propoxy group, and an isopropoxy group; and aryl groups such as a phenyl group, a naphthyl group, an anthryl group, and a pyrenyl group. More preferred are an alkyl group and an alkoxy group; and most preferred are a methyl group and an ethyl group.

The number of the carbon atoms in the organic substituent represented by $R^{a4}$ to $R^{a7}$ is not limited as long as the effects of the present invention are not significantly impaired, and is usually 20 or less, preferably 18 or less, and more preferably 12 or less and usually 1 or more. A significantly large number of carbon atoms leads to low solubility to a solvent for preparation of a coating liquid for forming an undercoat layer, and poor storage stability of the coating liquid for forming the undercoat layer even if the resin can be dissolved.

The copolymerized polyamide resin containing a diamine component corresponding to Formula (ii) may contain a constitutional unit other than the diamine component corresponding to Formula (ii) (hereinafter, optionally, referred to as "other polyamide constituent" simply). Examples of the other polyamide constituent include lactams such as γ-butyrolactam, ε-caprolactam, and lauryllactam; dicarboxylic acids such as 1,4-butanedicarboxylic acid, 1,12-dodecanedicarboxylic acid, and 1,20-eicosanedicarboxylic acid; diamines such as 1,4-butanediamine, 1,6-hexamethylenediamine, 1,8-octamethylenediamine, and 1,12-dodecanediamine; and piperazine. Furthermore, the copolymerized polyamide resin may be, for example, a binary, tertiary, or quaternary copolymer of the constituent.

When the copolymerized polyamide resin containing the diamine component corresponding to Formula (ii) contains another polyamide constitutional unit, the amount of the diamine component corresponding to Formula (ii) to the total constituents is not limited, but is usually 5 mol % or more, preferably 10 mol % or more, and more preferably 15 mol % or more and usually 40 mol % or less and preferably 30 mol % or less. A significantly large amount of diamine component corresponding to Formula (ii) may lead to poor stability of the coating liquid for forming an undercoat layer. A significantly small amount may lead to considerably low stability of the electric characteristics under conditions of high temperature and high humidity against environmental changes.

Examples of the copolymerized polyamide resin are shown below. In these examples, the copolymerization ratio represents the feed ratio (molar ratio) of monomers.

[Chemical Formula 5]

(1)

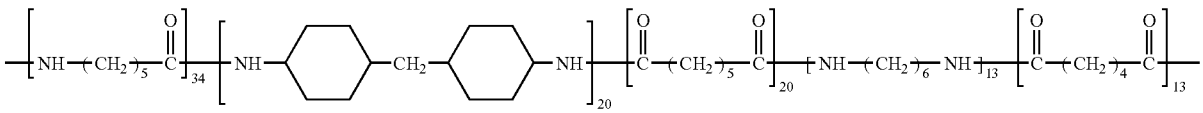

-continued (2)

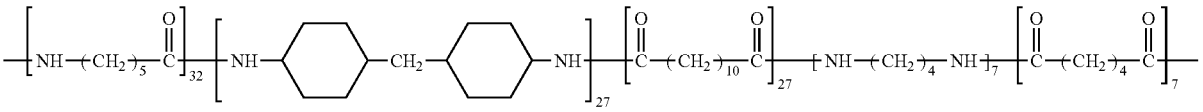

(3)

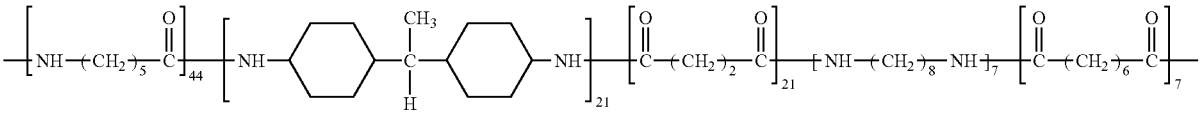

(4)

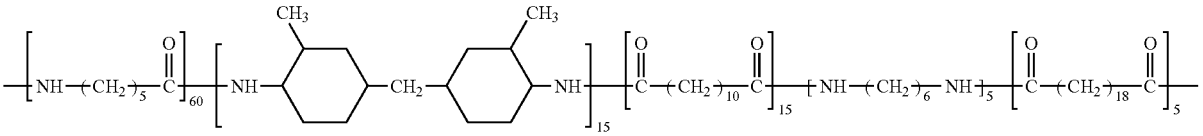

(5)

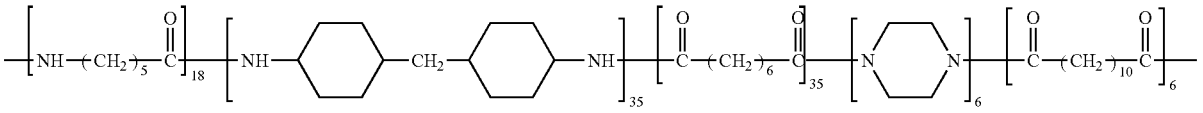

(6)

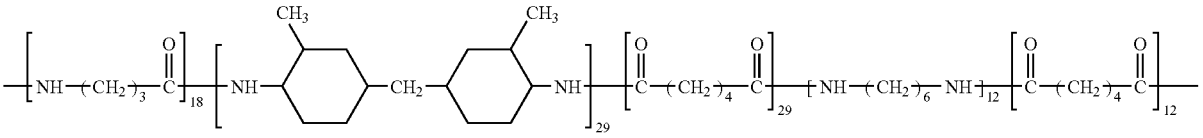

(7)

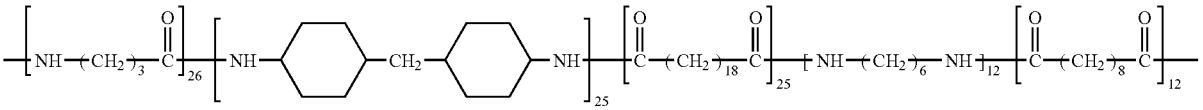

The copolymerized polyamide may be produced by any method without particular limitation and is properly produced by usual polycondensation of polyamide. For example, polycondensation such as melt polymerization, solution polymerization, or interfacial polymerization can be properly employed. Furthermore, in the polymerization, for example, monobasic acids such as acetic acid or benzoic acid; or monoacidic bases such as hexylamine or aniline may be contained in a polymerization system as a molecular weight adjuster.

The binder resins may be used alone or in any combination of two or more kinds in any ratio.

Furthermore, the binder resin according to the present invention may have any number average molecular weight without limitation. For example, for a binder resin of copolymerized polyamide, the number average molecular weight of the copolymerized polyamide is usually 10000 or more and preferably 15000 or more and usually 50000 or less and preferably 35000 or less. If the number average molecular weight is too small or too large, the undercoat layer tends to be difficult to maintain the uniformity.

[II-3. Other Component]

The undercoat layer of the present invention may contain other components in addition to the metal oxide particles and the binder resin, within a range that does not significantly impair the effects of the present invention. For example, the undercoat layer may contain any additive as the other component.

Examples of the additive include thermal stabilizers represented by sodium phosphite, sodium hypophosphite, phosphorous acid, hypophosphorous acid, and hindered phenol; other polymerization additives; and antioxidants. The additives may be used alone or in any combination of two or more kinds in any ratio.

[II-4. Physical Properties of Undercoat Layer]

[Film Thickness]

The undercoat layer may have any thickness. However, from the viewpoints of improvements in photoreceptive characteristics of the electrophotographic photoreceptor of the present invention and in coating characteristics, the thickness is usually 0.1 μm or more, preferably 0.3 μm or more, and more preferably 0.5 μm or more and usually 20 μm or less, preferably 15 μm or less, and more preferably 10 μm or less.

[Surface Roughness]

The undercoat layer according to the present invention may have any surface profile, but usually has characteristic in-plane root mean square roughness (RMS), in-plane arithmetic mean roughness (Ra), and in-plane maximum roughness (P-V). These numerical values are obtained by applying the reference lengths of the root mean square height, arithmetic mean height, and maximum height in the specification of JIS B 0601:2001 to a reference plane. The in-plane root mean square roughness (RMS) represents the root mean square of Z(x)'s, which are values in the height direction in the reference plane; the in-plane arithmetic mean roughness (Ra) represents the average of the absolute values of Z(x)'s; and the in-plane maximum roughness (P-V) represents the sum of the maximum height and the maximum depth of Z(x).

The in-plane root mean square roughness (RMS) of the undercoat layer according to the present invention is usually 10 nm or more and preferably 20 nm or more and usually 100 nm or less and preferably 50 nm or less. A smaller in-plane root mean square roughness (RMS) may impair the adhesion to an overlying layer. A larger roughness may cause an uneven coating thickness of the overlying layer.

The in-plane arithmetic mean roughness (Ra) of the undercoat layer according to the present invention is usually 10 nm or more and usually 50 nm or less. A smaller in-plane arithmetic mean roughness (Ra) may impair the adhesion to an overlying layer. A larger roughness may cause an uneven coating thickness of the overlying layer.

The in-plane maximum roughness (P-V) of the undercoat layer according to the present invention is usually 100 nm or more and preferably 300 nm or more and usually 1000 nm or less and preferably 800 nm or less. A smaller in-plane maximum roughness (P-V) may impair adhesion to an overlying layer. A larger roughness may cause an uneven coating thickness of the overlying layer.

The measures (RMS, Ra, P-V) representing the surface profile may be determined with any surface analyzer that can precisely measure irregularities in the reference plane. Particularly, it is preferred to determine these measures by a method of detecting irregularities on the surface of the sample by combining high-precision phase shift detection with counting of the order of interference fringes using an optical interference microscope. More specifically, they are preferably measured by an interference fringe addressing method at a wave mode using Micromap manufactured by Ryoka Systems Inc.

[Absorbance in Dispersion]

When the undercoat layer according to the present invention is dispersed in a solvent that can dissolve the binder resin binding the undercoat layer to prepare a dispersion (hereinafter, optionally, referred to as "dispersion for absorbance measurement"), the absorbance of the dispersion generally has specific physical properties.

The absorbance of the dispersion for absorbance measurement can be measured with a generally known absorption spectrophotometer. Since the conditions for measuring absorbance, such as a cell size and sample concentration, vary depending on physical properties of the metal oxide particles used, such as particle diameter and refractive index, in general, the sample concentration is properly adjusted so as not to exceed the detection limit of the detector within the wavelength region (400 to 1000 nm in the present invention) to be measured.

The cell size (light path length) used for the measurement is 10 mm. Any cell can be used as long as the cell is substantially transparent in the range of 400 to 1000 nm. Quartz cells are preferably used, and matched cells having the difference in transmittance characteristics between a sample cell and a standard cell within a predetermined range are particularly preferred.

Before preparation of a dispersion for absorbance measurement by dispersing the undercoat layer according to the present invention, overlying layers, such as photosensitive layer, disposed on the undercoat layer are removed by dissolving the layers in a solvent that can dissolve these layers on the undercoat layer, but not substantially dissolve the binder resin binding the undercoat layer, and then the binder resin in the undercoat layer is dissolved in a solvent to give the dispersion for absorbance measurement. The solvent that can dissolve the undercoat layer preferably does not have high light absorption in the wavelength region of 400 to 1000 nm.

Examples of the solvent that can dissolve the undercoat layer include alcohols such as methanol, ethanol, 1-propanol, and 2-propanol. In particular, methanol, ethanol, and 1-propanol are preferred. These solvents may be used alone or in any combination of two or more kinds in any ratio.

In particular, in a dispersion for absorbance measurement dispersing the undercoat layer according to the present invention in a solvent mixture of methanol and 1-propanol at a weight ratio of 7:3, the difference between the absorbance to light with 400 nm wavelength and the absorbance to light with 1000 nm wavelength (absorbance difference) is as follows: For a refractive index of metal oxide particles of 2.0 or more, the absorbance difference is usually 0.3 (Abs) or less and preferably 0.2 (Abs) or less. For a refractive index of metal oxide particles of less than 2.0, the absorbance difference is usually 0.02 (Abs) or less and preferably 0.01 (Abs) or less.

The absorbance depends on the solid content concentration of a liquid to be measured. Therefore, in the measurement of absorbance, the concentration of the metal oxide particles dispersed in the dispersion is preferably adjusted to the range of 0.003 to 0.0075 wt %.

[Regular Reflection Rate of Undercoat Layer]

The regular reflection rate of the undercoat layer according to the present invention usually shows a value specific to the present invention. The regular reflection rate of the undercoat layer according to the present invention means the rate of the regular reflection of an undercoat layer on an electroconductive substrate to that of the electroconductive substrate. Since the regular reflection rate of the undercoat layer varies depending on the thickness of the undercoat layer, the reflectance here is defined as that when the thickness of the undercoat layer is 2 μm.

In the undercoat layer according to the present invention, for a refractive index of the metal oxide particles contained in the undercoat layer of 2.0 or more, the ratio of the reflectance of 480 nm light on the undercoat layer to the reflectance of 480 nm light on the electroconductive substrate is usually 50% or more, where the ratio is converted into that of the undercoat layer with a thickness of 2 μm.

On the other hand, for a refractive index of the metal oxide particles contained in the undercoat layer of less than 2.0, the ratio of the reflectance of 400 nm light on the undercoat layer to the reflectance of 400 nm light on the electroconductive substrate is usually 50% or more, where the ratio is converted into that of the undercoat layer with a thickness of 2 μm.

Here, even if the undercoat layer contains different types of metal oxide particles with refractive indices of 2.0 or more or different types of metal oxide particles with refractive indices less than 2.0, the regular reflection rate is preferably in the above-mentioned range. Furthermore, even if the undercoat layer contains both metal oxide particles with a refractive index of 2.0 or more and metal oxide particles with a refractive index less than 2.0, as in the case of the undercoat layer containing metal oxide particles with a refractive index of 2.0 or more, the ratio of the regular reflection of the undercoat layer to light with a 480 nm wavelength to the regular reflection of the electroconductive substrate to light with 480 nm wavelength is preferably in the above-mentioned range (50% or more), where the regular reflection rate is converted into that of the undercoat layer with a thickness of 2 μm.

Hitherto, cases of the undercoat layer having a thickness of 2 μm are described in detail. In the electrophotographic photoreceptor according to the present invention, however, the thickness of the undercoat layer is not limited to 2 μm and may have any thickness. In the case of the undercoat layer having a thickness other than 2 μm, the regular reflection rate can be measured using a coating liquid for forming an undercoat layer (described below) that is used for forming the undercoat layer having a thickness other than 2 μm and forming an undercoat layer having a thickness of 2 μm on an electroconductive substrate equivalent to the electrophotographic photoreceptor and measuring the regular reflection rate of the undercoat layer. Alternatively, the regular reflection rate of the undercoat layer of the electrophotographic photoreceptor is measured, and then the regular reflection rate may be converted into that of an undercoat layer with a thickness of 2 μm.

A conversion process will be described below.

A layer having a small thickness dL and being perpendicular to the light is supposed for the detection of specific monochromatic light that passes through the undercoat layer, is regularly reflected on the electroconductive substrate, and then passes again through the undercoat.

A decrease in intensity −dI of the light that passed through the layer with a small thickness dL is proportional to the intensity I before the light passes through the layer and the layer thickness dL, as is expressed by the equation (k is a constant) below.

$$-dI=kIdL \qquad \text{Equation (A).}$$

Equation (A) can be modified as follows:

$$-dI/I=kdL \qquad \text{Equation (B).}$$

By integrating both sides of Equation (B) over the intervals from $I_0$ to I and from 0 to L, respectively, the following equation is obtained. Here, $I_0$ represents the intensity of the incident light.

$$\log(I_0/I)=kL \qquad \text{Equation (C).}$$

Equation (C) is identical to one called Lambert's law in a solution system and can be applied to measurement of the reflectance in the present invention.

Equation (C) can be modified as follows:

$$I=I_0\exp(-kL) \qquad \text{Equation (D).}$$

The behavior of the incident light before it reaches the surface of an electroconductive substrate is represented by Equation (D).

The reflectance on the surface of a cylinder is represented by $R=I_1/I_0$ where $I_1$ represents the intensity of the reflected light, since the denominator of the regular reflection rate is reflected light to the conductive substrate of the incident light.

The light that reaches the surface of the electroconductive substrate in accordance with Equation (D) is reflected after being multiplied by the reflectance R and then passes through the optical path L again toward the surface of the undercoat layer. That is, the following expression is obtained:

$$I=I_0\exp(-kL)\cdot R\cdot\exp(-kL) \qquad \text{Equation (E).}$$

$R=I_1/I_0$ is assigned and the equation is further modified to obtain a relationship:

$$I/I_1=\exp(-2kL) \qquad \text{Equation (F).}$$

This is the reflectance of the undercoat layer relative to the reflectance of the electroconductive substrate and is defined as the regular reflection rate.

As described above, in the case of a 2 μm undercoat layer, the to-and-fro optical path length is 4 μm, and the reflectance T of the undercoat layer on an optional electroconductive substrate is a function of the thickness L of the undercoat layer (in this case, the optical path length is 2 L) and is represented by T(L). From Equation (F), the following equation is obtained:

$$T(L)=I/I_1=\exp(-2kL) \qquad \text{Equation (G).}$$

Furthermore, since the value that should be determined is T(2), L=2 is assigned to Equation (G) to obtain:

$$T(2)=I/I_1=\exp(-4k) \qquad \text{Equation (H),}$$

and k is deleted by Equations (G) and (H) to obtain:

$$T(2)=T(L)^{2/L} \qquad \text{Equation (I).}$$

That is, at a thickness L (μm) of the undercoat layer, the reflectance T(2) for an undercoat layer of 2 μm thickness can be estimated with considerable accuracy by measuring the reflectance T(L) of the undercoat layer. The thickness L of the undercoat layer can be measured by any film thickness measuring apparatus such as a roughness meter.

[III. Method for Forming Undercoat Layer]

The undercoat layer according to the present invention can be formed by any method without limitation. However, in general, the undercoat layer can be obtained by applying a coating liquid for forming an undercoat layer containing metal oxide particles and a binder resin onto the surface of an electroconductive substrate and drying the liquid.

[III-1. Coating Liquid for Forming Undercoat Layer]

The coating liquid for forming an undercoat layer according to the present invention contains metal oxide particles and a binder resin. In addition, the coating liquid for forming an undercoat layer according to the present invention generally contains a solvent. Furthermore, the coating liquid for forming an undercoat layer according to the present invention may contain other components in a range that does not significantly impair the effects of the present invention.

[III-1-1. Metal Oxide Particle]

The metal oxide particles are the same as those described as the metal oxide particles contained in the undercoat layer.

However, the particle diameter distribution of the metal oxide particles in the coating liquid for forming the undercoat layer according to the present invention, in general, should meet the following requirements: the volume average particle diameter and 90% cumulative particle diameter, measured by a dynamic light-scattering method, of the metal oxide particles in the coating liquid for forming the undercoat layer according to the present invention are the same as the volume average particle diameter and 90% cumulative particle diameter, measured by a dynamic light-scattering method, of the metal oxide particles in the dispersion for undercoat layer measurement described above, respectively.

Accordingly, in the coating liquid for forming an undercoat layer according to the present invention, the volume average particle diameter of the metal oxide particles is usually 0.1 μm or less (refer to [Regarding volume average particle diameter of metal oxide particles]).

The metal oxide particles in the coating liquid for forming an undercoat layer according to the present invention are desirably present in the form of primary particles. However, in general, it is rare, and, in many cases, the metal oxide particles are aggregated into secondary particles or are present as a mixture of the both. Therefore, the profile of the particle size distribution is significantly important in such a state.

Therefore, in the coating liquid for forming an undercoat layer according to the present invention, precipitation and a change in viscosity in the coating liquid for forming an undercoat layer are suppressed by controlling the volume average particle diameter of the metal oxide particles in the coating liquid for forming an undercoat layer to the aforementioned range (0.1 μm or less), resulting in uniformity of the thickness and the surface characteristics of the formed undercoat layer. On the other hand, a larger volume average particle diameter (larger than 0.1 μm) of the metal oxide particles leads to accelerated precipitation and a large change in viscosity in the coating liquid for forming an undercoat layer, resulting in irregularity of the thickness and the surface characteristics of the formed undercoat layer. This may adversely affect the quality of overlying layers (such as a charge-generating layer).

Furthermore, in the coating liquid for forming an undercoat layer according to the present invention, the metal oxide particles usually have a 90% cumulative particle diameter of 0.3 μm or less (refer to [Regarding 90% cumulative particle diameter of metal oxide particles]).

The metal oxide particles in the coating liquid for forming an undercoat layer according to the present invention are desirably present in the form of primary particles. However, actually, such metal oxide particles cannot be practically obtained. The present inventors have found the fact that when the 90% cumulative particle diameter is sufficiently small, i.e., when the 90% cumulative particle diameter is 0.3 μm or less, the coating liquid for forming an undercoat layer exhibits less gelation and a small change in viscosity and therefore can be stored for a long period of time, even if the metal oxide particles aggregate and that, as a result, the thickness and surface characteristics of the formed undercoat layer can be uniform. On the other hand, when the diameter of the metal oxide particles in the coating liquid for forming an undercoat layer is too large, the gelation and the change in viscosity of the liquid are large and the thickness and surface characteristics of the formed undercoat layer are not uniform. This may also adversely affect the quality of overlying layers (such as a charge-generating layer).

The volume average particle diameter and the 90% cumulative particle diameter of the metal oxide particles in the coating liquid for forming an undercoat layer are directly measured with the coating liquid for forming an undercoat layer, not with the dispersion for measuring an undercoat layer, not the metal oxide particles in the coating liquid for forming an undercoat layer. This method for measurement is different from that for measuring the volume average particle diameter and the 90% cumulative particle diameter of the metal oxide particles in the dispersion for undercoat layer measurement in the following points. In other points, this method for measuring the volume average particle diameter and the 90% cumulative particle diameter of the metal oxide particles in the coating liquid for forming an undercoat layer is the same as that of the volume average particle diameter and the 90% cumulative particle diameter of the metal oxide particles in the dispersion for undercoat layer measurement.

That is, in the measurement of the volume average particle diameter and the 90% cumulative particle diameter of the metal oxide particles in the coating liquid for forming an undercoat layer, the dispersion medium is the solvent used in the coating liquid for forming an undercoat layer, and the dispersion refractive index is that of the solvent used in the coating liquid for forming an undercoat layer. In addition, if the concentration of the coating liquid for forming an undercoat layer is too high and is outside of the range that a measurement apparatus can measure, the coating liquid for forming an undercoat layer is diluted with a solvent mixture of methanol and 1-propanol (weight ratio: methanol/1-propanol=7/3, refractive index=1.35) such that the resulting concentration of the coating liquid for forming an undercoat layer is within the measurable range of the measurement apparatus. For example, in the case of the aforementioned UPA, the coating liquid for forming an undercoat layer is diluted with a solvent mixture of methanol and 1-propanol into a sample concentration index (SIGNAL LEVEL) within the range from 0.6 to 0.8, which is suitable for measurement. Since, even if such dilution is conducted, it is believed that the volume particle diameter of the metal oxide particles in the coating liquid for forming an undercoat layer does not vary, the volume average particle diameter and the 90% cumulative particle diameter after the dilution are regarded as the volume average particle diameter and the 90% cumulative particle diameter of metal oxide microparticles in the coating liquid for forming the undercoat layer.

The absorbance of the coating liquid for forming an undercoat layer according to the present invention can be measured by a generally known absorption spectrophotometer. Since the conditions for measuring absorbance, such as a cell size and sample concentration, vary depending on physical properties, such as particle diameter and refractive index, of metal oxide particles used, the sample concentration is properly adjusted so as not to exceed the detection limit of a detector in a wavelength region (400 to 1000 nm in the present invention) to be measured. In the present invention, the concentration of the metal oxide particles in a sample of the coating liquid for forming an undercoat layer is controlled to 0.0075 to 0.012 wt %. In general, the solvent for adjusting the sample concentration is the solvent used for the coating liquid for forming an undercoat layer. However, any solvent that has compatibility to the solvent of the coating liquid for forming an undercoat layer and the binder resin and does not cause turbidity or the like and does not have high light absorption in a wavelength region of 400 to 1000 nm can be used. Examples of such solvents include alcohols such as methanol, ethanol, 1-propanol, and 2-propanol; hydrocarbons such as toluene and xylene; ethers such as tetrahydrofuran; and ketones such as methyl ethyl ketone and methyl isobutyl ketone.

The cell size (light path length) used for the measurement is 10 mm. Any cell substantially transparent in the range of 400 to 1000 nm can be used. Quartz cells are preferably used, and matched cells having different transmittance characteristics within a predetermined range between a sample cell and a standard cell are particularly preferred.

In a dispersion prepared by dispersing the coating liquid for forming an undercoat layer of the present invention in a solvent mixture of methanol and 1-propanol at a weight ratio of 7:3, the difference between the absorbance to light with 400 nm wavelength and the absorbance to light with 1000 nm wavelength is preferably 1.0 (Abs) or less for a refractive index of metal oxide particles of 2.0 or more, or is preferably 0.02 (Abs) or less for a refractive index of metal oxide particles of less than 2.0.

[III-1-2. Binder Resin]

The binder resin contained in the coating liquid for forming an undercoat layer is the same as that contained in the undercoat layer, which has been described.

However, the binder resin may be contained in the coating liquid for forming an undercoat layer at any content that does not significantly impair the effects of the present invention, and is usually 0.5 wt % or more and preferably 1 wt % or more and usually 20 wt % or less and preferably 10 wt % or less.

[III-1-3. Solvent]

Any solvent can be used as a solvent for the coating liquid for forming an undercoat layer (solvent for the undercoat layer) according to the present invention as long as it can dissolve the binder resin according to the present invention. The solvent is usually an organic solvent, and examples thereof include alcohols containing five or less carbon atoms at most, such as methanol, ethanol, isopropyl alcohol, and normal propyl alcohol; halogenated hydrocarbons such as chloroform, 1,2-dichloroethane, dichloromethane, trichlene, carbon tetrachloride, and 1,2-dichloropropane; nitrogen-containing organic solvents such as dimethylformamide; and aromatic hydrocarbons such as toluene and xylene.

Furthermore, these solvents may be used alone or in any combination of two or more kinds in any ratio. Furthermore, even if a solvent alone cannot dissolve the binder resin according to the present invention, the solvent can be used in the form of a mixture with another solvent (for example, the organic solvents described above) that can dissolve the binder resin as the mixture. In general, a solvent mixture can advantageously reduce unevenness in coating.

In the coating liquid for forming an undercoat layer according to the present invention, the ratio of solid components, such as the metal oxide particles and the binder resin, to the solvent varies depending on the method for coating the coating liquid for forming an undercoat layer and may be determined such that uniform coating can be formed in the coating method that is applied. Specifically, the solid content in the coating liquid for forming an undercoat layer is usually 1 wt % or more and preferably 2 wt % or more and usually 30 wt % or less and preferably 25 wt % or less, from the viewpoints of stability and coating characteristics of the coating liquid for forming an undercoat layer.

[III-1-4. Other Components]

Other components contained in the coating liquid for forming an undercoat layer are the same as those contained in the undercoat layer, which has been described above.

[III-1-5. Advantage of Coating Liquid for Forming an Undercoat Layer]

The coating liquid for forming an undercoat layer according to the present invention has high storage stability. There are many measures of storage stability, for example, in the coating liquid for forming an undercoat layer according to the present invention, the rate of change in viscosity after storage for 120 days at room temperature compared to that immediately after the production (i.e., the value obtained by dividing a difference between the viscosity after storage for 120 days and the viscosity immediately after the production by the viscosity immediately after the production) is usually 20% or less, preferably 15% or less, and more preferably 10% or less. The viscosity can be measured by a method in accordance with JIS Z 8803 using an E-type viscometer (product name: ED, manufactured by Tokimec Inc.).

Furthermore, the use of the coating liquid for forming an undercoat layer according to the present invention enables highly efficient production of electrophotographic photoreceptors with high quality.

[III-2. Method of Producing Coating Liquid for Forming an Undercoat Layer]

The coating liquid for forming an undercoat layer according to the present invention may be produced by any method without limitation. However, the coating liquid for forming an undercoat layer according to the present invention contains metal oxide particles as described above, and the metal oxide particles are present in the form of dispersion in the coating liquid for forming an undercoat layer. Therefore, the method of producing the coating liquid for forming an undercoat layer according to the present invention usually includes a step of dispersing the metal oxide particles.

The metal oxide particles may be dispersed in a solvent (hereinafter, optionally, the solvent used for dispersion is referred to as "dispersion solvent") by, for example, wet dispersion using a known mechanical pulverizer (dispersing apparatus), such as a ball mill, a sand grind mill, a planetary mill, or a roll mill. It is believed that the metal oxide particles according to the present invention are dispersed so as to have the above-described predetermined particle diameter distribution through this dispersion step. The dispersion solvent may be that used in the coating liquid for forming an undercoat layer or may be another solvent. However, when a solvent other than the solvent used in the coating liquid for forming an undercoat layer is used as the dispersion solvent, the metal oxide particles after the dispersion and the solvent to be used in the coating liquid for forming an undercoat layer are necessarily mixed or subjected to solvent exchange. In such an occasion, it is preferable that the mixing or the solvent exchange be carried out so as to avoid aggregation of the metal oxide particles in order to maintain the predetermined particle diameter distribution.

Among wet dispersion methods, a dispersion using a dispersion medium is particularly preferred.

Any known dispersing apparatus can be used for dispersing using a dispersion medium, and examples thereof include a pebble mill, a ball mill, a sand mill, a screen mill, a gap mill, a vibration mill, a paint shaker, and an attritor. Among them, the dispersion apparatus can preferably disperse metal oxide particles by circulation. Furthermore, from the viewpoints of, for example, dispersion efficiency, final particle size, and continuous operation, wet agitating ball mills such as a sand mill, a screen mill, and a gap mill are particularly preferred. These mills may be either a vertical type or a horizontal type. In addition, the disk of the mill may have any shape, and, for example, a flat plate type, a vertical pin type, or a horizontal pin type can be used. A liquid circulating type sand mill is preferred.

The dispersion may be conducted with one type of dispersion apparatus or with any combination of two or more kinds.

In the dispersion using a dispersion medium, the volume average particle diameter and the 90% cumulative particle diameter of the metal oxide particles in the coating liquid for forming an undercoat layer can be adjusted in the above-mentioned ranges by using a dispersion medium having a predetermined average particle diameter.

That is, in the method of producing a coating liquid for forming an undercoat layer according to the present invention, the metal oxide particles are dispersed in a wet agitating ball mill such that the dispersion medium of the wet agitating ball mill has an average particle diameter of usually 5 μm or more and preferably 10 μm or more and usually 200 μm or less and preferably 100 μm or less. A dispersion medium having a smaller particle diameter tends to give a homogeneous dispersion within a shorter period of time. However, a dispersion medium having an excessively small particle diameter has significantly small mass, which may preclude efficient dispersion.

It is believed that the use of a dispersion medium having the above-described average particle diameter is a factor for adjusting the volume average particle diameter and the 90% cumulative particle diameter of metal oxide particles in a coating liquid for forming an undercoat layer within the desired ranges by the above-mentioned production method. Therefore, the coating liquid for forming an undercoat layer produced in a wet agitating ball mill with metal oxide particles dispersed using a dispersion medium having the above-mentioned average particle diameter favorably satisfies the requirements of the coating liquid for forming an undercoat layer according to the present invention.

Since the dispersion medium is substantially spherical, the average particle diameter can be determined by a sieving method using sieves described in, for example, JIS Z 8801: 2000 or image analysis, and the density can be measured by Archimedes's method. For example, the average particle diameter and the sphericity of the dispersion medium can be measured with an image analyzer represented by LUZEX50 manufactured by Nireco Corp.

The density of the dispersion medium is not limited, but is usually 5.5 g/cm$^3$ or more, preferably 5.9 g/cm$^3$ or more, and more preferably 6.0 g/cm$^3$ or more. In general, a dispersion medium having a higher density tends to give homogeneous dispersion within a shorter time. The sphericity of the dispersion medium is preferably 1.08 or less and more preferably 1.07 or less.

As the material of the dispersion medium, any known dispersion medium can be used, as long as it is insoluble in a dispersion solvent contained in the aforementioned slurry, has a specific gravity higher than that of the slurry, and does not react with the slurry nor degrade the slurry. Examples of the dispersion medium include steel balls such as chrome balls (bearing steel balls) and carbon balls (carbon steel balls); stainless steel balls; ceramic balls such as silicon nitride, silicon carbide, zirconia, and alumina balls; and balls coated with films of, for example, titanium nitride or titanium carbonitride. Among them, preferred are ceramic balls, and particularly preferred are fired zirconia balls are more preferred. More specifically, fired zirconia beads described in Japanese Patent No. 3400836 are particularly preferred.

The dispersion media may be used alone or in any combination of two or more kinds in any ratio.

Among the aforementioned wet agitating ball mills, preferably used is one including a cylindrical stator, a slurry supplying port disposed at one end of the stator, a slurry discharging port disposed at the other end of the stator, a rotor for agitating and mixing a dispersion medium packed in the stator and slurry supplied from the supplying port, and a separator that is rotatably connected to the discharging port and separates the dispersion medium and the slurry by the centrifugal force to discharge the slurry from the discharging port.

Here, the slurry contains at least metal oxide particles and a dispersion solvent.

Now, the structure of this wet agitating ball mill will now be described in detail.

The stator is a tubular (usually, cylindrical) container having a hollow portion and is provided with a slurry supplying port at one end and a slurry discharging port at the other end. In addition, the hollow portion of the inside is filled with a dispersion medium so that metal oxide particles in slurry are dispersed by the dispersion medium. Furthermore, the slurry is supplied to the inside of the stator from the supplying port, and the slurry in the stator is discharged from the discharging port to the exterior of the stator.

The rotor is disposed in the interior of the stator and agitates and mixes the dispersion medium and the slurry. The rotor may be of any type such as a pin, disk, or annular type.

Furthermore, the separator separates the dispersion medium and the slurry. This separator is connected to the discharging port of the stator, separates the slurry and the dispersion medium in the stator, and discharge the slurry from the discharging port of the stator to the exterior of the stator.

The separator used is rotatable and is desirably of an impeller-type. The separator is configured such that the dispersion medium and the slurry are separated from each other by centrifugal force that is generated by the rotation of the separator.

The separator may be rotated in synchronization with the rotor or independently of the rotor.

Furthermore, the wet agitating ball mill preferably includes a shaft serving as a rotary shaft of the separator. In addition, this shaft is preferably provided with a hollow discharging path communicating with the discharging port, at the center of the shaft. That is, it is preferable that the wet agitating ball mill include at least a cylindrical stator, a slurry supplying port disposed at one end of the stator, a slurry discharging port disposed at the other end of the stator, a rotor agitating and mixing a dispersion medium packed in the stator and slurry supplied from the supplying port, an impeller separator that is connected to the discharging port and is rotatable to separate the dispersion medium and the slurry from each other by centrifugal force effect and discharge the slurry from the discharging port, and a shaft serving as the rotary shaft of the separator where a hollow discharging path connected to the discharging port is disposed in the center of the shaft.

The discharging path provided to the shaft connects the rotary center of the separator and the discharging port of the stator. Therefore, the slurry separated from the dispersion medium by the separator is transported to the discharging port through the discharging path and is then discharged from the discharging port to the exterior of the stator. The discharging path extends through the center of the shaft. Since the centrifugal force does not work at the center of the shaft, the slurry discharged has no kinetic energy. Consequently, wasteful kinetic energy is not generated, excess energy is not consumed.

Such a wet agitating ball mill may be horizontally disposed, but is preferably vertically disposed in order to increase the filling ratio of the dispersion medium. In the vertical installation, the discharging port is preferably disposed at the upper end of the mill. Furthermore, the separator is desirably disposed at a position above the level of the packed dispersion medium.

When the discharging port is disposed at the upper end of the mill, the supplying port is disposed at the bottom of the mill. In this case, more preferably, the supplying port consists of a valve seat and a vertically movable valve element that is fitted to the valve seat and has a V-shape, a trapezoidal shape, or a cone shape so as to be in line contact with the edge of the valve seat. With this, an annular slit can be formed between the edge of the valve seat and the valve element to prevent a dispersion medium from passing through. Therefore, at the supplying port, slurry is supplied without deposition of the dispersion medium. In addition, it is possible to discharge the dispersion medium by spreading the slit by lifting the valve element or to seal the mill by closing the slit by lowering the valve element. Furthermore, since the slit is defined by the valve element and the edge of the valve seat, coarse particles (metal oxide particles) in the slurry are barely caught in and, even if caught, the particles can be readily removed upward or downward. Thus, occlusion hardly occurs.

In addition, coarse particles trapped in the slit can be removed from the slit by vertical vibration of the valve element with vibration means, and occlusion of the particles can also be prevented by the vibration. Furthermore, the vibration of the valve element applies shearing force to the slurry to decrease the viscosity thereof, resulting in an increased amount of slurry passing through the slit (i.e., the amount of supply). Any means can be used for vibrating the valve element without limitation. For example, in addition to mechanical means such as a vibrator, means of changing the pressure of compressed air that acts on a piston combined with the valve element, such as a reciprocating compressor or an electromagnetic switching valve of switching supply and discharge of compressed air, can be used.

Such a wet agitating ball mill is desirably provided with a screen for separating the dispersion medium and a slurry outlet at the bottom so that the slurry remaining in the wet agitating ball mill can be discharged after the completion of dispersion.

Furthermore, in the case that the wet agitating ball mill is vertically disposed, the shaft is pivoted at the upper end of the stator, an O-ring and a mechanical seal having a mating ring are disposed at a bearing portion bearing the shaft disposed at the upper end of the stator, and the bearing portion is provided with an annular groove for fitting the O-ring, and the O-ring is fitted to the annular groove, it is preferable that a tapered cut broadening downward be provided at the lower side of the annular groove. That is, it is preferable that the wet agitating ball mill include a cylindrical vertical stator, a slurry supplying port disposed at the bottom of the stator, a slurry discharging port disposed at the upper end of the stator, a shaft pivoted at the upper end of the stator and rotated by driving means such as a motor, a pin-, disk-, or annular rotor fixed to the shaft and agitating/mixing the dispersion medium packed in the stator and the slurry supplied from the supplying port, a separator disposed near the discharging port and separating the dispersion medium from the slurry, and a mechanical seal disposed at the bearing portion bearing the shaft at the upper end of the stator, and that a tapered cut broadening downward be provided at the lower side of an annular groove for fitting an O-ring being in contact with a mating ring of the mechanical seal is fitted.

In this wet agitating ball mill, the mechanical seal is provided at the upper end of the stator above the level of the liquid in the center of the shaft at which the dispersion medium and the slurry substantially do not have kinetic energy. This can significantly reduce intrusion of the dispersion medium and the slurry into a gap between the mating ring of the mechanical seal and the lower side portion of the O-ring fitting groove.

Furthermore, the lower side of the annular groove for fitting the O-ring broadens downward by a cut so that the clearance spreads. Therefore, intrusion of the slurry and the dispersion medium or clogging caused by solidification thereof hardly occurs, and the mating ring smoothly follows the seal ring to maintain the functions of the mechanical seal. In addition, the lower portion of the fitting groove to which the O-ring is fitted has a V-shaped cross-section. Since the entire wall is not thin, the strength is maintained, and the O-ring has high holding ability.

In particular, the separator preferably includes two disks having blade-fitting grooves on the inner faces facing each other, a blade fitted to the fitting grooves and lying between the disks, and supporting means supporting the disks having the blade therebetween from both sides. That is, it is preferable that the wet agitating ball mill include a cylindrical stator, a slurry supplying port disposed at one end of the stator, a slurry discharging port disposed at the other end of the stator, a rotor agitating and mixing the dispersion medium packed in the stator and the slurry supplied from the supplying port, and a rotatable separator provided in the stator, connected to the discharging port, separating the slurry from the dispersion medium by centrifugal force, and discharging the slurry from the discharging port, and that the separator include two disks having fitting grooves for a blade on the inner faces facing each other, the blade fitted to the fitting grooves and lying between the disks, and supporting means supporting the disks having the blade therebetween from both sides. In such a case, preferably, the supporting means is defined by a shoulder of a shouldered shaft and cylindrical pressing means fitted to the shaft and pressing the disks, and supports the disks having the blade therebetween by pinching them from both sides with the shoulder of the shaft and the pressing means. With such a wet agitating ball mill, the metal oxide particles in the undercoat layer can readily have a volume average particle diameter and a 90% cumulative particle diameter within the aforementioned ranges. Here, the separator preferably has an impeller-type structure.

The structure of the above-described vertical wet agitating ball mill will now be more specifically described with reference to an embodiment of the wet agitating ball mill. However, the agitating apparatus used for producing the coating liquid for an undercoat layer of the present invention is not limited to those exemplified here.

FIG. 1 is a longitudinal cross-sectional view schematically illustrating a structure of a wet agitating ball mill according to this embodiment. In FIG. 1, slurry (not shown) is supplied to the vertical wet agitating ball mill and is agitated with a dispersion medium (not shown) in the mill for pulverization. Then, the slurry is separated from the dispersion medium by a separator 14 and is discharged through a discharging path 19 in the center of a shaft 15 and then is recycled via a return path (not shown) for further milling.

As shown in FIG. 1 in detail, the vertical wet agitating ball mill has a stator 17 provided with a vertically cylindrical jacket 16 that allows a flow of water for cooling the mill; a shaft 15 that is rotatably born on the upper portion of the stator 17 at the center of the stator 17 and has a mechanical seal shown in FIG. 2 (described below) at a bearing portion and has a hollow center as a discharging path 19 at the upper portion; pin- or disk-shaped rotors 21 protruding in the radial direction at the lower portion of the shaft 15; a pulley 24, for transmitting driving force, fixed to the upper portion of the shaft 15; a rotary joint 25 mounted on an open end at the upper end of the shaft 15; a separator 14, for separating the medium, fixed to the shaft 15 near the upper portion in the stator 17; a slurry supplying port 26 disposed to the bottom of the stator 17 so as to oppose to the end of the shaft 15; and a screen 28, for separating the dispersion medium, mounted on a grid screen support 27 that is provided to a slurry outlet 29 disposed at an eccentric position of the bottom of the stator 17.

The separator 14 consists of a pair of disks 31 fixed to the shaft 15 with a predetermined interval and a blade 32 connecting these disks 31 to define an impeller and rotates with the shaft 15 to apply centrifugal force to the dispersion medium and the slurry entrapped between the disks 31 for centrifuging the dispersion medium in the radial direction and discharging the slurry through the discharging path 19 in the center of the shaft 15 by the difference in specific gravity.

The slurry supplying port 26 consists of an inverted trapezoidal valve element 35 that is vertically movable and is fitted to a valve seat disposed at the bottom of the stator 17 and a cylindrical body 36 having a bottom and protruding downward from the bottom of the stator 17. The valve element 35 is lifted upon the supply of slurry to form an annular slit (not shown) with the valve seat, whereby the slurry is supplied to the interior of the stator 17.

When a raw material is supplied, the valve element 35 is lifted by a supply pressure due to the slurry supplied to the inside of the cylindrical body 36, against the pressure in the mill, to form a slit between itself and the valve seat.

In order to prevent clogging of the slit, the valve element 35 repeats vertical shock involving lifting to the upper limit position within a short cycle. This vibration of the valve element 35 may be constantly performed, or may be performed when a large amount of coarse particles are contained in the slurry or in conjunction with an increase in supply pressure of the slurry due to clogging.

Figure 2:
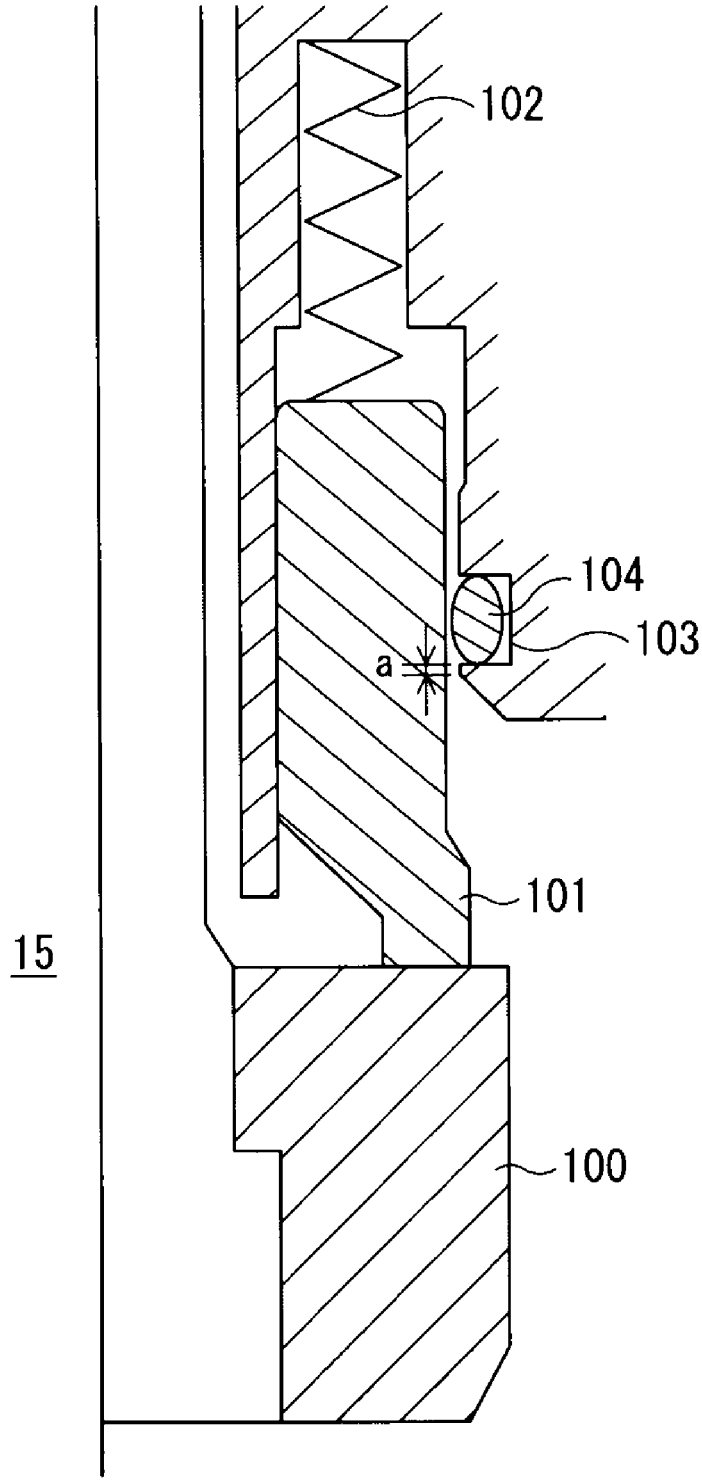
FIG. 2 is an enlarged longitudinal cross-sectional view schematically illustrating a mechanical seal used in a wet agitating ball mill according to an embodiment of the present invention.

In the mechanical seal, as shown in FIG. 2 in detail, a mating ring 101 at the stator side is biased by a spring 102 to a seal ring 100 fixed to the shaft 15. The stator 17 and the mating ring 101 are sealed by an O-ring 104 that is fitted to a fitting groove 103 at the stator side. In FIG. 2, a tapered cut (not shown) broadening downward is provided at the lower portion of the O-ring fitting groove 103. The length "a" of minimum clearance between the lower portion of the fitting groove 103 and the mating ring 101 is small in order to prevent deterioration of the sealing between the mating ring 101 and the seal ring 100 due to inhibited motion of the mating ring 101 by solidification of trapped medium or slurry.

In the above embodiment, the rotors 21 and the separator 14 are fixed to the same shaft 15. In another embodiment, however, they are fixed to different shafts coaxially arranged and are independently rotated. In the embodiment shown above, since the rotor and the separator are provided to the same shaft, a single driving apparatus is required, resulting in simplification of the structure. In the latter embodiment, the rotor and the shaft are mounted on the different shafts and are independently rotated by the respective driving apparatuses, and thus the rotor and the separator are independently driven at their optimum rotation rates.

Figure 3:
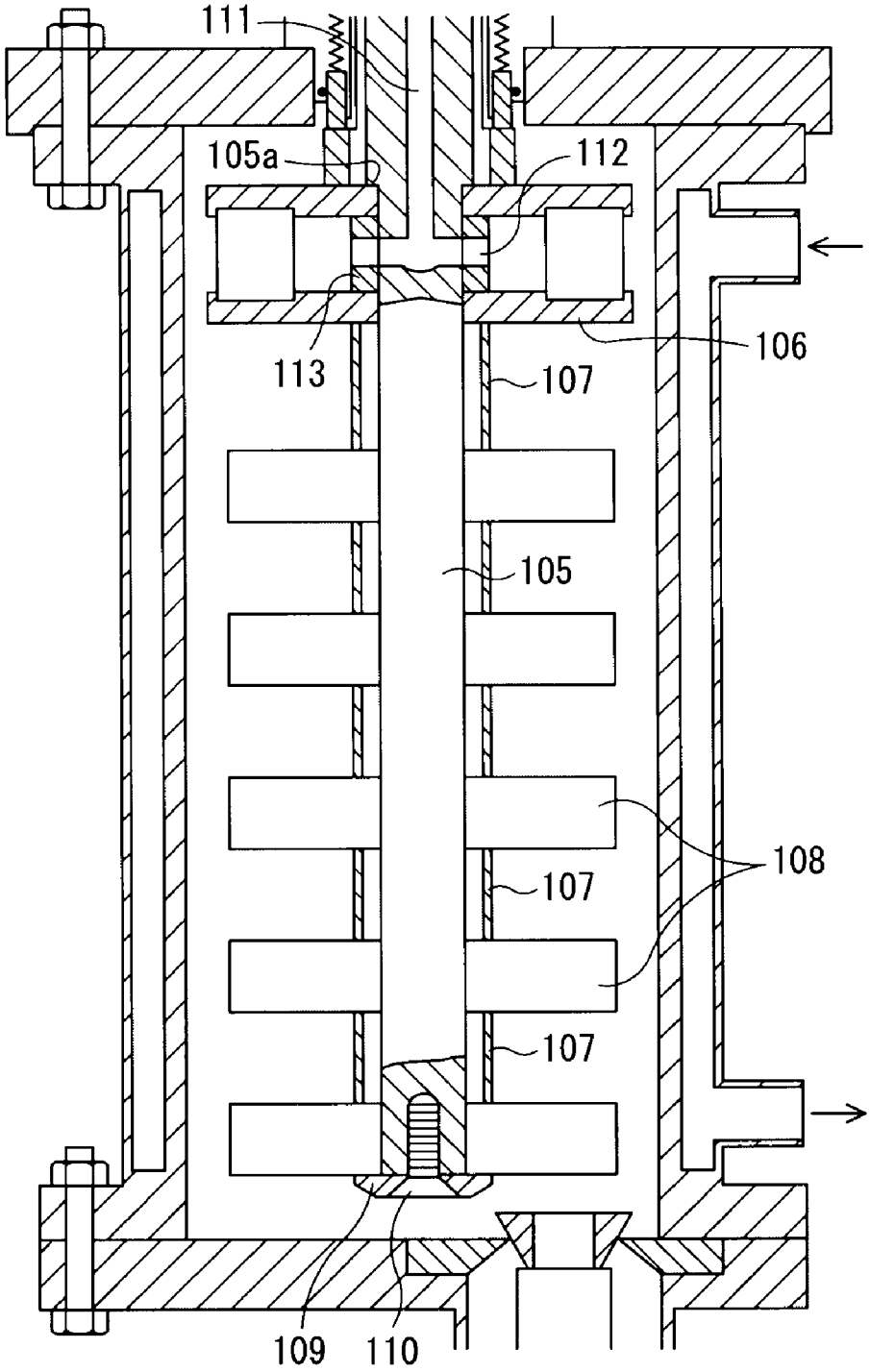
FIG. 3 is a longitudinal cross-sectional view schematically illustrating another example of a wet agitating ball mill according to an embodiment of the present invention.
Figure 4:
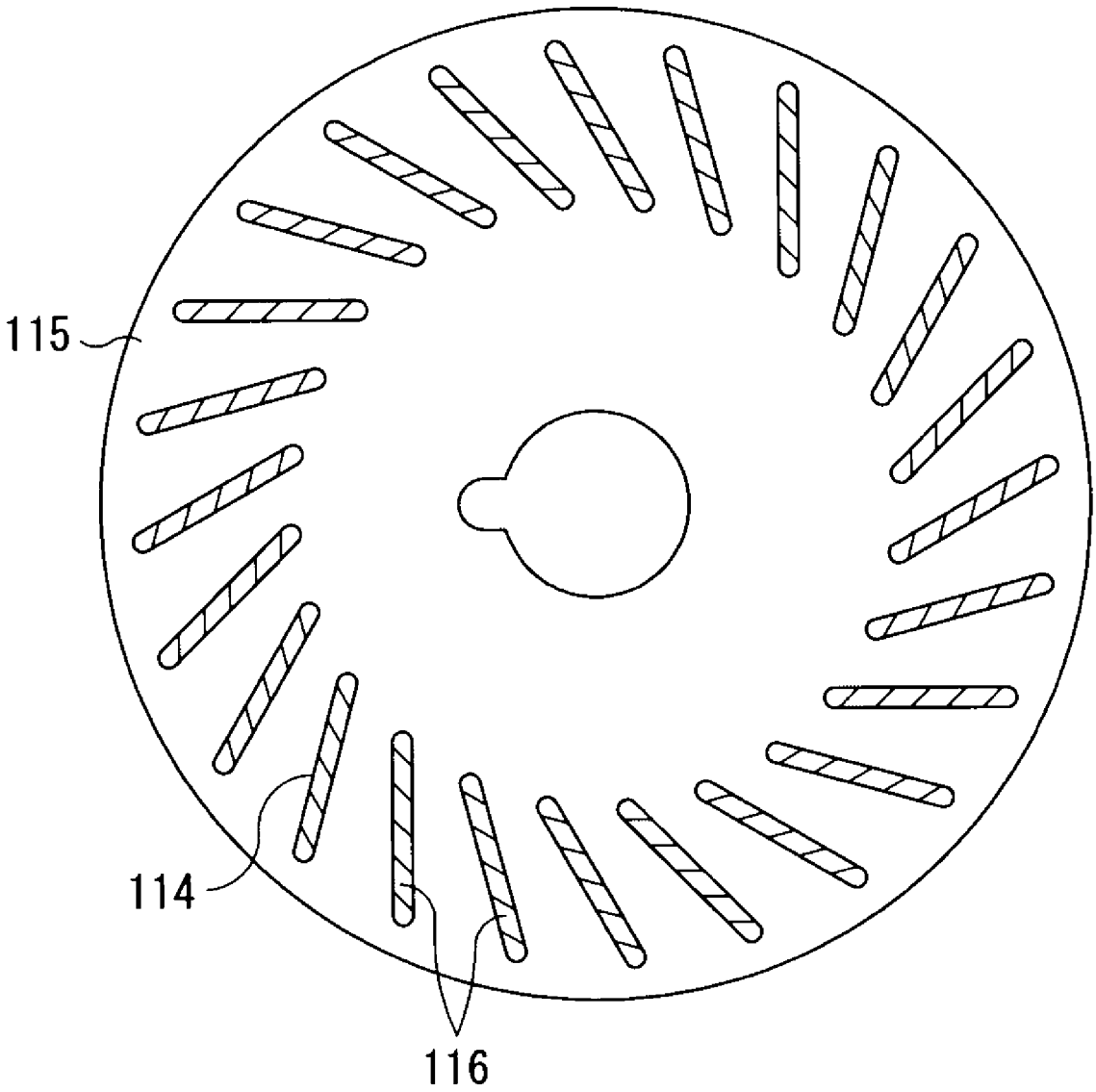
FIG. 4 is a horizontal cross-sectional view schematically illustrating a separator of the wet agitating ball mill shown in FIG. 3.

In the ball mill shown in FIG. 3, the shaft 105 is a shouldered shaft. A separator 106 is put on and fitted to the shaft from the lower end of the shaft, then spacers 107 and disk or pin rotors 108 are alternately put on and fitted to the shaft. Then a stopper 109 is fixed to the lower end of the shaft with a screw 110. Thus, the separator 106, the spacers 107, and the rotors 108 are interposed between the shoulder 105*a* of the shaft 105 and the stopper 109, and fixed in conjunction with each other. The separator 106 includes a pair of disks 115 each provided with blade fitting grooves 114, as shown in FIG. 4, on the inner surfaces facing each other, blades 116 interposing between both the disks and fitted to the blade fitting grooves 114, and an annular spacer 113 for securing a predetermined distance between these disks 115 and having a hole 112 communicating with a discharging path 111 to define an impeller.

An example of the wet agitating ball mill having a structure shown in this embodiment is an Ultra Apex Mill manufactured by Kotobuki Industries Co., Ltd.

Using the wet agitating ball mill of this embodiment having such a structure, slurry is dispersed through the following procedures: A dispersion medium (not shown) is packed in the stator 17 of the wet agitating ball mill of this embodiment, the rotors 21 and the separator 14 are rotated by driving force from an external power source, while a predetermined amount of slurry is supplied to the supplying port 26. As a result, the slurry is supplied to the interior of the stator 7 through the slit (not shown) formed between the edge of the valve seat and the valve element 35.

The slurry and the dispersion medium in the stator 7 are stirred and mixed by the rotation of the rotors 21 to pulverize the slurry. Furthermore, the dispersion medium and the slurry transferred by the rotation of the separator 14 into the separator 14 are separated from each other by the difference in specific gravity. The dispersion medium, which has a larger specific gravity, is centrifuged in the radial direction, and the slurry, which has a smaller specific gravity, is discharged through the discharging path 19 in the center of the shaft 15 toward a raw material tank. When the pulverization proceeds to some extent, the particle size may be optionally measured. If a desired particle size is obtained, the raw material pump is stopped once, and then mill driving is stopped to terminate the pulverization.

When metal oxide particles are dispersed in a wet agitating ball mill, the filling rate of the dispersion medium packed in the wet agitating ball mill is not limited, as long as the metal oxide particles can be dispersed into a predetermined particle size distribution. When metal oxide particles are dispersed in such a vertical wet agitating ball mill described above, the filling rate of the dispersion medium packed in the wet agitating ball mill is usually 50% or more, preferably 70% or more, and more preferably 80% or more and usually 100% or less, preferably 95% or less, and more preferably 90% or less.

The wet agitating ball mill used for dispersing metal oxide particles may have a separator of a screen or slit mechanism, but, as described above, an impeller-type is desirable and a vertical impeller type is preferable. The wet agitating ball mill is desirably of a vertical type having a separator at the upper portion of the mill. In particular, when the filling rate of the dispersion medium is adjusted to the above-mentioned range, pulverization is most efficiently performed, and the separator can be placed at a position higher than the level of the packed medium. This can prevent leakage of a dispersion medium which is carried on the separator.

The operation conditions of the wet agitating ball mill applied to the dispersion of metal oxide particles affect the volume average particle diameter and the 90% cumulative particle diameter of the metal oxide particles in a coating liquid for forming an undercoat layer, the stability of the coating liquid for forming the undercoat layer, the surface shape of the undercoat layer formed by applying the coating liquid for forming the undercoat layer, and characteristics of an electrophotographic photoreceptor having the undercoat layer formed by applying the coating liquid for forming the undercoat layer. In particular, the slurry supplying rate and the rotation velocity of the rotor have significant influences.

The slurry-supplying rate affects the residence time of the slurry in the wet agitating ball mill. Accordingly, though the rate varies depending on the capacity and shape of the mill, in the case of a stator usually used, the rate is generally 20 kg/hr or more and preferably 30 kg/hr or more and usually 80 kg/hr or less and preferably 70 kg/hr or less per liter of the wet agitating ball mill.

The rotation velocity of the rotor is affected by parameters such as the shape of the rotor or the distance from the stator. In the case of a stator and a rotor usually used, the circumferential velocity at the top end of the rotor is usually 5 m/sec or more, preferably 8 m/sec or more, and more preferably 10 m/sec or more and usually 20 m/sec or less, preferably 15 m/sec or less, and more preferably 12 m/sec or less.

Furthermore, the amount of the dispersion medium is not limited. However, the volume ratio of the dispersion medium to slurry is usually 1 to 5. In the dispersion, a dispersion aid that can be readily removed after the dispersion may be used together with the dispersion medium. Examples of the dispersion aid include sodium chloride and sodium sulfate.

The dispersion of metal oxide particles is preferably carried out by a wet process in the presence of a dispersion solvent. In addition to the dispersion solvent, any additional component may be present as long as the metal oxide particles can be properly dispersed. Examples of such an additional component include a binder resin and various kinds of additives.

Any dispersion solvent can be used without limitation, but the solvent that is used in the coating liquid for forming an undercoat layer is preferably used because of no requirement of steps, such as exchange of solvent, after the dispersion. These dispersion solvents may be used alone or as a solvent mixture of two or more kinds in any combination and any ratio.

The amount of the dispersion solvent used is in the range of usually 0.1 part by weight or more and preferably 1 part by weight or more and usually 500 parts by weight or less and preferably 100 parts by weight or less, on the basis of 1 part by weight of metal oxide particles to be dispersed, from the viewpoint of productivity.

The mechanical dispersion can be carried out at any temperature from the freezing point to the boiling point of a solvent (or solvent mixture), but is carried out at a temperature of usually 10° C. or higher and usually 200° C. or lower from the viewpoint of safe manufacturing operation.

After the dispersion treatment using a dispersion medium, it is preferable that the dispersion medium be separated from the slurry and subjected to further sonication. The sonication is a treatment of the metal oxide particles with ultrasonic vibration.

Conditions, such as a vibration frequency, for the sonication are not particularly limited, but ultrasonic vibration with a frequency of usually 10 kHz or more and preferably 15 kHz or more and usually 40 kHz or less and preferably 35 kHz or less from an oscillator is used.

Furthermore, the output of an ultrasonic oscillator is not particularly limited, but is usually 100 W to 5 kW.

In general, dispersion treatment of a small amount of slurry with ultrasound from a low output ultrasonic oscillator is more efficient compared to that of a large amount of slurry with ultrasound from a high output ultrasonic oscillator. Therefore, the amount of slurry to be treated at once is usually 1 L or more, preferably 5 L or more, and more preferably 10 L or more and usually 50 L or less, preferably 30 L or less, and more preferably 20 L or less. The output of an ultrasonic oscillator in such a case is preferably 200 W or more, more preferably 300 W or more, and most preferably 500 W or more and preferably 3 kW or less, more preferably 2 kW or less, and most preferably 1.5 kW or less.

The method of applying ultrasonic vibration to metal oxide particles is not particularly limited. For example, the treatment is carried out by directly immersing an ultrasonic oscillator in a container containing slurry, bringing an ultrasonic oscillator into contact with the outer wall of a container containing slurry, or immersing a container containing slurry in a liquid to which vibration is applied with an ultrasonic oscillator. Among these methods, preferably used is the method of immersing a container containing slurry in a liquid to which vibration is applied with an ultrasonic oscillator.

In such a case, the liquid to which vibration is applied with an ultrasonic oscillator is not limited, and examples thereof include water; alcohols such as methanol; aromatic hydrocarbons such as toluene; and oils such as a silicone oil. In particular, water is preferred, in consideration of safe manufacturing operation, cost, washing properties, and other factors.

In the method of immersing the container containing slurry in a liquid to which vibration is applied with an ultrasonic oscillator, since the efficiency of the sonication varies depending on the temperature of the liquid, it is preferable to maintain the temperature of the liquid constant. The applied vibration may raise the temperature of the liquid that is subjected to the ultrasonic vibration. The temperature of the liquid subjected to the sonication is in the range of usually 5° C. or higher, preferably 10° C. or higher, and more preferably 15° C. or higher and usually 60° C. or lower, preferably 50° C. or lower, and more preferably 40° C. or lower.

The container for containing the slurry treated with ultrasound is not limited. For example, any container that is usually used for containing a coating liquid for forming an undercoat layer, which is used for forming a photosensitive layer of an electrophotographic photoreceptor, can be also used. Examples of the container include containers made of resins such as polyethylene or polypropylene, glass containers, and metal cans. Among them, metal cans are preferred. In particular, an 18-liter metal can prescribed in JIS Z 1602 is preferred because of its high resistances to organic solvents and impacts.

The slurry after dispersion or after sonication is filtered before use, according to need, in order to remove coarse particles. The filtration medium in such a case may be any filtering material that is usually used for filtration, such as cellulose fiber, resin fiber, or glass fiber. A preferred form of the filtration medium is a so-called wound filter, which is made of a fiber wound around a core material, because it has a large filtration area to achieve high efficiency. Any known core material can be used, and examples thereof include stainless steel core materials and core materials made of resins, such as polypropylene, that are not dissolved in the slurry and the solvent contained in the slurry.

To the resulting slurry, a solvent, a binder resin (binder), and other optional components (e.g., auxiliary agents) are further added to give a coating liquid for forming an undercoat layer. The metal oxide particles may be mixed with the solvent of the coating liquid for forming an undercoat layer, the binder resin, and the other optional components, in any step of before, during, or after the dispersion or sonication process. Therefore, mixing of the metal oxide particles with the solvent, the binder resin, or the other components may not necessarily be carried out after the dispersion or sonication.

As described above, according to the method of preparing the coating liquid for forming an undercoat layer of the present invention, the coating liquid for forming an undercoat layer according to the present invention can be efficiently produced and also can have higher storage stability. Therefore, an electrophotographic photoreceptor with higher quality can be efficiently obtained.

[III-3. Formation of Undercoat Layer]

The undercoat layer according to the present invention can be formed by applying the coating liquid for forming an undercoat layer according to the present invention onto an electroconductive substrate and drying it. The method of applying the coating liquid for forming an undercoat layer according to the present invention is not limited, and examples thereof include dip coating, spray coating, nozzle coating, spiral coating, ring coating, bar-coat coating, roll-coat coating, and blade coating. These coating methods may be carried out alone or in any combination of two or more kinds.

Examples of the spray coating include air spray, airless spray, electrostatic air spray, electrostatic airless spray, rotary atomizing electrostatic spray, hot spray, and hot airless spray. In consideration of the fineness of grains and adhesion efficiency for obtaining a uniform thickness, a preferred method is rotary atomizing electrostatic spray disclosed in Japanese Domestic Re-publication (Saikohyo) No. 1-805198, that is, continuous conveyance without spacing in the axial direction with rotation of a cylindrical work. This can give an electrophotographic photoreceptor that exhibits high uniformity of thickness of the undercoat layer with overall high adhesion efficiency.

Examples of the spiral coating method include a method using an injection applicator or a curtain applicator, which is disclosed in Japanese Unexamined Patent Application Publication No. 52-119651; a method of continuously spraying paint in the form of a line from a small opening, which is disclosed in Japanese Unexamined Patent Application Publication No. 1-231966; and a method using a multi-nozzle body, which is disclosed in Japanese Unexamined Patent Application Publication No. 3-193161.

In the case of the dip coating, in general, the total solid content in a coating liquid for forming an undercoat layer is in a range of usually 1 wt % or more and preferably 10 wt % or more and usually 50 mass % or less and preferably 35 wt % or less; and the viscosity is in a range of preferably 0.1 cps or more and preferably 100 cps or less, where 1 Cps=$1\times10^{-3}$ Pa·s.

After the application, the coating is dried. It is preferable that the drying temperature and time be adjusted so as to achieve necessary and sufficient drying. The drying temperature is in a range of usually 100° C. or higher, preferably 110° C. or higher, and more preferably 115° C. or higher and usually 250° C. or lower, preferably 170° C. or lower, and more preferably 140° C. or lower. The drying method is not limited. For example, a hot air dryer, a steam dryer, an infrared dryer, or far-infrared dryer can be used.

[IV. Photosensitive Layer]

The photosensitive layer can have any composition that can be applied to a known electrophotographic photoreceptor, and examples thereof include a so-called single-layer photoreceptor having a single photosensitive layer (single photosensitive layer) containing a binder resin dissolving or dispersing a photoconductive material therein; and a so-called multilayered photoreceptor composed of a plurality of laminated layers (laminated photosensitive layer) including a charge-generating layer containing a charge-generating material and a charge-transporting layer containing a charge-transporting material. It is known that the photoconductive material generally exhibits equivalent functions in both the monolayer and layered photoreceptors.

The photosensitive layer of the electrophotographic photoreceptor of the present invention may be present in any known form, but is preferably a layered photoreceptor, by taking mechanical physical properties, electric characteristics, manufacturing stability, and other characteristics of the photoreceptor into comprehensive consideration. In particular, a normally layered photoreceptor in which an undercoat layer, a charge-generating layer, and a charge-transporting layer are deposited on an electroconductive substrate in this order is more preferable.

The photosensitive layer according to the present invention contains crystalline phthalocyanine showing at least one distinct main diffraction peak at a Bragg angle (2θ±0.2°) of 27.0° to 29.0° in an X-ray diffraction spectrum. Here, the term "main" means that the strength of the peak is larger than an average strength of all peaks.

[IV-1. Crystalline Phthalocyanine]

The photosensitive layer according to the present invention contains crystalline phthalocyanine showing at least one distinct main diffraction peak at a Bragg angle (2θ±0.2°) of 27.0° to 29.0° in an X-ray diffraction spectrum to CuKα characteristic X-rays (hereinafter, optionally, referred to as "crystalline phthalocyanine according to the present invention"). The crystalline phthalocyanine according to the present invention functions as a charge-generating material in the photosensitive layer.

A preferable example of the crystalline phthalocyanine according to the present invention is oxytitanium phthalocyanine and hydroxygallium phthalocyanine having a distinct peak near a Bragg angle (2θ±0.2°) of 27° to 29° in a powder X-ray diffraction spectrum to CuKα characteristic X-rays from the viewpoint of high sensitivity. Particularly preferred are type V hydroxygallium phthalocyanine and type D crystalline oxytitanium phthalocyanine.

Oxytitanium phthalocyanine and hydroxygallium phthalocyanine, which are preferred examples of the crystalline phthalocyanine according to the present invention, will now be described.

[IV-1-1. Oxytitanium Phthalocyanine]

The oxytitanium phthalocyanine according to the present invention shows a distinct main diffraction peak at a Bragg angle (2θ±0.2°) of 27.3° in a powder X-ray diffraction spectrum to CuKα characteristic X-rays. That is, the photoreceptor of the present invention preferably contains oxytitanium phthalocyanine showing a distinct main diffraction peak at a Bragg angle (2θ±0.2°) of 27.3° in an X-ray diffraction spectrum in the photosensitive layer. With this, the photoreceptor can have a high sensitivity. The powder X-ray diffraction spectrum to CuKα characteristic X-rays can be measured by usual X-ray diffractometry for solid powder.

Preferably, oxytitanium phthalocyanine of the present invention further shows another distinct diffraction peak at a Bragg angle (2θ±0.2°) of 9.0° to 9.8° in the powder X-ray diffraction spectrum to CuKα characteristic X-rays. Specifically, oxytitanium phthalocyanine having peaks at Bragg angles (2θ±0.2°) of 9.0°, 9.6°, or 9.5° and 9.7° is preferred.

That is, the oxytitanium phthalocyanine according to the present invention preferably shows a distinct main diffraction peak at a Bragg angle (2θ±0.2°) of 9.0° in the powder X-ray diffraction spectrum to CuKα characteristic X-rays. With this, the coating liquid for forming a photosensitive layer can be advantageously stabilized.

In addition, the oxytitanium phthalocyanine according to the present invention preferably shows a distinct diffraction peak at a Bragg angle (2θ±0.2°) of 9.6° in the powder X-ray diffraction spectrum to CuKα characteristic X-rays. With this, the electric characteristics of the photoreceptor can be advantageously stabilized under various operation environments.

Furthermore, the oxytitanium phthalocyanine according to the present invention preferably shows distinct diffraction peaks at Bragg angles (2θ±0.2°) of 9.5° and 9.7° in the powder X-ray diffraction spectrum to CuKα characteristic X-rays. With this, the electric characteristics of the photoreceptor can be advantageously stabilized under various operation environments.

However, the oxytitanium phthalocyanine according to the present invention preferably does not show a distinct diffraction peak at a Bragg angle (2θ±0.2°) of 26.3°. With this, the oxytitanium phthalocyanine in a coating liquid for forming a photosensitive layer can have excellent crystallinity, and the electric characteristics of the photoreceptor can be advantageously stabilized.

The oxytitanium phthalocyanine according to the present invention may contain chlorine in the crystal. In such a case, the chlorine content is not limited as long as the effects of the present invention are not significantly impaired, but, preferably, the chlorine content in the oxytitanium phthalocyanine according to the present invention is 1.5 wt % or less. With this, photoreceptor characteristics of high reproducibility can be achieved in mass production of electrophotographic photoreceptors.

The chlorine content in the oxytitanium phthalocyanine according to the present invention can be determined by elemental analysis. The particularly preferred content depends on a producing process, but is within the following range.

[1. The Case that a Solvent for Converting Crystal to Type D is not a Halogenated Organic Compound]

In the production of oxytitanium phthalocyanine according to the present invention, when a solvent for converting the crystal to type D (that is, the solvent used in a process of converting the crystal type of the oxytitanium phthalocyanine to type D) is not a halogenated organic compound, the chlorine content in the oxytitanium phthalocyanine according to the present invention is preferably in the following range.

For example, when an acid-paste method is employed for forming of an amorphous form prior to the conversion of the crystal type of the oxytitanium phthalocyanine to type D, the chlorine content in the oxytitanium phthalocyanine according to the present invention is preferably 0.4 wt % or less and more preferably 0.2 wt % or less.

For example, when a dry milling method is employed for forming of an amorphous form, the chlorine content in the oxytitanium phthalocyanine according to the present invention is preferably 0.8 wt % or less. The lower limit is usually 0.2 wt % or more and preferably 0.3 wt % or more.

[2. The Case that a Solvent for Converting Crystal to Type D is a Halogenated Organic Compound]

In the production of oxytitanium phthalocyanine according to the present invention, when a solvent for converting the crystal to type D is a halogenated organic compound, the chlorine content in the oxytitanium phthalocyanine according to the present invention is preferably in the following range.

For example, when the acid-paste method is employed for forming of an amorphous form, the chlorine content in the oxytitanium phthalocyanine according to the present invention is preferably 0.9 wt % or less and more preferably 0.7 wt % or less. The lower limit is usually 0.2 wt % or more and preferably 0.3 wt % or more.

For example, when the dry milling method is employed for forming of an amorphous form, the chlorine content in the oxytitanium phthalocyanine according to the present invention is preferably 1.4 wt % or less and more preferably 1.3 wt % or less. The lower limit is usually 0.4 wt % or more and preferably 0.6 wt % or more.

Furthermore, in the oxytitanium phthalocyanine crystal according to the present invention, the ratio of chlorinated oxytitanium phthalocyanine represented by the following formula (1) to unsubstituted oxytitanium phthalocyanine represented by the following formula (2) is usually 0.070 or less, preferably 0.060 or less, and more preferably 0.055 or less, on the basis of the intensity of mass spectra. Furthermore, in the manufacturing process, the ratio is preferably 0.02 or more for the dry milling method for forming an amorphous form or is preferably 0.03 or less for the acid-paste method for forming an amorphous form. The amount of substituted chlorine can be measured according to the procedure described in Japanese Unexamined Patent Application Publication No. 2001-115054.

[Chemical Formula 6]

(1)

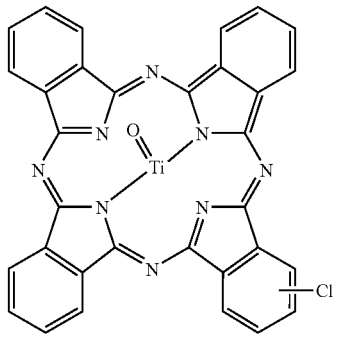

m/z: 610

(2)

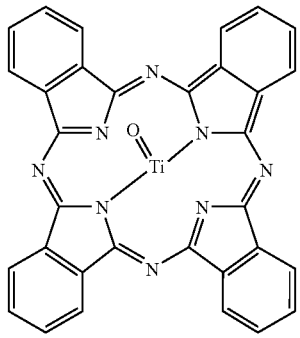

m/z: 576

The particle diameter of the oxytitanium phthalocyanine according to the present invention significantly varies depending on its production process, crystal formation, and other conditions, and is preferably 500 nm or less in consideration of dispersibility and is preferably 300 nm or less in consideration of coating characteristics for forming a film.

The oxytitanium phthalocyanine according to the present invention may be substituted with a substituent, such as a fluorine atom, a nitro group, or a cyano group, other than chlorine atom. Furthermore, the oxytitanium phthalocyanines may contain various types of oxytitanium phthalocyanine derivatives having substituents such as a sulfone group.

[IV-1-2. Production of Oxytitanium Phthalocyanine]

The oxytitanium phthalocyanine according to the present invention may be produced by any process without limitation. For example, dichlorotitanium phthalocyanine is synthesized with phthalonitrile and titanium halide as raw materials; the dichlorotitanium phthalocyanine is hydrolyzed into an oxytitanium phthalocyanine composition intermediate, followed by purification; the resulting oxytitanium phthalocyanine composition intermediate is converted into an amorphous oxytitanium phthalocyanine composition, which is then crystallized (crystal conversion) in a solvent.

This production process will now be described.

The titanium halide may be any halide that can give oxytitanium phthalocyanine according to the present invention, and titanium chloride is preferred. Examples of titanium chloride include titanium tetrachloride and titanium trichloride, and particularly preferred is titanium tetrachloride. Use of titanium tetrachloride can lead to ready control of the content of chlorinated oxytitanium phthalocyanine in the resulting oxytitanium phthalocyanine composition.

In addition, the titanium halides may be used alone or in any combination of two or more kinds in any ratio.

The synthesis of dichlorotitanium phthalocyanine from phthalonitrile and titanium halide as raw materials may be carried out at any reaction temperature within the range that the reaction proceeds, and is carried out usually at 150° C. or higher and preferably at 180° C. or higher. In the case that the titanium halide is titanium chloride, the reaction temperature is more preferably 190° C. or higher and usually 300° C. or lower, preferably 250° C. or lower, and more preferably 230° C. or lower, in order to control the content of chlorinated oxytitanium phthalocyanine.

In general, titanium chloride is mixed with a mixture of phthalonitrile and a reaction solvent. In such a case, titanium chloride may be directly mixed with the mixture at a temperature not higher than the boiling point thereof or may be mixed with the mixture after being mixed with a solvent having a high boiling point of 150° C. or higher. In the case that titanium chloride is mixed with the mixture at a temperature of the boiling point or higher, usually, the titanium chloride is mixed with the mixture of phthalonitrile and a reaction solvent after being mixed the solvent having a high boiling point. Specifically, a part of titanium chloride is mixed with the mixture of phthalonitrile and a reaction solvent with a temperature of preferably 160° C. or lower, more preferably 120° C. or lower, and most preferably 100° C. or lower.

For example, in the case that phthalonitrile and titanium tetrachloride are used for producing oxytitanium phthalocyanine in diarylalkane as a reaction solvent, titanium tetrachloride is partly mixed with phthalonitrile at a low temperature of 100° C. or lower and at a high temperature of 180° C. or higher. With this, oxytitanium phthalocyanine can be appropriately produced.

The time for increasing temperature to a reaction temperature is usually 0.5 hour or longer and usually 4 hours or shorter and preferably 3 hours or shorter. The reaction is continued for usually 1 hour or longer and preferably 2 hours or longer and usually 10 hours or shorter, preferably 8 hours or shorter, and more preferably 6 hours or shorter. These preferable ranges ensure significantly excellent image characteristics.

The resulting dichlorotitanium phthalocyanine is hydrolyzed, and the oxytitanium phthalocyanine composition intermediate obtained after purification is converted into an amorphous form. The amorphous form may be obtained by any method, for example, by pulverization with a known mechanical pulverizer such as a paint shaker, a ball mill, or a sand grind mill; or by a so-called acid-paste method involving dissolution of the intermediate in concentrated sulfuric acid and then solidification of it in cold water. The mechanical pulverization is preferred from the viewpoint of dark decay, while the acid-paste method is preferred from the viewpoint of sensitivity and environmental dependence.

A composition containing oxytitanium phthalocyanine according to the present invention (oxytitanium phthalocyanine composition) is obtained by crystallizing the resulting amorphous oxytitanium phthalocyanine composition using a known solvent (solvent for converting the crystal to type D). Examples of the solvent preferably used in this step include halogenated aromatic hydrocarbon solvents such as orthodichlorobenzene, chlorobenzene, and chloronaphthalene; halogenated hydrocarbon solvents such as chloroform and dichloroethane; aromatic hydrocarbon solvents such as methylnaphthalene, toluene, and xylene; ester-based solvents such as ethyl acetate and butyl acetate; ketone solvents such as methyl ethyl ketone and acetone; alcohols such as methanol, ethanol, butanol, and propanol; ether-based solvents such as ethyl ether, propyl ether, and butyl ether; monoterpene-type hydrocarbon solvents such as terpinolene and pinene; and fluid paraffin. Among them, for example, ortho-dichlorobenzene, toluene, methylnaphthalene, ethyl acetate, butyl ether, and pinene are preferred.

The solvents for crystallization may be used alone or in any combination of two or more kinds in any ratio.

[IV-1-3 Hydroxygallium Phthalocyanine]

Hydroxygallium phthalocyanine according to the present invention preferably shows a distinct main diffraction peak at a Bragg angle (2θ±0.2°) of 28.1° in the X-ray diffraction spectrum to CuKα characteristic X-rays.

The particle diameter of hydroxygallium phthalocyanine does not have any limitation, but is usually 1.0 μm or less and preferably 0.5 μm or less.

The chlorine content in hydroxygallium phthalocyanine does not have any limitation, but is usually 0.1 wt % or less. Hydroxygallium phthalocyanine preferably does not contain chlorine.

[IV-1-4. Production of Hydroxygallium Phthalocyanine]

The hydroxygallium phthalocyanine according to the present invention may be produced by any process without limitation. For example, hydroxygallium phthalocyanine can be produced by a method including a step obtaining hydrated hydroxygallium phthalocyanine by treating halogenated gallium phthalocyanine; a step lyophilizing the hydrated hydroxygallium phthalocyanine into low-crystalline hydroxygallium phthalocyanine; and a step milling the low-crystalline hydroxygallium phthalocyanine. In a process of preparing hydrated hydroxygallium phthalocyanine by treating halogenated gallium phthalocyanine, acid paste is preferably used.

This production process will now be described.

First, hydrated hydroxygallium phthalocyanine in a paste form is prepared by treating halogenated gallium phthalocyanine by acid pasting. Examples of the halogenated gallium phthalocyanine used here include chlorogallium phthalocyanine, bromogallium phthalocyanine, and iodogallium phthalocyanine. The halogenated gallium phthalocyanines may be used alone or in any combination of two or more kinds in any ratio.

Then, this hydrated hydroxygallium phthalocyanine is lyophilized into low-crystalline hydroxygallium phthalocyanine.

The resulting low-crystalline hydroxygallium phthalocyanine is subjected to milling treatment using a dispersion agent to give crystalline hydroxygallium phthalocyanine of the present invention. The dispersion agent is an amide solvent such as acetamide, N,N-dimethylformamide, N,N-dimethylacetamide, N-methylformamide, N-methylacetamide, N-methylpropioamide, or formamide.

The halogenated gallium phthalocyanine may be produced by any method, for example, by the method described in Japanese Unexamined Patent Application Publication No. 6-93203.

The milling treatment here is conducted with a milling device, such as a sand mill or a ball mill, using a dispersion medium such as glass beads, steel beads, or an alumina ball. The milling treatment time varies depending on the milling device, but is preferably about 4 to 24 hours. The hydroxygallium phthalocyanine of the present invention cannot be obtained if the treatment time is too long. In particular, the Bragg angle of a sample is confirmed every 1 to 3 hours. The amount of the dispersion agent used in the milling treatment is preferably 10 to 50 times that of low-crystalline hydroxygallium phthalocyanine on the basis of weight.

One characteristic of the above-described process of producing hydroxygallium phthalocyanine is the lyophilization of hydrated hydroxygallium phthalocyanine. If the lyophilization step is not conducted, in general, a maximum peak (main diffraction peak) cannot be obtained at a Bragg angle (2θ±0.2°) of 28.1°. It is conjectured that, in the above-mentioned production method, water contained in hydrated hydroxygallium phthalocyanine is sublimated by lyophilization and, as a result, hydroxygallium phthalocyanine with a target crystal form can be obtained. Therefore, the lyophilization is conducted under conditions for sublimation of water. For example, when hydrated hydroxygallium phthalocyanine is frozen under a reduced pressure of 4 Torr or less, sublimation readily occurs even at room temperature.

A device that can be used for the above-described production process is, for example, a freeze dryer, model KFD-1, manufactured by Kaneda Scientific Co., Ltd., which can be used for lyophilization by being connected to a vacuum pump. In this freeze dryer, the temperature of a water-trapping portion can be adjusted within the range of −20 to −110° C. The vacuum pump used is, for example, that having a displacement of 100 L/min and achieving a vacuum of $10^{-4}$ Torr.

[IV-2. Charge-Generating Layer]

The charge-generating layer contains a charge-generating material. The charge-generating material used in the electrophotographic photoreceptor of the present invention is the crystalline phthalocyanine according to the present invention.

In addition, charge-generating materials other than the crystalline phthalocyanine according to the present invention (hereinafter, optionally, referred to as "optional charge-generating material") can be used together with the crystalline phthalocyanine according to the present invention within ranges that do not significantly impair the effects of the present invention.

Examples of the optional charge-generating materials are various types of photoconductive materials including inorganic photoconductive materials such as selenium and alloys thereof and cadmium sulfide; and organic pigments such as phthalocyanine pigments, azo pigments, dithioketopyrrolopyrrole pigments, squalene (squalilium) pigments, quinacridone pigments, indigo pigments, perylene pigments, polycyclic quinone pigments, anthanthrone pigments, and benzimidazole pigments. Among them, preferred are organic pigments, and particularly preferred are phthalocyanine pigments and azo pigments.

Among them, examples of the phthalocyanine pigments that can be used together include various crystal forms of metal-free phthalocyanine and phthalocyanines with which metals such as copper, indium, gallium, tin, titanium, zinc, vanadium, silicon, and germanium, or oxides thereof, halides thereof, hydroxides thereof, or alkoxides thereof are coordinated. In particular, preferred are crystal forms with high-sensitivity, e.g., metal-free phthalocyanines of X-type and τ-type, titanyl phthalocyanine (alias: oxytitanium phthalocyanine) such as A-type (alias: β-type), B-type (alias: α-type), and D-type (alias: Y-type), vanadyl phthalocyanine, chloroindium phthalocyanine, chlorogallium phthalocyanine such as II-type, hydroxygallium phthalocyanine such as V-type, μ-oxo-gallium phthalocyanine dimer such as G-type and I-type, and μ-oxo-aluminum phthalocyanine dimer such as II-type. Among these phthalocyanine pigments, particularly preferred are A-type (β-type), B-type (α-type) titanyl phthalocyanine, II-type chlorogallium phthalocyanine, II-type chlorogallium phthalocyanine, V-type hydroxygallium phthalocyanine, and G-type μ-oxo-gallium phthalocyanine dimer.

The phthalocyanine pigment may be of a mixed crystal state. Here, the phthalocyanine pigment or the mixed crystal state thereof may be obtained by mixing respective constituents afterwards or by causing the mixed state in any production or treatment process of the phthalocyanine pigment, such as synthesis, pigment formation, or crystallization. Examples of such treatment are acid-paste treatment, milling treatment, and solvent treatment. To cause a mixed crystal state, for example, as described in Japanese Unexamined Patent Application Publication No. 10-48859, two different crystals are mixed and are then mechanically milled into an amorphous state, and then the mixture is converted into a specific crystal state by solvent treatment.

Examples of the azo pigments preferably include a variety of known bisazo pigments and trisazo pigments.

Preferable examples of the azo pigments are shown below. In the following structural formulae, $Cp^1$, $Cp^2$, and $Cp^3$ each independently represent a coupler.

[Chemical Formula 7]

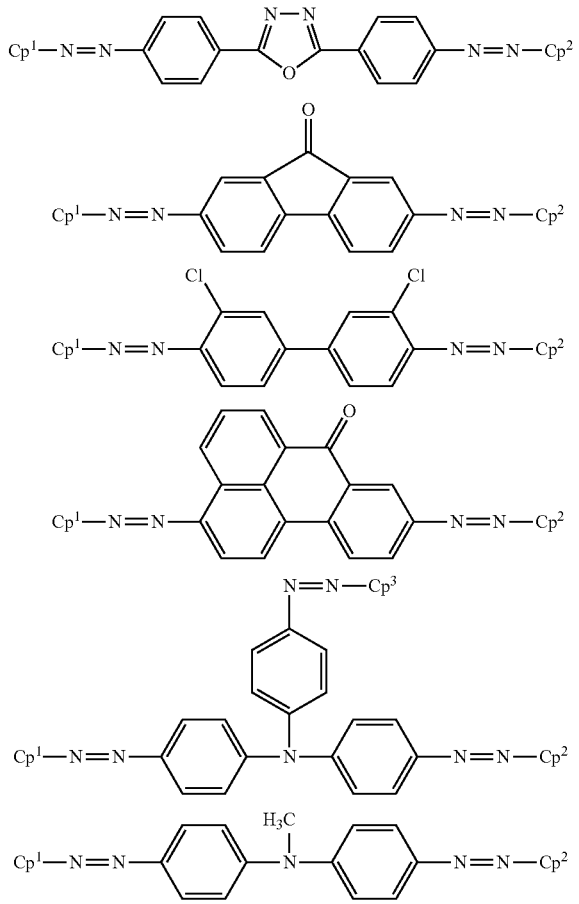

The couplers, $Cp^1$, $Cp^2$, and $Cp^3$, preferably have the following structures:

[Chemical Formula 8]

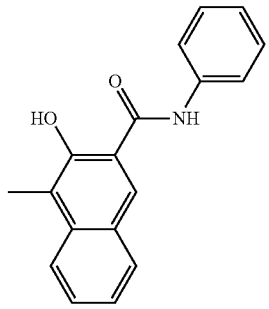

-continued

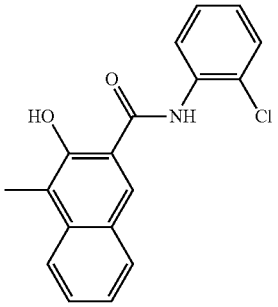

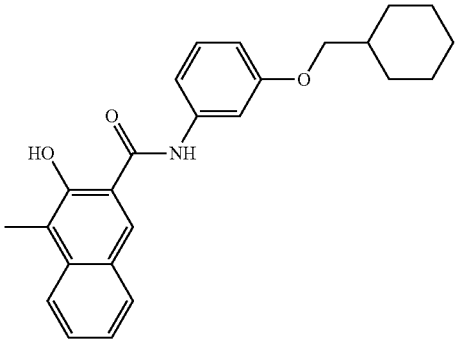

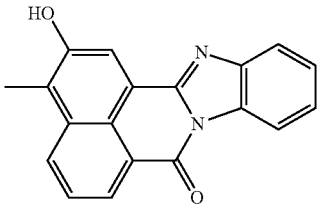

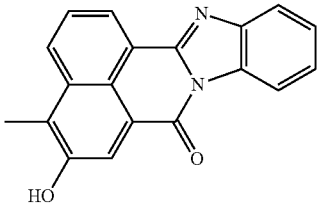

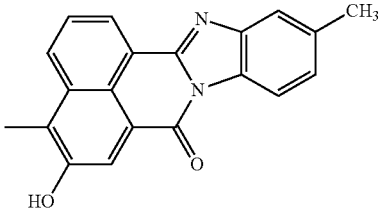

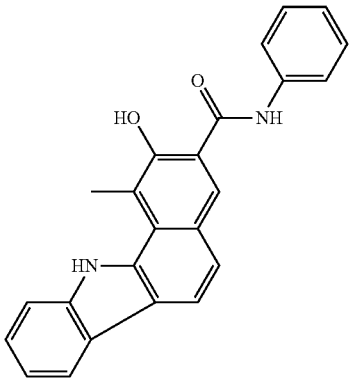

-continued

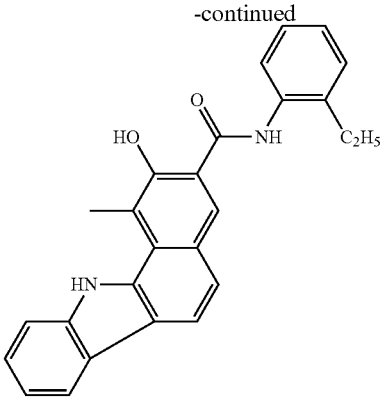

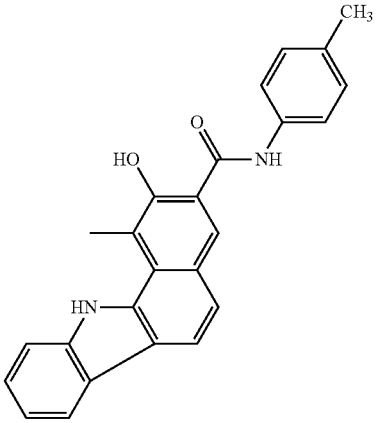

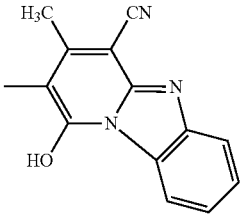

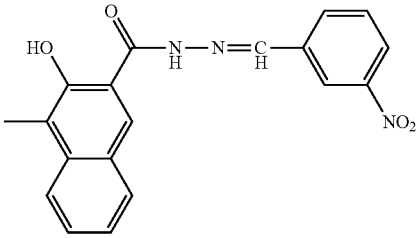

The charge-generating materials may be used alone or in any combination of two or more in any ratio. Accordingly, the crystalline phthalocyanines according to the present invention and the optional charge-generating materials, respectively, may be used alone or in any combination of two or more in any ratio.

In the case that the optional charge-generating material is used, the amount of the optional charge-generating material relative to that of the crystalline phthalocyanine according to the present invention is properly selected within a range that does not significantly impair the effects of the present invention, and is usually 60 wt % or more, preferably 80 wt % or more, and more preferably 90 wt % or more. A smaller amount of the crystalline phthalocyanine according to the present invention may deteriorate the electric characteristics of the resulting photoreceptor and, particularly, may decrease the sensitivity.

The charge-generating material forms a charge-generating layer in a state of being bound with a binder resin. Any binder resin can be used in the charge-generating layer as long as it does not significantly impair the effects of the present invention.

Examples of the binder resin that can be used in the charge-generating layer include insulating resins such as a polyvinyl butyral resin, a polyvinyl formal resin, polyvinyl acetal-based resins, e.g., partially acetal-modified polyvinyl butyral resins in which the butyral groups are partially modified with, for example, formal or acetal, a polyarylate resin, a polycarbonate resin, a polyester resin, an ether-modified polyester resin, a phenoxy resin, a polyvinyl chloride resin, a polyvinylidene chloride resin, a polyvinyl acetate resin, a polystyrene resin, an acrylic resin, a methacrylic resin, a polyacrylamide resin, a polyamide resin, a polyvinyl pyridine resin, a cellulose-based resin, a polyurethane resin, an epoxy resin, a silicone resin, a polyvinyl alcohol resin, a polyvinyl pyrrolidone resin, casein, vinyl chloride-vinyl acetate-based copolymers, e.g., a vinyl chloride-vinyl acetate copolymer, a hydroxyl-modified vinyl chloride-vinyl acetate copolymer, a carboxyl-modified vinyl chloride-vinyl acetate copolymer, and a vinyl chloride-vinyl acetate-maleic anhydride copolymer, a styrene-butadiene copolymer, a polyvinylidene chloride-acrylonitrile copolymer, a styrene-alkyd resin, a silicone-alkyd resin, and a phenol-formaldehyde resin; and organic photoconductive polymers such as poly-N-vinylcarbazole, polyvinylanthracene, and polyvinylperylene.

The binder resin in the charge-generating layer may be used alone or in any combination of two or more kinds in any ratio.

The amount of the charge-generating material used is optional within a range that does not significantly impair the effects of the present invention, and is usually 10 parts by weight or more and preferably 30 parts by weight or more and usually 1000 parts by weight or less and preferably 500 parts by weight or less, on the basis of 100 parts by weight of the binder resin in the charge-generating layer. A smaller amount of the charge-generating material may not realize sufficient sensitivity, and a larger amount may cause agglomeration of the charge-generating material to decrease the stability of the coating liquid that is used for forming a charge-generating layer.

The thickness of the charge-generating layer is not limited, but is usually 0.1 μm or more and preferably 0.15 μm or more and usually 4 μm or less and preferably 0.6 μm or less.

The charge-generating material is dispersed in a coating liquid for forming a photosensitive layer after it is formed, and the method for the dispersion is not limited. For example, ultrasonic dispersion, ball-mill dispersion, attritor dispersion, or sand-mill dispersion is employed. In this process, it is effective for the dispersion to reduce the particle diameter of the charge-generating material to usually 0.5 μm or less, preferably 0.3 μm or less, and more preferably 0.15 μm or less.

Furthermore, the charge-generating layer may further contain an additional component that does not significantly impair the effects of the present invention. For example, the charge-generating layer may contain any additive. The additive is used for improving film-forming characteristics, flexibility, coating characteristics, contamination resistance, gas stability, light stability, or other characteristics. Examples of the additive include an antioxidant, a plasticizer, an ultraviolet absorber, an electron-attractive compound, a leveling agent, a visible light-shielding agent, a sensitizer, a dye, a pigment, and a surfactant. Examples of the antioxidant include hindered phenol compounds and hindered amine compounds. Examples of the dye and the pigment include various types of coloring compounds and azo compounds. Examples of the surfactant include silicone oils and fluorine-base oils.

The additives may be used alone or in any combination of two or more kinds in any ratio.

[IV-3. Charge-Transporting Layer]

The charge-transporting layer contains a charge-transporting material. Any known charge-transporting material can be used as long as it does not significantly impair the effects of the present invention.

In particular, the charge-transporting material is preferably a compound represented by the following Formula (I) (optionally, referred to as "arylamine compound according to the present invention"). Accordingly, in the photoreceptor of the present invention, the photosensitive layer preferably contains the arylamine compound according to the present invention.

[Chemical Formula 9]

(I)

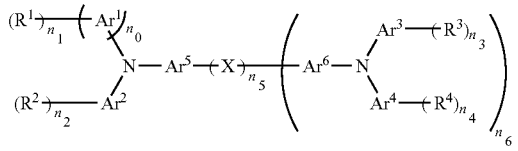

(in Formula (I), $Ar^1$ to $Ar^6$ each independently represent an aromatic moiety that may have a substituent, X represents an organic moiety that may have a substituent, $R^1$ to $R^4$ each independently represent an unsaturated group that may have a substituent, $n_1$ is 1 or 2, and $n_0$ and $n_2$ to $n_6$ represent integers of 0 to 2).

In Formula (I), $Ar^1$ to $Ar^6$ each independently represent an aromatic moiety that may have a substituent. Here, the valences of $Ar^1$ to $Ar^6$ are determined such that the structure represented by Formula (I) can be formed. Specifically, each of $Ar^2$ to $Ar^5$ is univalent or bivalent, and each of $Ar^1$ and $Ar^6$ is bivalent.

Examples of the aromatic moieties $Ar^1$ to $Ar^6$ include moieties of aromatic hydrocarbons such as benzene, naphthalene, anthracene, pyrene, perylene, phenanthrene, and fluorene; and moieties of aromatic heterocycles such as thiophene, pyrrole, carbazole, and imidazole.

In addition, the number of the carbon atoms of the aromatic moieties $Ar^1$ to $Ar^6$ is not limited within a range that does not significantly impair the effects of the present invention, and is usually 20 or less, preferably 16 or less, and more preferably 10 or less. A larger number of carbon atoms may decrease the stability of the arylamine compound represented by Formula (I), resulting in decomposition by oxidizing gas. Thus, ozone resistance may be decreased. Furthermore, ghosting due to memory may occur during formation of an image. The lower limit is usually 5 or more and preferably 6 or more, from the viewpoint of electric characteristics.

From the viewpoints described above, among the above-mentioned aromatic moieties, aromatic hydrocarbon moieties are preferred, and a benzene moiety is more preferred as $Ar^1$ to $Ar^6$. More preferably, all $Ar^1$ to $Ar^6$ are benzene moieties.

The substituents of $Ar^1$ to $Ar^6$ are not limited as long as the effects of the present invention are not significantly impaired. Examples of the substituent include alkyl groups such as a methyl group, an ethyl group, a propyl group, an isopropyl group, and an allyl group; alkoxy groups such as a methoxy group, an ethoxy group, and a propoxy group; aryl groups such as a phenyl group, an indenyl group, a naphthyl group, an acenaphthyl group, a phenanthryl group, and a pyrenyl group; and heterocyclic groups such as an indolyl group, a quinolyl group, and a carbazolyl group. These substituents may form a ring through a linking group or by a direct bond.

The introduction of the substituent can control intramolecular charge of the arylamine compound according to the present invention to increase charge mobility. However, it may decrease charge mobility by distortion of the intramolecular conjugate plane and intermolecular steric interactions due to the increased molecular volume. Accordingly, the number of the carbon atoms of the substituent is usually 1 or more and usually 6 or less, preferably 4 or less, and more preferably 2 or less.

The number of the substituents may be one or more. In addition, the substituents may be used alone or in any combination of two or more in any ratio. However, introduction of a plurality of substituents is effective for suppressing crystal precipitation of the arylamine compound according to the present invention and is preferred. However, a larger number of the substituents may contrarily decrease charge mobility due to intramolecular conjugate distortion and intermolecular steric interactions. Accordingly, the number of the substituents of each $Ar^1$ to $Ar^6$ is usually 2 or less per ring.

Preferably, the substituents of $Ar^1$ to $Ar^6$ each have small bulkiness for improving stability of the arylamine compound according to the present invention in a photosensitive layer and for improving electric characteristics. From these viewpoints, examples of the substituents of $Ar^1$ to $Ar^6$ are preferably a methyl group, an ethyl group, a butyl group, an isopropyl group, and a methoxy group.

In particular, when $Ar^1$ to $Ar^4$ are benzene moieties, they preferably have substituents. In such a case, examples of the substituent are preferably an alkyl group, and a methyl group is particularly preferred.

When $Ar^5$ or $Ar^6$ is a benzene moiety, preferred substituents are a methyl group and a methoxy group.

Furthermore, in Formula (I), at least one of $Ar^1$ to $Ar^4$ preferably has a fluorene structure. In such a case, the fluorene structure may be present at least as a partial skeleton. With this, the resulting electrophotographic photoreceptor can exhibit high charge mobility, quick response, and low residual potential.

In Formula (I), X represents an organic moiety that may have a substituent. Here, X has a valence so that the structure represented by Formula (I) can be formed. Specifically, the valence is bivalent or tervalent. In Formula (I), when $n_5$ is 2 (namely, there are two X's), the X's may be the same or different from each other.

Examples of X include aromatic moieties that may have substituents; saturated aliphatic moieties; heterocyclic moieties; organic groups having ether structures; and organic moieties having divinyl structures.

The number of the carbon atoms in the organic moiety X is not limited within a range that does not significantly impair the effects of the present invention, and is usually 1 or more and 15 or less. In particular, X is preferably an aromatic moiety or a saturated aliphatic moiety. When X is an aromatic moiety, the number of the carbon atoms of the aromatic moiety is preferably 6 or more and preferably 14 or less and more preferably 10 or less. More specifically, arylene groups such as a phenylene group and a naphthylene group are preferred. When X is a saturated aliphatic moiety, the number of the carbon atoms in the saturated aliphatic moiety is preferably 10 or less and more preferably 8 or less.

X may have any substituent that does not significantly impair the effects of the present invention. Examples of the substituent include alkyl groups such as a methyl group, an ethyl group, a propyl group, an isopropyl group, and an allyl group; alkoxy groups such as a methoxy group, an ethoxy group, and a propoxy group; aryl groups such as a phenyl group, an indenyl group, a naphthyl group, an acenaphthyl group, a phenanthryl group, and a pyrenyl group; and heterocyclic groups such as an indolyl group, a quinolyl group, and a carbazolyl group. Among them, aryl groups, in particular, a phenyl group is preferred. Such substituents can improve electronic characteristics of the resulting photoreceptor. Furthermore, in order to accelerate the charge mobility, alkyl groups, in particular, a methyl group and an ethyl group are preferred. Furthermore, these substituents may form a ring through a linking group or by a direct bond.

The number of the carbon atoms of the substituent of X is not limited as long as the effects of the present invention are not significantly impaired, and is usually 1 or more and usually 10 or less, preferably 6 or less, and more preferably 3 or less. From this view point, preferable examples of the substituent of X include a methyl group, an ethyl group, a butyl group, an isopropyl group, and a methoxy group.

X may have one or more substituents. In addition, the substituents may be used alone or in any combination of two or more kinds in any ratio. A plurality of substituents is preferred because it is effective for suppressing crystal precipitation of the arylamine compound according to the present invention. However, a larger number of substituents may contrarily decrease charge mobility due to distortion of the intramolecular conjugate plane and intermolecular steric interactions. Accordingly, the number of the substituents of X is usually 2 or less per ring.

In Formula (I), $R^1$ to $R^4$ each independently represent an unsaturated group that may have a substituent. The unsaturated group is a part of an unsaturated compound. Specifically, the unsaturated compound is an organic compound having a double bond or a triple bond between carbon atoms. However, the aromatic double bond is not regarded as the unsaturated double bond.

The unsaturated groups $R^1$ to $R^4$ may be any type that does not significantly impair the effects of the present invention, and preferably have groups represented by the following Formula (II):

[Chemical Formula 10]

(II)

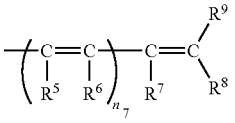

(in Formula (II), $R^5$ to $R^9$ each independently represent a hydrogen atom or an alkyl or aryl group that may have a substituent, and $n_7$ represents an integer of 0 to 5).

In Formula (II), $R^5$ to $R^9$ each independently represent a hydrogen atom or an alkyl or aryl group that may have a substituent.

The number of the carbon atoms in the alkyl groups $R^5$ to $R^9$ is not limited within a range that does not significantly impair the effects of the present invention, and is usually 10 or less, preferably 6 or less, and more preferably 3 or less.

Examples of the alkyl groups $R^5$ to $R^9$ include a methyl group, an ethyl group, a propyl group, a butyl group, a hexyl group, and a stearyl group. Among them, a methyl group is preferred.

The number of the carbon atoms of the aryl groups $R^5$ to $R^9$ is not limited within a range that does not significantly impair the effects of the present invention, and is usually 16 or less, preferably 10 or less, and more preferably 6 or less. Examples of the aryl groups $R^5$ to $R^9$ include a phenyl group, an indenyl group, a naphthyl group, an acenaphthyl group, a phenanthryl group, and a pyrenyl group.

The alkyl group and the aryl group may have a substituent. The substituents of $R^5$ to $R^9$ are not limited as long as the effects of the present invention are not significantly impaired. Examples of the substituents include alkyl groups such as a methyl group, an ethyl group, a propyl group, an isopropyl group, and an allyl group; alkoxy groups such as a methoxy group, an ethoxy group, and a propoxy group; aryl groups such as a phenyl group, an indenyl group, a naphthyl group, an acenaphthyl group, a phenanthryl group, and a pyrenyl group; and heterocyclic groups such as an indolyl group, a quinolyl group, and a carbazolyl group.

These substituents may form a ring through a linking group or by a direct bond. Furthermore, the number of the carbon atoms of the substituents of $R^5$ to $R^9$ is not limited within a range that does not significantly impair the effects of the present invention, and is usually 10 or less.

Furthermore, in Formula (II), $n_7$ represents an integer of 0 or more and 5 or less and preferably 2 or less.

In the aforementioned Formula (I), $n_1$ is 1 or 2 and is preferably 1.

In Formula (I), $n_0$ and $n_2$ each independently represent an integer of 0 or 2 and preferably 0 or 1. However, when $n_0$ is 0, $n_1$ is 1.

Furthermore, in Formula (I), $n_3$ and $n_4$ each independently represent an integer of 0 to 2.

In addition, in Formula (I), $n_5$ and $n_6$ represent integers of 0 to 2. When $n_5$ is 0, X represents a direct bond (direct coupling) (that is, $Ar^5$ and $Ar^6$ are directly bonded to each other). When $n_6$ is 0, $n_5$ is preferably 0.

When both $n_5$ and $n_6$ are 1, X preferably represents an alkylidene group, an arylene group, or a group having an ether structure.

Examples of the alkylidene group preferably include a phenylmethylidene group, a 2-methylpropylidene group, a 2-methylbutylidene group, and a cyclohexylidene group. Examples of the arylene group preferably include a phenylene group and a naphthylene group. Furthermore, examples of the group having an ether structure preferably include —O—$CH_2$—O—.

In Formula (I), when both $n_5$ and $n_6$ are 0, $Ar^5$ is preferably a benzene moiety or a fluorene moiety. In particular, when $Ar^5$ is a benzene moiety, the benzene moiety is preferably substituted by an organic group such as an alkyl group or an alkoxy group. Among them, the substituent is preferably a methyl group or a methoxy group. In particular, the organic group is preferably bonded to the para-position with respect to the nitrogen atom.

Furthermore, in Formula (I), when $n_6$ is 2, X is preferably a benzene moiety.

Table 2 shows examples of specific combinations of $n_0$ to $n_6$ in Formula (I).

TABLE 2

[Examples of combinations of $n_0$ to $n_6$]

| $n_0$ | $n_1$ | $n_2$ | $n_3$ | $n_4$ | $n_5$ | $n_6$ |
|---|---|---|---|---|---|---|
| 1 | 1 | 0 | 0 | 0 | 0 | 0 |
| 1 | 1 | 1 | 0 | 0 | 0 | 0 |
| 1 | 1 | 0 | 1 | 0 | 0 | 1 |
| 1 | 1 | 1 | 1 | 1 | 0 | 1 |
| 1 | 2 | 2 | 0 | 0 | 0 | 0 |
| 1 | 2 | 0 | 0 | 0 | 0 | 0 |
| 1 | 2 | 2 | 2 | 2 | 1 | 1 |
| 1 | 1 | 1 | 1 | 0 | 2 | 1 |
| 1 | 1 | 1 | 1 | 1 | 1 | 2 |
| 0 | 1 | 1 | 0 | 0 | 0 | 0 |

Specific examples of preferable structure of the arylamine compound according to the present invention are shown below. In the following structural formulae of the arylamine compound, R represents a hydrogen atom or any substituent, and R's may be the same or different from each other. Examples of the substituent R preferably include organic groups such as alkyl groups, alkoxy groups, and aryl groups. In particular, a methyl group and a phenyl group are more preferred. Furthermore, n represents an integer of 0 to 2.

[Chemical Formula 11]

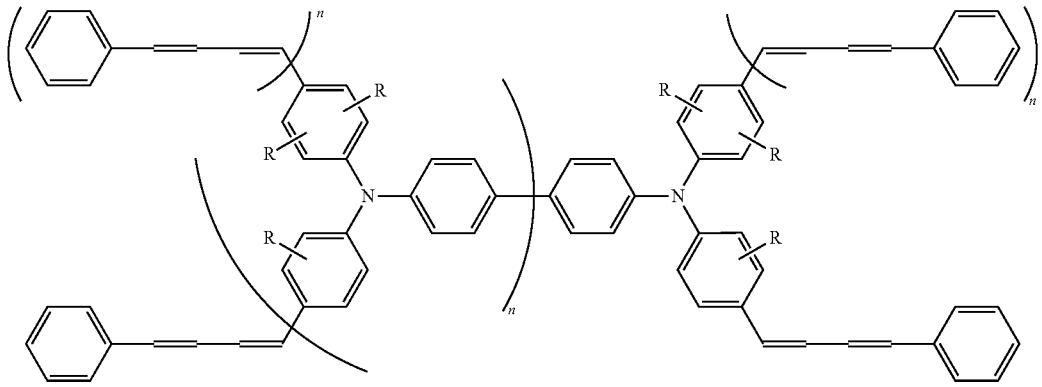

-continued
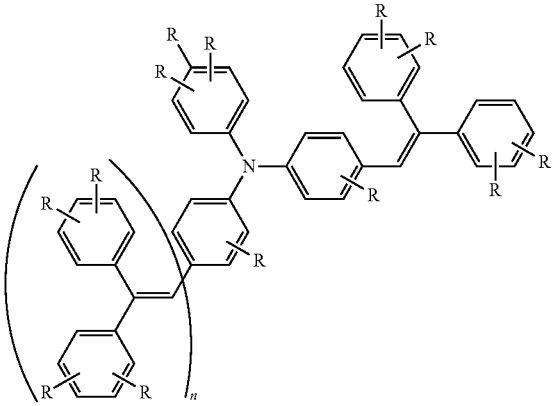
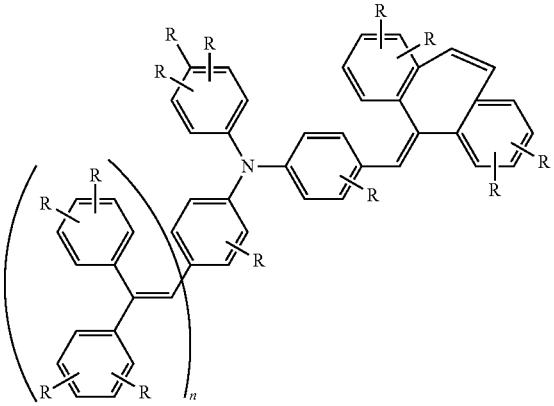
[Chemical Formula 12]
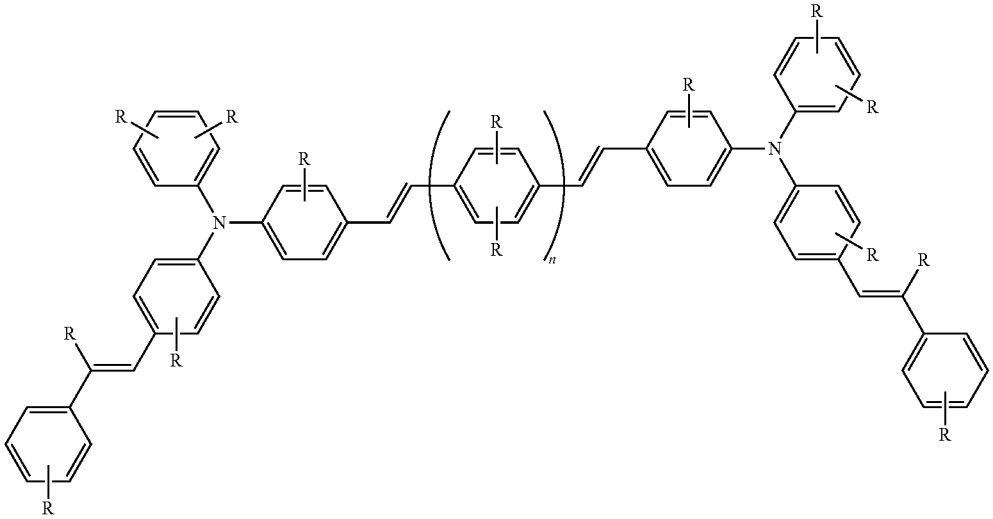
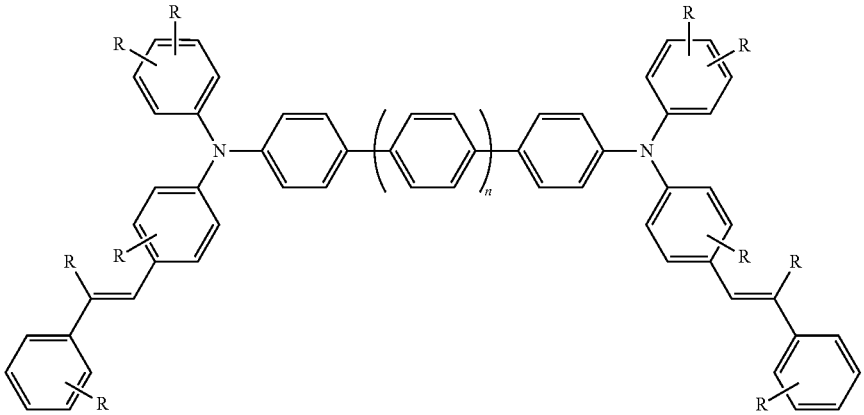

-continued
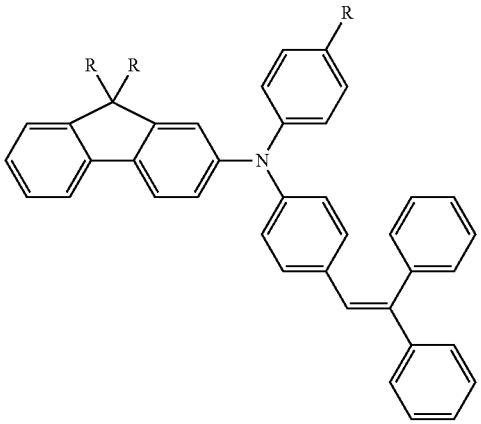
[Chemical Formula 13]
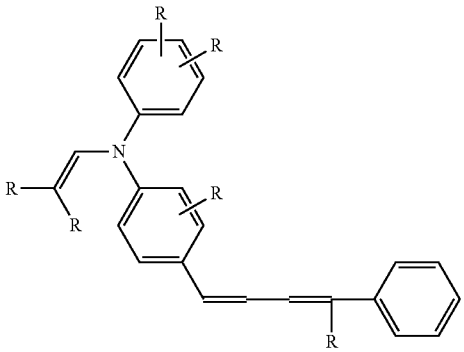
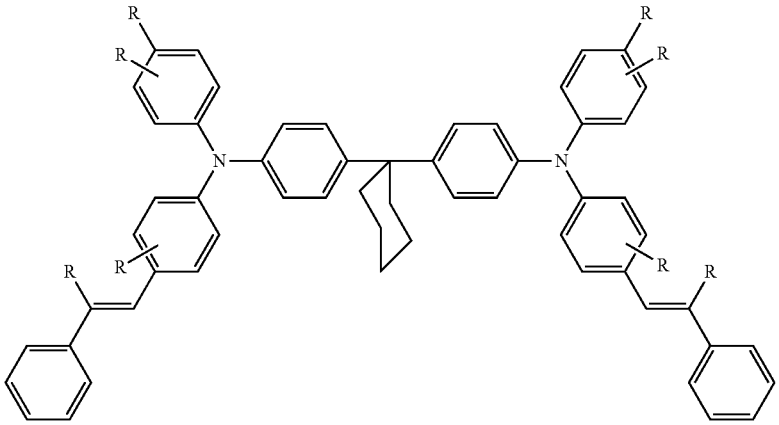
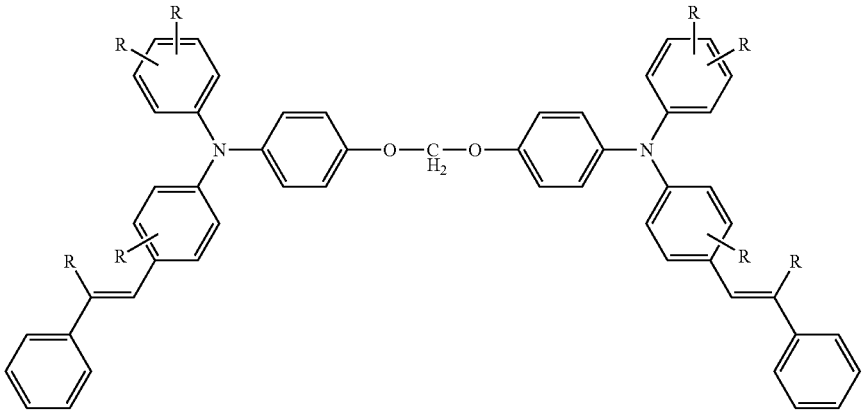

-continued
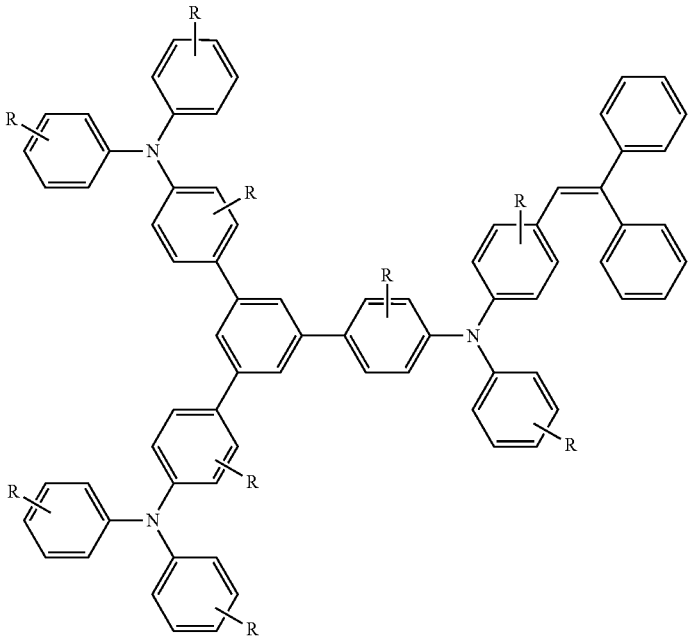
[Chemical Formula 14]
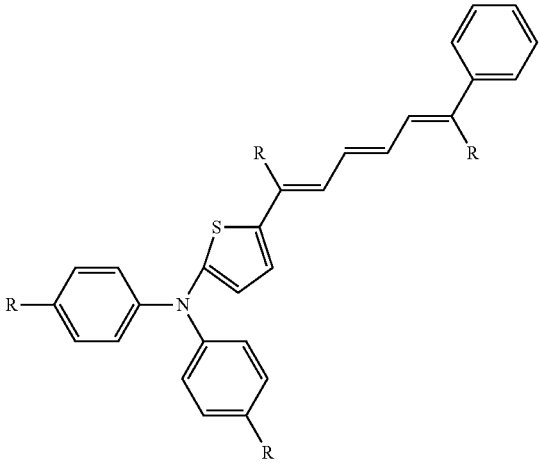
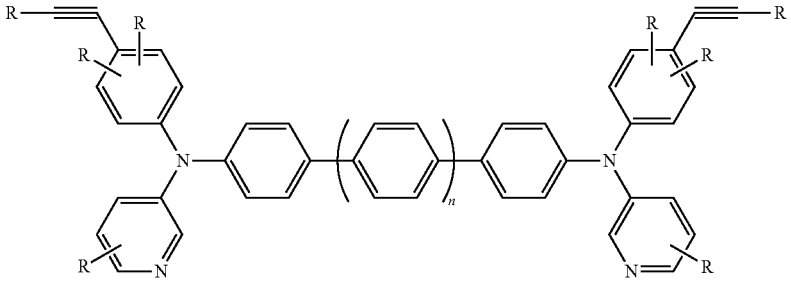

-continued

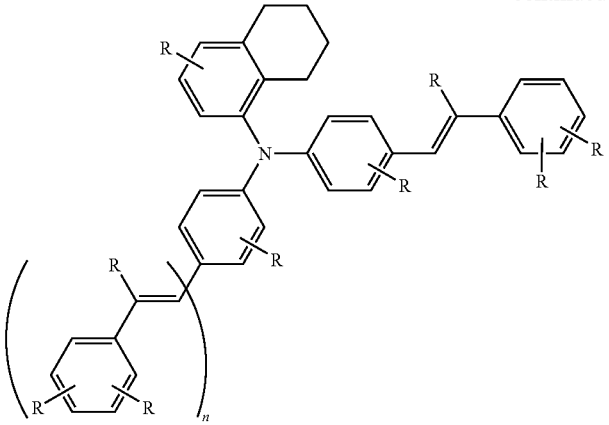

Furthermore, examples of charge-transporting materials other than the arylamine compound according to the present invention include aromatic nitro compounds such as 2,4,7-trinitrofluorenone; cyano compounds such as tetracyanoquinodimethane; electron-attractive materials, for example, quinone compounds such as diphenoquinone; heterocyclic compounds such as carbazole derivatives, indol derivatives, imidazole derivatives, oxazole derivatives, pyrazole derivatives, thiadiazole derivatives, and benzofuran derivatives; aniline derivatives, hydrazone derivatives, aromatic amine derivatives, stilbene derivatives, butadiene derivatives, enamine derivatives, and products in which some of these compounds are bonded to each other; and electron-donating materials such as polymers having groups composed of these compounds in their main chains or side chains.

Among them, carbazole derivatives, aromatic amine derivatives, stilbene derivatives, butadiene derivatives, enamine derivatives, and products in which some of these compounds are bonded to each other are preferable. These change-transporting materials may be used alone or in any other combination of two or more kinds in any ratio.

Specific structures of preferable examples of these charge-transporting materials are shown below. These examples are merely shown for illustrative purposes, and any known charge-transporting material may be used within the scope of the present invention.

[Chemical Formula 15]

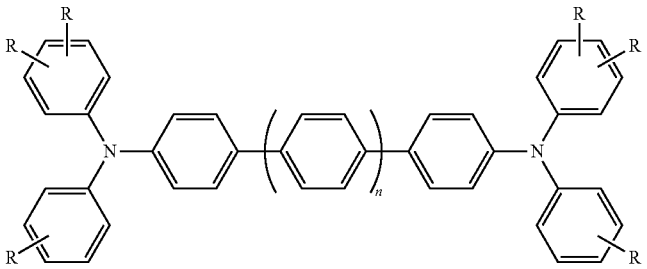

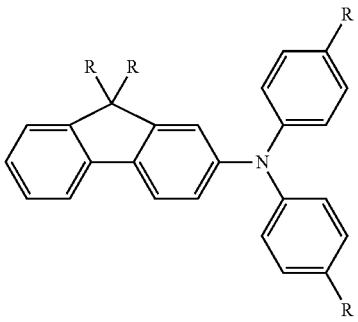

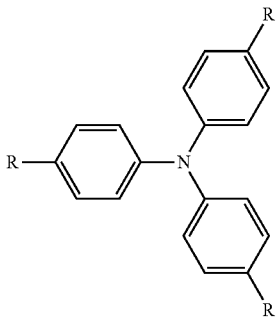

-continued
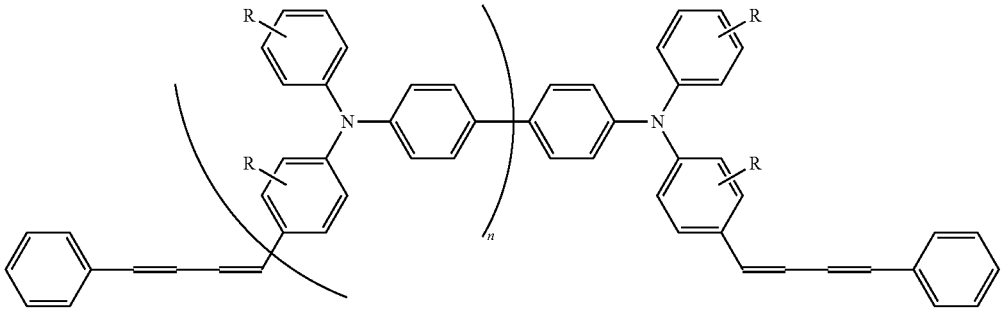
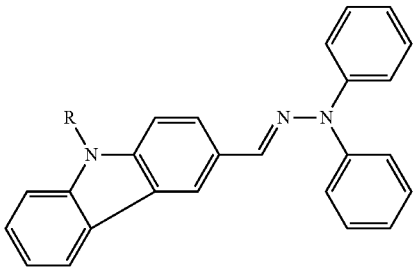
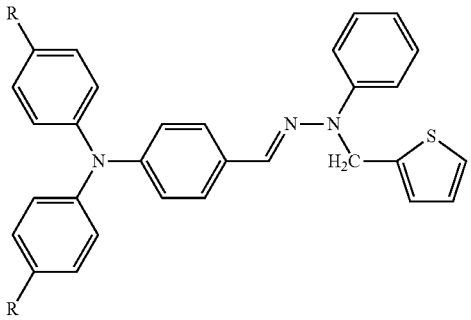
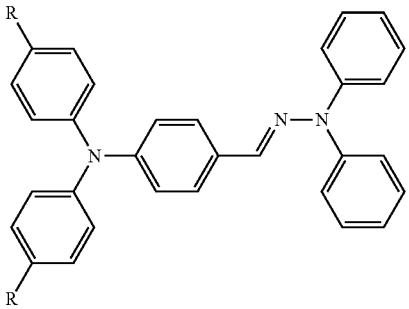
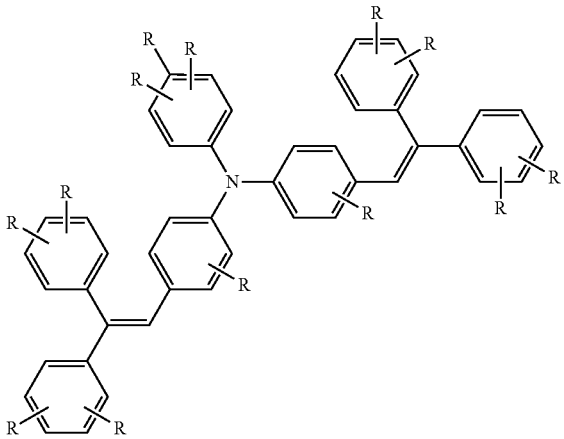
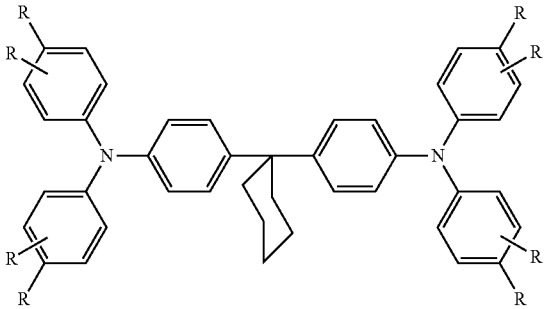
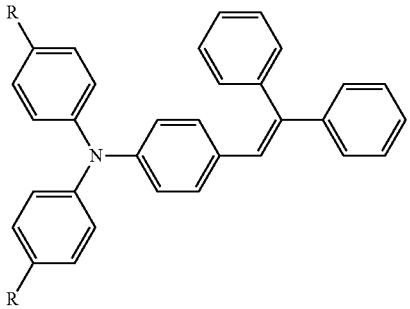

-continued
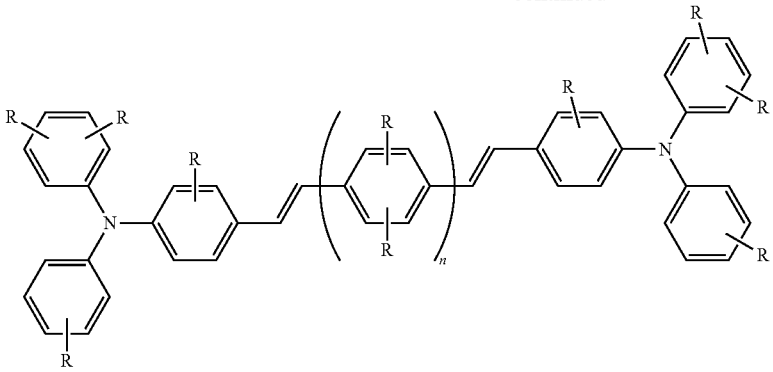
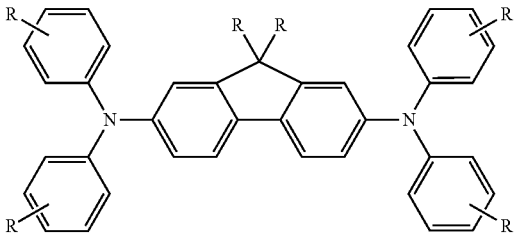
[Chemical Formula 16]
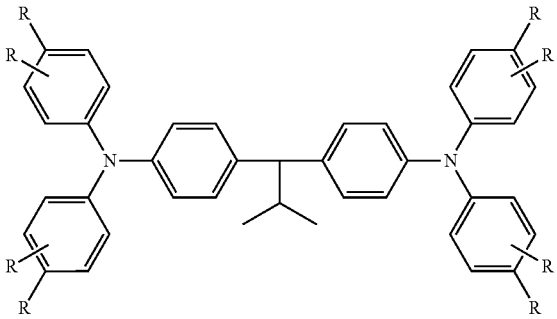
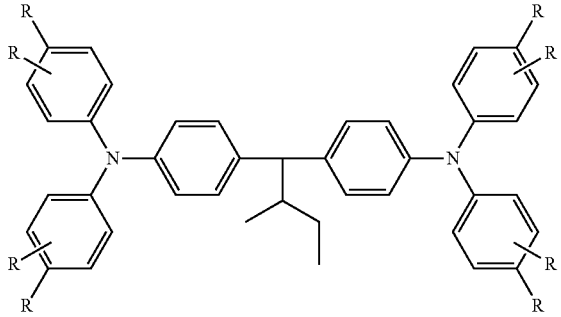
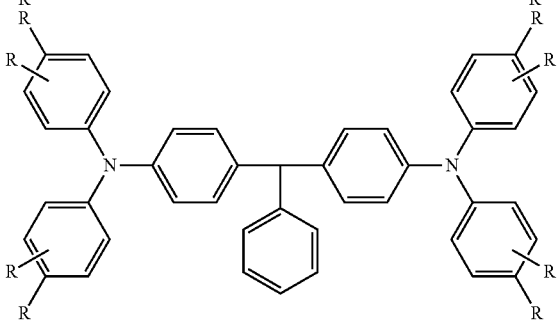
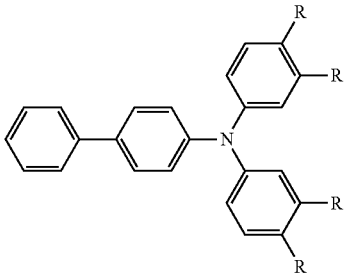
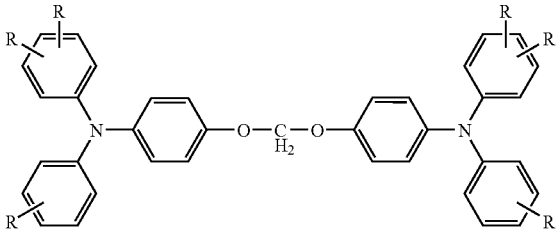
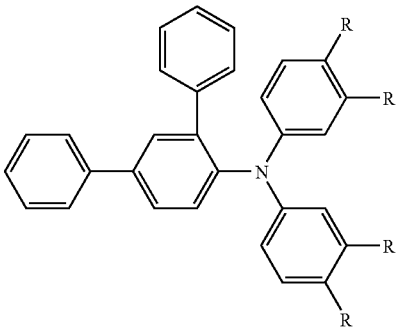
In the structures shown above, R represents a hydrogen atom or a substituent. This substituent is preferably an organic group such as an alkyl group, an alkoxy group, or a phenyl group. Particularly preferred is a methyl group. Furthermore, n represents an integer of 0 to 2. R may be the same or different from each other.

In addition, when the arylamine compound according to the present invention and a charge-generating material other than the arylamine compound are used as the charge-generating material, the amount of the arylamine compound according to the present invention relative to that of the total charge-generating material is usually 60 wt % or more, preferably 80 wt % or more, and more preferably 90 wt % or more. A smaller amount of the arylamine compound according to the present invention may decrease memory resistance of a photoreceptor, resulting in ready ghosting. The upper limit is 100 wt %.

In the charge-transporting layer, the charge-transporting material is bound with a binder resin. The binder resin is used to ensure the strength of the layer.

Examples of the binder resin used in the charge-generating layer include butadiene resins, styrene resins, vinyl acetate resins, vinyl chloride resins, acrylic acid ester resins, methacrylic acid ester resins, vinyl alcohol resins, polymers and copolymers of vinyl compounds such as ethyl vinyl ether, polyvinyl butyral resins, polyvinyl formal resins, partially modified polyvinyl acetal, polycarbonate resins, polyester resins, polyarylate resins, polyamide resins, polyurethane resins, cellulose ester resins, phenoxy resins, silicone resins, silicone-alkyd resins, and poly-N-vinylcarbazole resins. These binder resins may be modified with a silicon reagent or any other reagent.

Among the above-mentioned binder resins, the polycarbonate resins and the polyarylate resins are particularly preferred. Furthermore, among the polycarbonate resins and the polyarylate resins, polycarbonate resins and polyarylate resins containing a bisphenol component or a biphenol component having a structure shown below are preferred from the viewpoints of sensitivity and residual potential. In particular, the polycarbonate resins are more preferred from the viewpoint of mobility.

The structures of monomers corresponding to the bisphenol component and the biphenol component that can be suitably used in the polycarbonate resins are shown below. However, these are merely exemplified for clarifying the concept, and accordingly the present invention is not limited to these monomers shown below within the scope of the present invention.

[Chemical Formula 17]

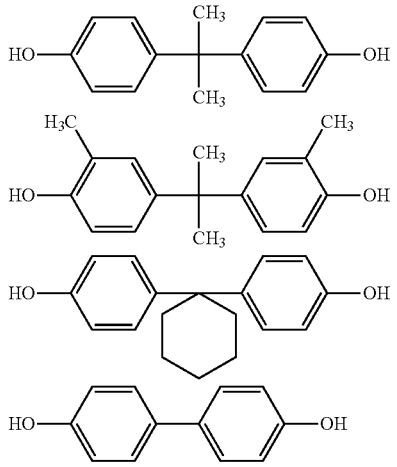

-continued

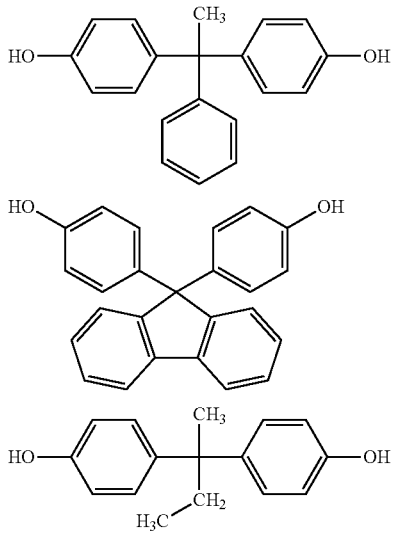

In particular, in order to achieve higher effects of the present invention, preferred are polycarbonate resins containing bisphenol components corresponding to the bisphenol derivatives shown by the following structures:

[Chemical Formula 18]

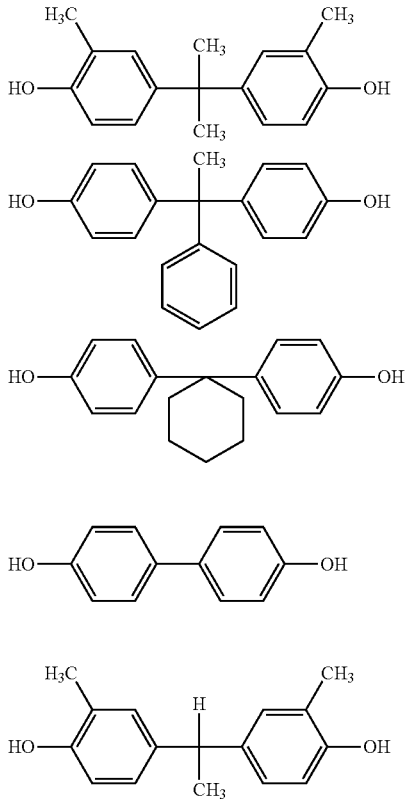

Furthermore, in order to improve mechanical characteristics, it is preferable to use a polyarylate resin. In such a case, preferred are bisphenol components corresponding to monomers represented by the following structural formulae:

[Chemical Formula 19]

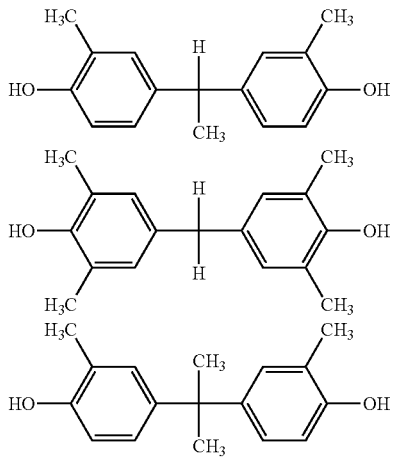

Furthermore, preferred are acid components correspond to monomers represented by the following formulae:

[Chemical Formula 20]

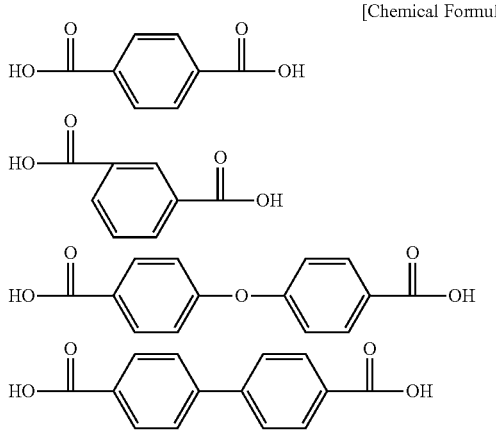

In addition, in the charge-transporting layer, the binder resins may be used alone or in any combination of two or more kinds in any ratio.

The ratio of the charge-transporting material used in the charge-transporting layer to the binder resin is not limited as long as the effects of the present invention are not significantly impaired, and the amount of the charge-transporting material is usually 20 parts by weight or more, preferably 30 parts by weight or more from the viewpoint of a decrease in residual potential, and more preferably 40 parts by weight or more from the viewpoints of stability in repeated use and charge mobility, on the basis of 100 parts by weight of the binder resin. On the other hand, the amount is usually 150 parts by weight or less from the viewpoint of thermal stability of the photosensitive layer, more preferably 120 parts by weight or less from the viewpoint of compatibility between the charge-transporting material and the resin binder, more preferably 100 parts by weight or less from the viewpoint of printing durability, and most preferably 80 parts by weight or less from the viewpoint of scratch resistance.

Furthermore, the thickness of the charge-transporting layer is not limited, but is usually 5 μm or more and preferably 10 μm or more from the viewpoints of a long service life and image stability, and usually 50 μm or less, preferably 45 μm or less from the viewpoints of a long service life and image stability, and more preferably 30 μm or less from the viewpoint of high resolution.

Furthermore, the charge-generating layer may contain any component, for example, any additive that does not significantly impair the effects of the present invention, as in the charge-transporting layer.

[IV-4. Single Photosensitive Layer]

A single photosensitive layer is composed of the charge-generating material dispersed in a charge-transporting layer having the blending ratio mentioned above.

In the single photosensitive layer, the types and the ratio of the charge-transporting material and the binder resin are the same as those described in the charge-transporting layer. Therefore, the single photosensitive layer contains the arylamine compound according to the present invention.

Furthermore, the charge-generating material is the same type as those described above. However, in this case, it is desirable that the particle diameter of the charge-generating material be sufficiently small. Specifically, the particle diameter is usually 0.5 μm or less, preferably 0.3 μm or less, and more preferably 0.15 μm or less.

Furthermore, a smaller amount of the charge-generating material dispersed in the photosensitive layer may cause insufficient sensitivity, and a larger amount may cause a decrease in charging performance and a decrease in sensitivity. Accordingly, the amount of the charge-generating material in the single photosensitive layer is usually 0.1 wt % or more and more preferably 1 wt % or more and usually 50 wt % or less and preferably 20 wt % or less.

The thickness of the single photosensitive layer is not limited, but is usually 5 μm or more and preferably 10 μm or more and usually 100 μm or less and more preferably 50 μm or less.

Furthermore, the single photosensitive layer may also contain any component that does not significantly impair the effects of the present invention. For example, this layer may contain additives, like the charge-generating layer.

[IV-5. Method for Forming Photosensitive Layer]

Each layer (charge-generating layer, charge-transporting layer, or single photosensitive layer) constituting a photosensitive layer may be formed by any method without limitation, but, usually, these layers are formed in series by repeating the coating and drying steps of coating liquids each containing materials constituting each layer (coating liquid for a charge-generating layer, coating liquid for a charge-transporting layer, and coating liquid for a single photosensitive layer) onto an undercoat layer by a known method.

For example, the charge-generating layer can be formed by preparing a coating liquid by dissolving or dispersing a charge-generating material, a binder resin, and other components in a solvent; applying this coating liquid onto an undercoat layer in the case of a normal laminated photosensitive layer or onto a charge-transporting layer in the case of a reverse laminated photosensitive layer; and drying the liquid.

The charge-transporting layer can be formed by preparing a coating liquid by dissolving or dispersing a charge-transporting material, a binder resin, and other components in a solvent; applying this coating liquid onto the charge-generating layer in the case of a normal laminated photosensitive layer or onto the undercoat layer in the case of a reverse laminated photosensitive layer; and drying the liquid.

Furthermore, the single photosensitive layer can be formed by preparing a coating liquid by dissolving or dispersing a charge-generating material, a charge-transporting material, a binder resin, and other components in a solvent; applying this coating liquid onto an undercoat layer; and drying the liquid.

The solvent (or dispersion medium) used for dissolving the binder resin in the preparation of the coating liquid is not limited as long as the effects of the present invention are not significantly impaired. Examples of the solvent include saturated aliphatic solvents such as pentane, hexane, octane, and nonane; aromatic solvents such as toluene, xylene, and anisole; halogenated aromatic solvents such as chlorobenzene, dichlorobenzene, and chloronaphthalene; amide solvents such as dimethylformamide and N-methyl-2-pyrrolidone; alcohol solvents such as methanol, ethanol, isopropanol, n-butanol, and benzyl alcohol; aliphatic polyols such as glycerin and ethylene glycol; straight, branched, or cyclic ketone solvents such as acetone, cyclohexanone, methyl ethyl ketone, and 4-methoxy-4-methyl-2-pentanone; ester solvents such as methyl formate, ethyl acetate, and n-butyl acetate; halogenated hydrocarbon solvents such as methylene chloride, chloroform, and 1,2-dichloroethane; straight or cyclic ether solvents such as diethyl ether, dimethoxy ethane, tetrahydrofuran, 1,4-dioxane, methyl cellosolve, and ethyl cellosolve; aprotic polar solvents such as acetonitrile, dimethyl sulfoxide, sulforane, and hexamethyl phosphate triamide; nitrogen-containing compounds such as n-butylamine, isopropanolamine, diethylamine, triethanolamine, ethylenediamine, and triethylamine; mineral oils such as ligroin; and water. Among them, those that do not dissolve the undercoat layer are particularly preferable.

In addition, these solvents may be used alone or in any combination of two or more kinds in any ratio.

The solid content in the coating liquid for a monolayer photoreceptor or a charge-transporting layer is usually 5 wt % or more and preferably 10 wt % or more and usually 40 wt % or less and preferably 35 wt % or less. In addition, the viscosity of these coating liquids is usually 10 mPa·s or more and preferably 50 mPa·s or more and usually 500 mPa·s or less and preferably 400 mPa·s or less.

On the other hand, in the coating liquid for a charge-generating layer, the solid content is usually 0.1 wt % or more and preferably 1 wt % or more and usually 15 wt % or less and preferably 10 wt % or less. In addition, the viscosity of this coating liquid is usually 0.01 mPa·s or more and preferably 0.1 mPa·s or more and usually 20 mPa·s or less and preferably 10 mPa·s or less.

The coating liquid may be applied by any method, for example, dip coating, spray coating, spin coating, bead coating, wire-bar coating, blade coating, roller coating, air-knife coating, curtain coating, or any other known coating method.

The coating liquid may be dried by any method, and is preferably dried by contact drying at room temperature and then heat drying at a temperature ranging from 30 to 200° C. for 1 minute to 2 hours with or without ventilation. The heating temperature may be constant or variable during the drying process.

[V. Other Layers]

The electrophotographic photoreceptor of the present invention may include any other layer, in addition to the undercoat layer and photosensitive layer.

For example, a protective layer may be disposed on the outermost layer of the photoreceptor in order to prevent abrasion of the photosensitive layer or prevent or reduce deterioration of the photosensitive layer, which is caused by materials or the like generated from a charging device or other portions. For example, the protective layer can be made of a suitable binding resin containing an electroconductive material or a copolymer of a charge-transportable compound, such as a triphenylamine skeleton described in Japanese Unexamined Patent Application Publication No. 9-190004 or 10-252377.

Examples of the electroconductive material can include, but are not limited to, aromatic amino compounds such as TPD (N,N'-diphenyl-N,N'-bis-(m-tolyl)benzidine, and metal oxides such as antimony oxide, indium oxide, tin oxide, titanium oxide, tin oxide-antimony oxide, aluminum oxide, and zinc oxide. The electroconductive materials may be used alone or in any combination of two or more kinds in any ratio.

The binder resin used in the protective layer may be any known resin, and examples thereof include polyamide resins, polyurethane resins, polyester resins, epoxy resins, polyketone resins, polycarbonate resins, polyvinyl ketone resins, polystyrene resins, polyacrylamide resins, and siloxane resins. In addition, copolymers of such resins and charge-transportable skeletons, such as a triphenyl amine skeleton described in Japanese Unexamined Patent Application Publication No. 9-190004 or 10-252377, can be used. These binder resins may be used alone or in any combination of two or more kinds in any ratio.

Furthermore, the protective layer preferably has an electric resistance of $10^9$ to $10^{14}$ Ω·cm. An electric resistance higher than $10^{14}$ Ω·cm may increase the residual potential to form a foggy image. On the other hand, an electric resistance lower than $10^9$ Ω·cm may cause a blur image or a decreased resolution.

In addition, the protective layer must be designed to ensure the transmission of light for image exposure.

Furthermore, the surface layer may contain, for example, a fluorine resin, a silicone resin, a polyethylene resin, or a polystyrene resin in order to decrease friction resistance and abrasion of the photoreceptor surface and to increase transfer efficiency of toner from the photoreceptor to a transfer belt or paper. The surface layer may also contain particles of these resins or inorganic compounds.

These layers other than the undercoat layer and the photosensitive layer may be formed by any method, but, usually, the layers are formed in series by repeating the coating and drying steps of coating liquids each containing materials constituting each layer by a known coating method, as in the photosensitive layer.

[IV. Advantage of Electrophotographic Photoreceptor of the Present Invention]

The electrophotographic photoreceptor of the present invention is excellent in electric characteristics. Specifically, it has high sensitivity and exhibits low residual potential. Furthermore, in general, it exhibits low dark attenuation which can be maintained even after repeated use. Thus, electric characteristics are stable even after the electrophotographic photoreceptor is repeatedly used.

Therefore, by forming images with the electrophotographic photoreceptor of the present invention, high-quality images that contain reduced black spots and fogs can be formed at initial and after printing durability, and the stability of image quality is satisfactory.

When the electrophotographic photoreceptor of the present invention contains the arylamine compound according to the present invention in the photosensitive layer, the electric characteristics, such as sensitivity and residual potential, are satisfactory even if environments, such as temperature and humidity, change. Therefore, in such a case, a satisfactory image can be formed under various operation environments. This advantage will now be elucidated with reference to conventional technologies.

In a conventional organic photoreceptor, known hole-transporting materials, which are charge-transporting materials, are, for example, hydrazone compounds, triphenylamine compounds, benzidine compounds, stilbene compounds, and butadiene compounds. Known electrontransporting materials, which are charge-transporting materials, are, for example, diphenoquinone compounds.

The charge-transporting material is selected in consideration of characteristics demanded in the photoreceptor. Examples of the characteristics demanded in the photoreceptor include: (1) electrostatic charge generated by corona discharge is high in a dark place, (2) attenuation of the charge generated by the corona discharge is low in a dark place, (3) the charge is rapidly dissipated by irradiation with light, (4) the residual electric charge after the irradiation with light is low, (5) an increase in the residual potential and a decrease in the initial potential are small in repeated use, and (6) changes in the electrophotographic characteristics caused by environmental changes, such as temperature and humidity, are small.

Various charge-transporting materials, such as a hydrazone compound, have been hitherto proposed for improving these characteristics (for example, Japanese Unexamined Patent Application Publication Nos. 11-202519 and 6-273962, Japanese Patent Publication Nos. 55-42380 and 58-32372, Japanese Unexamined Patent Application Publication Nos. 61-295558 and 58-198043, and Japanese Patent Publication Nos. 5-42661 and 7-21646).

In association with reductions in size and cost and speeding up of image forming in recent years, many image-forming apparatuses do not have components, such as a heater, for maintaining the temperature of the photoreceptor constant. The photoreceptor used in such an image-forming apparatus (in particular, color image-forming apparatus) is demanded to have a good response for maintaining high-quality image under any environment.

The above-mentioned conventional charge-transporting materials are also useful as hole-transporting agents for electrophotographic photoreceptors. In particular, the use of a hole-transporting agent having a stilbene skeleton in the photosensitive layer of an electrophotographic photoreceptor can provide a photoreceptor excellent, particularly, in response, for example. Though image defects due to poor response at low temperature are obviously suppressed by using the hole-transporting agent having a stilbene skeleton in the photosensitive layer of the electrophotographic photoreceptor, the demand is not sufficiently satisfied in some cases due to recent high-speed printing in image-forming apparatuses and an increase in demand for a high-quality image.

On the other hand, in a photoreceptor containing the arylamine compound according to the present invention, electric characteristics of high sensitivity and low residual potential can be achieved under various operation environments, and a high-quality image can be formed.

[VII. Image-Forming Apparatus]

Regarding an embodiment of an image-forming apparatus (image-forming apparatus of the present invention) including the electrophotographic photoreceptor of the present invention, the main structure of the apparatus will now be described with reference to FIG. 5. However, the embodiment is not limited to the following description, and various modifications can be conducted within the scope of the present invention.

Figure 5:
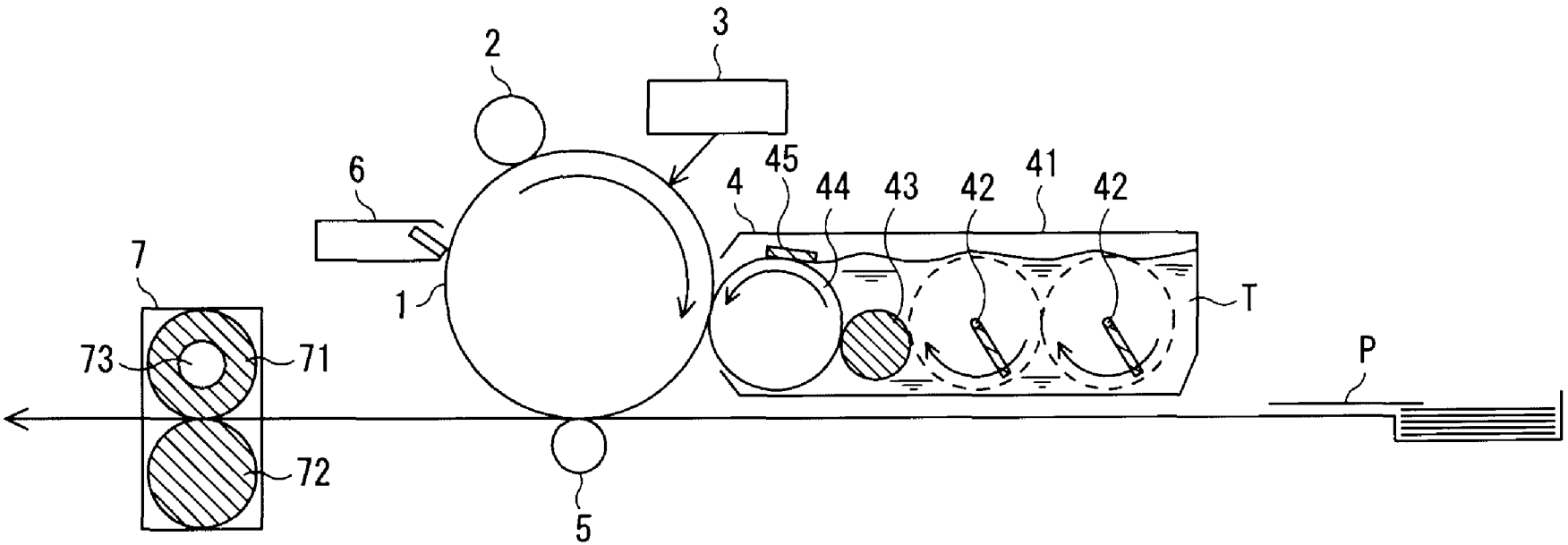
FIG. 5 is a schematic view illustrating the main structure of an embodiment of an image-forming apparatus provided with an electrophotographic photoreceptor of the present invention.

As shown in FIG. 5, the image-forming apparatus includes an electrophotographic photoreceptor 1, a charging device (charging means) 2, an exposure device (exposure means; image exposure means) 3, a development device (development means) 4, and a transfer device (transfer means) 5. Furthermore, the image-forming apparatus optionally includes a cleaning device (cleaning means) 6 and a fixation device (fixation means) 7.

The photoreceptor 1 of the image-forming apparatus of the present invention is the above-described electrophotographic photoreceptor of the present invention. That is, in the image-forming apparatus of the present invention including an electrophotographic photoreceptor, charging means for charging the electrophotographic photoreceptor, image exposure means for forming an electrostatic latent image by subjecting the charged electrophotographic photoreceptor to image exposure, development means for developing the electrostatic latent image with toner, and transfer means for transferring the toner to a transfer object, the electrophotographic photoreceptor includes an undercoat layer containing metal oxide particles and a binder resin on an electroconductive substrate, and a photosensitive layer disposed on the undercoat layer. The metal oxide particles have a volume average particle diameter of 0.1 μm or less and a 90% cumulative particle diameter of 0.3 μm or less which are measured by a dynamic light-scattering method in a liquid of the undercoat layer dispersed in a solvent mixture of methanol and 1-propanol at a weight ratio of 7:3. The photosensitive layer contains crystalline phthalocyanine showing at least one distinct main diffraction peak at a Bragg angle ($2\theta \pm 0.2°$) of 27.0° to 29.0° in an X-ray diffraction spectrum.

The electrophotographic photoreceptor 1 is the above-described electrophotographic photoreceptor of the present invention without any additional requirement. FIG. 5 shows, as such an example, a drum photoreceptor having the above-described photosensitive layer on the surface of a cylindrical electroconductive substrate. Along the outer surface of this electrophotographic photoreceptor 1, a charging device 2, an exposure device 3, a development device 4, a transfer device 5, and a cleaning device 6 are arranged.

The charging device 2 charges the electrophotographic photoreceptor 1 such that the surface of the electrophotographic photoreceptor 1 is uniformly charged to a predetermined potential. It is preferable that the charging device be in contact with the electrophotographic photoreceptor 1 in order to efficiently utilize the effects of the present invention. FIG. 5 shows a roller charging device (charging roller) as an example of the charging device 2, but other charging devices, for example, corona charging devices such as corotron or scorotron and contacting charging devices such as a charging brush, are widely used.

In many cases, the electrophotographic photoreceptor 1 and the charging device 2 are integrated into a cartridge (hereinafter, optionally, referred to as "photoreceptor cartridge") that is detachable from the body of an image-forming apparatus. When the electrophotographic photoreceptor 1 or the charging device 2 are degraded during the use, the photoreceptor cartridge can be replaced with a new one by detaching the used photoreceptor cartridge from the image-forming apparatus body and attaching the new one to the image-forming apparatus body. In addition, in many cases, toner described below is also stored in a toner cartridge detachable from an image-forming apparatus body. When the toner in the toner cartridge is exhausted in use, the toner cartridge can be detached from the image-forming apparatus body, and a new toner cartridge can be attached to the apparatus body. Furthermore, a cartridge including all the electrophotographic photoreceptor 1, the charging device 2, and the toner may be used.

The exposure device 3 may be of any type that can form an electrostatic latent image on a photosensitive surface of the electrophotographic photoreceptor 1 by exposure (image exposure) to the electrophotographic photoreceptor 1, and examples thereof include halogen lamps, fluorescent lamps, lasers such as a semiconductor laser and a He—Ne laser, and LEDs (light-emitting diodes). Furthermore, the exposure may be conducted by a photoreceptor internal exposure system. Any light can be used for the exposure. For example, the exposure may be carried out with monochromatic light having a wavelength of 780 nm; monochromatic light having a slightly shorter wavelength of 600 to 700 nm; or monochromatic light having a shorter wavelength of 350 to 600 nm. Among them, the exposure is preferably carried out with monochromatic light having a short wavelength of 350 to 600 nm and more preferably a wavelength of 380 to 500 nm.

The development device 4 develops the electrostatic latent image. The development device 4 may be of any type, and examples thereof include dry development systems such as cascade development, one-component conductive toner development, and two-component magnetic brush development; and wet development systems. The development device 4 shown in FIG. 5 includes a development tank 41, agitators 42, a supply roller 43, a development roller 44, a control member 45, and the development tank 41 containing toner T. In addition, the development device 4 may be provided with an optional refill device (not shown) for refilling the toner T. This refill device can refill the development tank 41 with toner T from a container such as a bottle or a cartridge.

The supply roller 43 is made of, for example, an electroconductive sponge. The development roller 44 is, for example, a metal roller made of, e.g., iron, stainless steel, aluminum, or nickel or a resin roller made of such a metal roller coated with, e.g., a silicone resin, a urethane resin, or a fluorine resin. The surface of this development roller 44 may be optionally smoothed or roughened.

The development roller 44 is arranged between the electrophotographic photoreceptor 1 and the supply roller 43 and abuts on both the electrophotographic photoreceptor 1 and the supply roller 43. The supply roller 43 and the development roller 44 are rotated by a rotary drive mechanism (not shown). The supply roller 43 carries the toner T stored and supplies it to the development roller 44. The development roller 44 carries the toner T supplied from the supply roller 43 and brings it into contact with the surface of the electrophotographic photoreceptor 1.

The control member 45 is made of, for example, a resin blade of, e.g., a silicone resin or a urethane resin; a metal blade of, e.g., stainless steel, aluminum, copper, brass, or phosphor bronze; or a blade made of such a metal blade coated with a resin. The control member 45 abuts on the development roller 44 and is biased toward the development roller 44 at a predetermined force (a usual blade line pressure is 5 to 500 g/cm) with, for example, a spring. The control member 45 may have an optional function charging the toner T by frictional electrification.

The agitators 42 are each rotated by a rotary drive mechanism and agitate and transfer the toner T to the supply roller 43. The blade shapes and sizes of the agitators 42 may be different from each other.

The toner T may be of any type, and polymerized toner prepared by suspension polymerization or emulsion polymerization, as well as powder toner, can be used. In the use of the polymerized toner, a small particle diameter of about 4 to 8 μm is particularly preferred, and various shapes of toner may be used from a spherical shape to a non-spherical shape such as a potato-like shape. The polymerized toner exhibits superior charging uniformity and transferring characteristics and, therefore, can be suitably used for forming an image with higher quality.

The transfer device 5 may be of any type, and devices employing, for example, electrostatic transfer such as corona transfer, roller transfer, or belt transfer; pressure transfer; or adhesive transfer can be used. The transfer device 5 includes a transfer charger, a transfer roller, and a transfer belt that are arranged so as to face the electrophotographic photoreceptor 1. The transfer device 5 transfers a toner image formed in the electrophotographic photoreceptor 1 to a transfer material (transfer object, paper, medium) P by a predetermined voltage (transfer voltage) with a polarity opposite to that of the charged potential of the toner T. In the present invention, it is effective that the transfer device 5 be in contact with the photoreceptor via the transfer material.

The cleaning device 6 may be of any type, and examples thereof include a brush cleaner, a magnetic brush cleaner, an electrostatic brush cleaner, a magnetic roller cleaner, and a blade cleaner. The cleaning device 6 collects remaining toner adhering to the photoreceptor 1 by scraping the remaining toner with a cleaning member. The cleaning device 6 is unnecessary when the amount of toner remaining on the surface of the photoreceptor is small or substantially zero.

The fixation device 7 is composed of an upper fixation member (fixation roller) 71 and a lower fixation member (fixation roller) 72, and the fixation member 71 or 72 is provided with a heating device 73 therein. FIG. 5 shows an example of the heating device 73 provided inside the upper fixation member 71. The upper and lower fixation members 71 and 72 may be known thermal fixation members, for example, a fixation roller in which a pipe of a metal material, such as stainless steel or aluminum, is coated with a silicone rubber, a fixation roller having a fluorine resin coating, or a fixation sheet. The upper and lower fixation members 71 and 72 may have a structure for supplying a mold-releasing agent, such as a silicone oil, for improving mold release properties or may have a structure for applying a pressure to each other with, for example, a spring.

The toner transferred onto a recording paper P is heated to be melted when passing through between the upper fixation member 71 and the lower fixation member 72 that are heated to a predetermined temperature, and then is fixed on the recording paper P by cooling thereafter.

The fixation device may be of any type, and examples thereof include, in addition to that described here, devices employing a system of heat roller fixation, flash fixation, oven fixation, or pressure fixation.

In the electrophotographic apparatus having a structure described above, an image is recorded as follows: The surface (photosensitive surface) of the photoreceptor 1 is charged to a predetermined potential (for example, −600 V) with the charging device 2. The charging may be conducted by a direct-current voltage or by a direct-current voltage superimposed by an alternating-current voltage.

Subsequently, the charged photosensitive surface of the photoreceptor 1 is exposed with the exposure device 3 depending on the image to be recorded. Thereby, an electrostatic latent image is formed in the photosensitive surface. This electrostatic latent image formed in the photosensitive surface of the photoreceptor 1 is developed by the development device 4.

In the development device 4, the toner T supplied by the supply roller 43 is spread into a thin layer with the control member (developing blade) 45 and, simultaneously, is charged by friction so as to have a predetermined polarity (here, the toner is charged into negative polarity, which is the same as the polarity of the charge potential of the photoreceptor 1). This toner T is held on the development roller 44 and is conveyed and brought into contact with the surface of the photoreceptor 1.

The charged toner T held on the development roller 44 comes into contact with the surface of the photoreceptor 1, so that a toner image corresponding to the electrostatic latent image is formed on the photosensitive surface of the photoreceptor 1. This toner image is transferred to a recording paper P with the transfer device 5. Thereafter, the toner remaining on the photosensitive surface of the photoreceptor 1 without being transferred is removed with the cleaning device 6.

After the transfer of the toner image to the recording paper P, the recording paper P passes through the fixation device 7 to thermally fix the toner image on the recording paper P. Thereby, an image is finally recorded.

The image-forming apparatus may have a structure that can conduct, for example, a charge elimination step, in addition to the above-described structure. The charge elimination step neutralizes the electrophotographic photoreceptor by exposing the electrophotographic photoreceptor with light. Examples of such a device for the charge elimination include fluorescent lamps and LEDs. In many cases, the light used in the charge elimination step has an exposure energy intensity at least 3 times that of the exposure light.

The structure of the image-forming apparatus may be further modified. For example, the image-forming apparatus may have a structure that conducts steps such as a pre-exposure step and a supplementary charging step, that performs offset printing, or that includes a full-color tandem system using different toners.

In the case that a combination of the photoreceptor 1 and the charging device 2 integrated into a cartridge, it is preferable that the cartridge further include the development device 4. Furthermore, a combination of the photoreceptor 1 and, according to need, one or more of the charging device 2, the exposure device 3, the development device 4, the transfer device 5, the cleaning device 6, and the fixation device 7 may be integrated into an integral cartridge (electrophotographic cartridge) that is detachable from an electrophotographic apparatus body such as a copier or a laser beam printer. That is, the electrophotographic cartridge of the present invention includes the electrophotographic photoreceptor and at least one of the charging means for charging the electrophotographic photoreceptor, the image exposure means for forming an electrostatic latent image by conducting image exposure to the charged electrophotographic photoreceptor, the development means for developing the electrostatic latent image with toner, the transfer means for transferring the toner to a transfer object, the fixation means for fixing the toner transferred on the transfer object, and the cleaning means for collecting the toner adhering to the electrophotographic photoreceptor, wherein the electrophotographic photoreceptor includes an undercoat layer containing metal oxide particles and a binder resin on an electroconductive substrate, and a photosensitive layer disposed on the undercoat layer. Here, it is preferable that the metal oxide particles have a volume average particle diameter of 0.1 μm or less and a 90% cumulative particle diameter of 0.3 μm or less which are measured by a dynamic light-scattering method in a liquid of the undercoat layer dispersed in a solvent mixture of methanol and 1-propanol at a weight ratio of 7:3 and that the photosensitive layer contains crystalline phthalocyanine showing at least one distinct main diffraction peak at a Bragg angle (2θ±0.2°) of 27.0° to 29.0° in an X-ray diffraction spectrum.

In this case, as in the cartridge described in the above embodiment, for example, even if the photoreceptor 1 or another member is deteriorated, the maintenance of an image-forming apparatus can be readily performed by detaching the electrophotographic cartridge from the image-forming apparatus body and attaching a new electrophotographic cartridge to the image-forming apparatus body.

The image-forming apparatus and the electrophotographic cartridge of the present invention can constantly form a high-quality image. Specifically, in the image-forming apparatus and the electrophotographic cartridge of the present invention, images that contain a reduced number of black spots can be formed at initial and after printing durability, and a significantly reduced number of fogs after printing durability, resulting in high and stable image quality.

Furthermore, conventionally, in the case that a transfer device 5 is in contact with a photoreceptor via a transfer material, the quality of an image is readily deteriorated. However, the image-forming apparatus and the electrophotographic cartridge of the present invention hardly cause such quality deterioration and are hence effective.

In addition, in the case using the arylamine compound according to the present invention, the image-forming apparatus and the electrophotographic cartridge of the present invention can form high-quality images under various environments. That is, since the electrophotographic photoreceptor according to the present invention exhibit excellent electric characteristics, i.e., high sensitivity and low residual potential, regardless of environments such as temperature and humidity, a high-quality image containing a small number of image defects can be formed regardless of environmental conditions by using the image-forming device and the electrophotographic cartridge of the present invention.

EXAMPLES

The present invention will now be further specifically described with reference to Examples and Comparative Examples, but is not limited thereto within the scope of the present invention. In the description of Examples, the term "part(s)" means "part(s) by weight" unless otherwise specified.

Example Group 1

Preparation of Oxytitanium Phthalocyanine

Preparation Example 1-1

Under nitrogen atmosphere, 66.6 g of phthalonitrile was suspended in 353 mL of diphenylmethane, and a liquid mixture of 15.0 g of titanium tetrachloride and 25 mL of diphenylmethane was added thereto at 40° C., followed by heating to 205 to 210° C. over about 1 hour. Then, a liquid mixture of 10.0 g of titanium tetrachloride and 16 mL of diphenylmethane was dropwise added thereto, and then a reaction was conducted at 205 to 210° C. for 5 hours. The product was subjected to heat filtration at 130 to 140° C. and then was washed with N-methylpyrrolidone (hereinafter, optionally, referred to as "NMP") and n-butanol successively. After reflux under heating in 600 mL of n-butanol, the product was washed by suspension in NMP, water, and methanol and then dried to obtain 47.0 g of B-type oxytitanium phthalocyanine.

This B-type oxytitanium phthalocyanine (20.0 g) was shaken in a paint shaker together with 120 mL of glass beads (diameter: 1.0 to 1.4 mm) for 25 hours. The oxytitanium phthalocyanine was washed out with methanol and filtered to obtain amorphous oxytitanium phthalocyanine. This oxytitanium phthalocyanine was suspended in 210 mL of water, and 40 mL of toluene was added thereto, followed by agitation at 60° C. for 1 hour. After the removal of water by decantation, the crystal type was converted by suspension washing with methanol, followed by filtration and drying to obtain 19.0 g of the target D-type oxytitanium phthalocyanine.

The X-ray diffraction spectrum of the resulting D-type oxytitanium phthalocyanine showed distinct diffraction peaks at Bragg angles (2θ±0.2°) of 9.6° and 27.3°, but did not show a distinct diffraction peak at a Bragg angle (2θ±0.2°) of 26.3°.

The mass spectrum showed a peak of unsubstituted oxytitanium phthalocyanine at m/z: 576 and a peak of chlorinated oxytitanium phthalocyanine at m/z: 610. The peak intensity ratio of the chlorinated oxytitanium phthalocyanine to the unsubstituted oxytitanium phthalocyanine was 0.027. The chlorine content determined by elemental analysis was 0.65 wt %.

Preparation Example 1-2

Under nitrogen atmosphere, 66.6 g of phthalonitrile was dissolved in 436 mL of 1-chloronaphthalene, and a liquid mixture of 25.0 g of titanium tetrachloride and 21 mL of 1-chloronaphthalene was dropwise added thereto at 200° C., followed by a reaction at 205 to 210° C. for 5 hours. The product was subjected to heat filtration at 130 to 140° C. After reflux under heating in 580 mL of n-butanol, the product was washed by suspension in water, NMP, and methanol and then dried to obtain 48.7 g of B-type oxytitanium phthalocyanine.

This B-type oxytitanium phthalocyanine (30.0 g) was shaken in a paint shaker together with 200 mL of glass beads (diameter: 1.0 to 1.4 mm) for 20 hours. The oxytitanium phthalocyanine was washed out with methanol and filtered to obtain amorphous oxytitanium phthalocyanine. This oxytitanium phthalocyanine was suspended in 625 mL of water, and 48 mL of ortho-dichlorobenzene was added thereto, followed by agitation at room temperature for 1 hour. After the removal of water by decantation, the crystal type was converted by suspension washing with methanol, followed by filtration and drying to obtain 29.0 g of the target D-type oxytitanium phthalocyanine composition.

The X-ray diffraction spectrum of the resulting D-type oxytitanium phthalocyanine showed distinct diffraction peaks at Bragg angles (2θ±0.2°) of 9.6° and 27.3°, but did not show a distinct diffraction peak at a Bragg angle (2θ±0.2°) of 26.3°.

In the mass spectrum of the oxytitanium phthalocyanine, the intensity ratio of a peak of chlorinated oxytitanium phthalocyanine at m/z: 610 to a peak of unsubstituted oxytitanium phthalocyanine at m/z: 576 was 0.056. The chlorine content determined by elemental analysis was 1.41 wt %.

Preparation Example 1-3

1,3-Diiminoisoindoline (29.2 g) and sulforane (200 mL) were mixed, and titanium tetraisopropoxide (17.0 g) was added thereto, followed by a reaction under nitrogen atmosphere at 140° C. for 2 hours. After precipitate was allowed to be cooled, it was collected by filtration, washed with chloroform, a 2% hydrochloric acid aqueous solution, water, and methanol, followed by drying to obtain 25.5 g (88.8%) of titanyl phthalocyanine.

Then, the crystals obtained were dissolved in concentrated sulfuric acid, and the resulting solution was dropwise added to deionized water at 20° C. with stirring for reprecipitation. The precipitate was collected by filtration and sufficiently washed with water to obtain amorphous oxytitanium phthalocyanine. The obtained amorphous oxytitanium phthalocyanine (4.0 g) was suspension-treated in 100 mL of methanol with stirring at a room temperature (22° C.) for 8 hours and then subjected to filtration and drying under reduced pressure to obtain low-crystalline oxytitanium phthalocyanine.

Then, 40 mL of n-butyl ether was added to 2.0 g of this oxytitanium phthalocyanine, and the resulting mixture was subjected to milling treatment with glass beads having a diameter of 1 mm at a room temperature (22° C.) for 20 hours. The solid in this dispersion solution was extracted and sufficiently washed with methanol and then with water, followed by drying to obtain the target D-type oxytitanium phthalocyanine.

The X-ray diffraction spectrum of the resulting D-type oxytitanium phthalocyanine showed distinct diffraction peaks at Bragg angles (2θ±0.2°) of 9.0° and 27.3°, but did not show a distinct diffraction peak at a Bragg angle (2θ±0.2°) of 26.3°.

In the mass spectrum of the oxytitanium phthalocyanine, the intensity ratio of a peak of chlorinated oxytitanium phthalocyanine at m/z: 610 to a peak of unsubstituted oxytitanium phthalocyanine at m/z: 576 was lower than the detection limit (0.0003 or less). The chlorine content was lower than the detection limit (0.01 wt % or less) of elemental analysis.

Preparation Example 1-4

1,3-Diiminoisoindoline (29.2 g) and sulforane (200 mL) were mixed, and titanium tetraisopropoxide (17.0 g) was added thereto, followed by a reaction under nitrogen atmosphere at 140° C. for 2 hours. After precipitate was allowed to be cooled, it was collected by filtration, washed with chloroform, a 2% hydrochloric acid aqueous solution, water, and methanol, followed by drying to obtain 25.5 g (88.8%) of titanyl phthalocyanine.

The product was dissolved in 20-fold amount of concentrated sulfuric acid, and the resulting solution was poured into 100-fold amount of water for precipitation. The precipitate was collected by filtration, and the resulting wet cake was treated with dichloromethane and then with methanol, followed by drying to obtain crystals. The crystals were subjected to milling treatment with a paint conditioner apparatus (manufactured by Red Level Corp.) in methyl ethyl ketone together with glass beads having a diameter of 1 mm to obtain D-type oxytitanium phthalocyanine.

The X-ray diffraction spectrum of the resulting D-type oxytitanium phthalocyanine showed distinct diffraction peaks at Bragg angles (2θ±0.2°) of 9.5°, 9.7°, and 27.3°, but did not show a distinct diffraction peak at a Bragg angle (2θ±0.2°) of 26.3°.

In the mass spectrum of the oxytitanium phthalocyanine, the intensity ratio of a peak of chlorinated oxytitanium phthalocyanine at m/z: 610 to a peak of unsubstituted oxytitanium phthalocyanine at m/z: 576 was lower than the detection limit (0.0003 or less). The chlorine content was lower than the detection limit (0.01 wt % or less) of elemental analysis.

Preparation Example 1-5

B-type oxytitanium phthalocyanine (49 g) was prepared as in Preparation Example 1-2 except that a mixture of 5.0 g of titanium tetrachloride and 16 mL of 1-chloronaphthalene was added at 25° C. and the dropwise addition amount at 200° C. was a liquid mixture of 20.0 g of titanium tetrachloride and 25 mL of 1-chloronaphthalene. A process of converting the crystal type of this B-type oxytitanium phthalocyanine (30 g) was conducted as in Preparation Example 1-2 except that tetrahydrofuran (hereinafter, optionally, referred to as "THF") was used as a solvent. As a result, (peaks were also observed at 26.3° and 28.6°) 28 g of oxytitanium phthalocyanine that shows a maximum diffraction peak at a Bragg angle (2θ±0.2°) of 27.3° in a powder X-ray diffraction spectrum to CuKα characteristic X-rays was obtained.

The powder X-ray diffraction spectrum of this oxytitanium phthalocyanine composition showed a peak at 28.6° of which the relative intensity to that of the peak at 27.3° was 3% and a peak at 26.3° of which the relative intensity to that of the peak at 27.3° was 1%.

In the mass spectrum of the oxytitanium phthalocyanine, the intensity ratio of a peak of chlorinated oxytitanium phthalocyanine at m/z: 610 to a peak of unsubstituted oxytitanium phthalocyanine at m/z: 576 was 0.075. The chlorine content determined by elemental analysis was 0.81 wt %.

Comparative Preparation Example 1-1

Under nitrogen atmosphere, 66.6 g of phthalonitrile was dissolved in 436 mL of 1-chloronaphthalene, and a liquid mixture of 25.0 g of titanium tetrachloride and 21 mL of 1-chloronaphthalene was dropwise added thereto at 200° C., followed by a reaction at 205 to 210° C. for 5 hours. The product was subjected to heat filtration at 130 to 140° C. After reflux under heating in 580 mL of n-butanol, the product was washed by suspension in water, NMP, and methanol and then dried to obtain 48.7 g of B-type oxytitanium phthalocyanine.

Comparative Preparation Example 1-2

A-type titanyl phthalocyanine was prepared by the method described in Japanese Unexamined Patent Application Publication No. 62-67094.

Preparation of Hydroxygallium Phthalocyanine

Preparation Example 1-6

Phthalonitrile (73 g), gallium trichloride (25 g), and α-chloronaphthalene (400 mL) were reacted under nitrogen atmosphere at 200° C. for 4 hours, and the product was collected by filtration at 130° C. The resulting product was washed by dispersion in N,N-dimethylformamide at 130° C. for 1 hour and then filtrated. After washing with methanol and drying, 30 g of chlorogallium phthalocyanine was obtained.

The resulting chlorogallium phthalocyanine (10 g) was dissolved in 400 g of concentrated sulfuric acid at 10° C., and the resulting mixture was dropwise added to 3 kg of iced water with stirring for reprecipitation. The precipitate was collected by filtration and sufficiently washed with ion-exchange water, washed by dispersion in 1% ammonia water, and then sufficiently washed with ion-exchange water again. After drying at room temperature, amorphous hydroxygallium phthalocyanine was obtained.

Then, 7 g of the resulting hydroxygallium phthalocyanine and 210 g of N,N-dimethylformamide were subjected to milling treatment with a sand mill together with 300 g of glass beads having a diameter of 1 mm at room temperature (20° C.) for 6 hours. The solid was extracted from this dispersion solution and was sufficiently washed with methanol, followed by drying to obtain 5 g of hydroxygallium phthalocyanine having a novel crystal form.

The X-ray diffraction spectrum of the resulting phthalocyanine showed a distinct diffraction peak at a Bragg angle (2θ±0.2°) of 28.1°.

In the mass spectrum of the phthalocyanine, m/z: 598 was confirmed.

Example 1-1

Coating Liquid for a Undercoat Layer

Surface-treated titanium oxide was prepared by mixing rutile titanium oxide having an average primary particle diameter of 40 nm ("TTO55N" manufactured by Ishihara Sangyo Co., Ltd.) and methyldimethoxysilane ("TSL8117", manufactured by Toshiba Silicone Co., Ltd.) in an amount of 3 wt % on the basis of the amount of the titanium oxide with a Henschel mixer. One kilogram of raw material slurry composed of a mixture of 50 parts of the surface-treated titanium oxide and 120 parts of methanol was subjected to dispersion treatment for 1 hour using zirconia beads with a diameter of about 100 μm (YTZ, manufactured by Nikkato Corp.) as a dispersion medium and an Ultra Apex Mill (model UAM-015, manufactured by Kotobuki Industries Co., Ltd.) having a mill capacity of about 0.15 L under liquid circulation conditions of a rotor peripheral velocity of 10 m/sec and a liquid flow rate of 10 kg/h to give a titanium oxide dispersion.

The titanium oxide dispersion, a solvent mixture of methanol/1-propanol/toluene, and a pelletized polyamide copolymer composed of ε-caprolactam [compound represented by the following Formula (A)]/bis(4-amino-3-methylcyclohexyl)methane [compound represented by the following Formula (B)]/hexamethylene diamine [compound represented by the following Formula (C)]/decamethylenedicarboxylic acid [compound represented by the following Formula (D)]/octadecamethylenedicarboxylic acid [compound represented by the following Formula (E)] at a molar ratio of 60%/15%/5%/15%/5% were mixed with agitation under heat to dissolve the pelletized polyamide. The resulting solution was subjected to ultrasonic dispersion treatment for 1 hour with an ultrasonic oscillator at an output of 1200 W and then filtered through a PTFE membrane filter with a pore size of 5 μm (Mitex LC, manufactured by Advantech Co., Ltd.) to obtain a coating liquid 1-A for forming an undercoat layer wherein the weight ratio of the surface-treated titanium oxide/copolymerized polyamide was 3/1, the weight ratio of methanol/1-propanol/toluene in the solvent mixture was 7/1/2, and the solid content was 18.0 wt %.

The particle size distribution of this coating liquid 1-A for forming an undercoat layer measured using the aforementioned UPA is shown in Table 3.

[Chemical Formula 21]

A

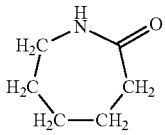

B

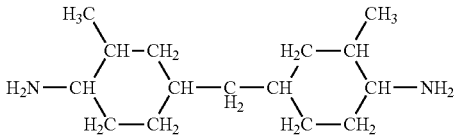

C

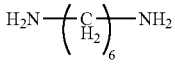

D

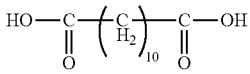

E

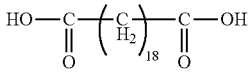

This coating liquid 1-A for forming an undercoat layer was applied to a non-anodized aluminum cylinder (outer diameter: 30 mm, length: 260.5 mm, thickness: 1.0 mm) by dipping to form an undercoat layer with a dried thickness of 1.5 μm.

This undercoat layer (94.2 $cm^2$) was immersed in a solvent mixture of 70 g of methanol and 30 g of 1-propanol and was sonicated with an ultrasonic oscillator at an output of 600 W for 5 minutes to prepare an undercoat layer dispersion. The particle size distribution of the metal oxide particles in the dispersion was measured with the UPA. The volume average particle diameter was 0.09 μm, and the 90% cumulative particle diameter was 0.12 μm.

Then, as a charge-generating material, 20 parts of the oxytitanium phthalocyanine obtained in Preparation Example 1-1 and 280 parts of 1,2-dimethoxyethane were mixed and pulverized in a sand grind mill for 2 hours for microparticle dispersion treatment.

Then, this microparticle treatment liquid was mixed with a binder solution prepared by dissolving polyvinyl butyral (trade name "Denka Butyral" #6000C, manufactured by Denki Kagaku Kogyo K.K.) in a solvent mixture of 253 parts of 1,2-dimethoxyethane and 85 parts of 4-methoxy-4-methyl-2-pentanone, and 230 parts of 1,2-dimethoxyethane to prepare a dispersion (charge-generator).

This dispersion (charge generator) was applied to the aluminum cylinder provided with the undercoat layer by dipping to form a charge-generating layer having a dried thickness of 0.3 μm (0.3 $g/m^2$).

Then, 50 parts of a charge-transporting material represented by the following compound (CT-1):

[Chemical Formula 22]

CT-1

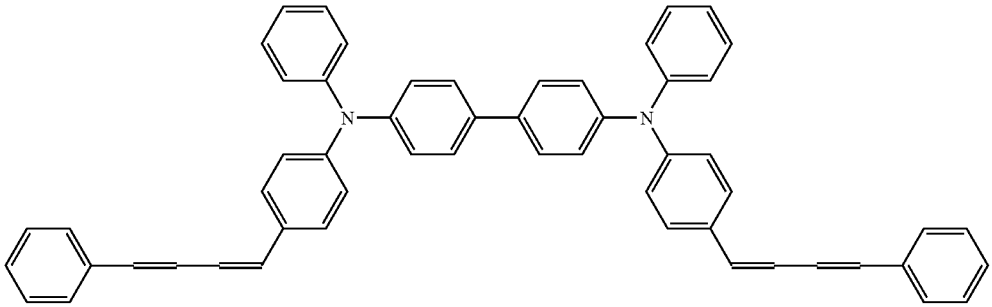

100 parts of a binder resin of polycarbonate having a repeating unit represented by the following structure (PC-1, viscosity-average molecular weight: about 30000, m:n=1:1):

[Chemical Formula 23]

PC-1

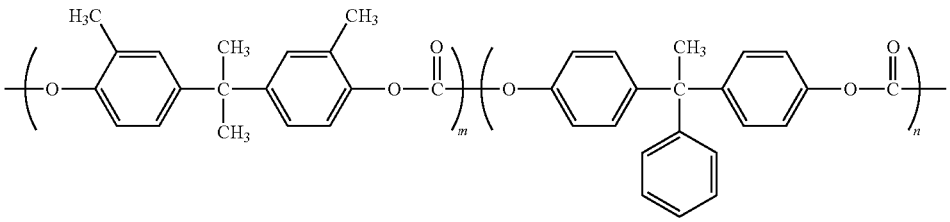

8 parts of antioxidant having the following structure:

[Chemical Formula 24]

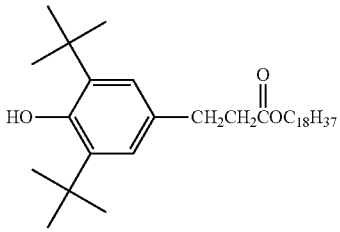

and 0.05 part of a silicone oil leveling agent (trade name: KF96, manufactured by Shin-Etsu Chemical Co., Ltd.) were dissolved in 640 parts of a solvent mixture of tetrahydrofuran/toluene (weight ratio: 8/2). The resulting solution was applied onto the charge-generating layer by dipping to form a layer with a dried thickness of 18 μm to give a photoreceptor drum 1-E1 having a laminated photosensitive layer.

The photosensitive layer (94.2 $cm^2$) of the resulting photoreceptor 1-E1 was removed by dissolving the layer in 100 $cm^3$ of tetrahydrofuran by sonication with an ultrasonic oscillator at an output of 600 W for 5 minutes, and then the photoreceptor 1-E1 after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA. The volume average particle diameter was 0.08 μm, and the 90% cumulative particle diameter was 0.11 μm.

Example 1-2

A photoreceptor 1-E2 was produced as in Example 1-1 except that the oxytitanium phthalocyanine prepared in Preparation Example 1-2 was used as the charge-generating material, instead of the oxytitanium phthalocyanine prepared in Preparation Example 1-1.

Example 1-3

A photoreceptor 1-E3 was produced as in Example 1-1 except that the oxytitanium phthalocyanine prepared in Preparation Example 1-3 was used as the charge-generating material, instead of the oxytitanium phthalocyanine prepared in Preparation Example 1-1.

Example 1-4

A photoreceptor 1-E4 was produced as in Example 1-1 except that the oxytitanium phthalocyanine prepared in Preparation Example 1-4 was used as the charge-generating material, instead of the oxytitanium phthalocyanine prepared in Preparation Example 1-1.

Example 1-5

A photoreceptor 1-E5 was produced as in Example 1-1 except that the oxytitanium phthalocyanine prepared in Preparation Example 1-5 was used as the charge-generating material, instead of the oxytitanium phthalocyanine prepared in Preparation Example 1-1.

Example 1-6

A coating liquid 1-B for forming an undercoat layer was prepared as in Example 1-1 except that the dispersion medium used in the Ultra Apex Mill was zirconia beads having a diameter of about 50 μm (YTZ, manufactured by Nikkato Corp.), and the physical properties thereof were measured as in Example 1-1. The results are shown in Table 3.

The coating liquid 1-B for forming an undercoat layer was applied to a non-anodized aluminum cylinder (outer diameter: 30 mm, length: 260.5 mm, thickness: 1.0 mm) by dipping to form an undercoat layer with a dried thickness of 1.5 μm.

This undercoat layer (94.2 $cm^2$) was immersed in a solvent mixture of 70 g of methanol and 30 g of 1-propanol and was sonicated with an ultrasonic oscillator at an output of 600 W for 5 minutes to prepare an undercoat layer dispersion. The particle size distribution of the metal oxide particles in this dispersion was measured with the UPA as in Example 1-1. The volume average particle diameter was 0.08 μm, and the 90% cumulative particle diameter was 0.11 μm.

A charge-generating layer and a charge-transporting layer were formed on the resulting undercoat layer as in Example 1-1 to give a photoreceptor 1-E6.

The photosensitive layer (94.2 $cm^2$) of the resulting photoreceptor 1-E6 was removed by dissolving the layer in 100 $cm^3$ of tetrahydrofuran by sonication with an ultrasonic oscillator at an output of 600 W for 5 minutes, and then the photoreceptor 1-E6 after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 1-1. The volume average particle diameter was 0.08 μm, and the 90% cumulative particle diameter was 0.12 μm.

Example 1-7

A coating liquid 1-C for forming an undercoat layer was prepared as in Example 1-6 except that the rotor peripheral velocity of the Ultra Apex Mill was 12 m/sec, and physical properties thereof were measured as in Example 1-1. The results are shown in Table 3.

Using this coating liquid 1-C for forming an undercoat layer, an undercoat layer was formed on an aluminum cylinder by dipping as in Example 1-1.

This undercoat layer (94.2 $cm^2$) was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 1-1. The volume average particle diameter was 0.08 μm, and the 90% cumulative particle diameter was 0.11 μm.

A photoreceptor 1-E7 was produced as in Example 1-1 except that the coating liquid 1-C for forming an undercoat layer was used.

The photosensitive layer (94.2 $cm^2$) of the resulting photoreceptor 1-E7 was removed by dissolving the layer in 100 $cm^3$ of tetrahydrofuran by sonication with an ultrasonic oscillator at an output of 600 W for 5 minutes, and then the photoreceptor 1-E7 after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 1-1. The volume average particle diameter was 0.08 μm, and the 90% cumulative particle diameter was 0.11 μm.

Example 1-8

A photoreceptor 1-E8 was produced as in Example 1-1 except that the phthalocyanine prepared in Preparation Example 1-6 was used as the charge-generating material, instead of the oxytitanium phthalocyanine prepared in Preparation Example 1-1.

Comparative Example 1-1

A photoreceptor 1-P1 was produced as in Example 1-1 except that the oxytitanium phthalocyanine prepared in Comparative Preparation Example 1-1 was used as the charge-generating material, instead of the oxytitanium phthalocyanine prepared in Preparation Example 1-1.

Comparative Example 1-2

A photoreceptor 1-P2 was produced as in Example 1-1 except that the oxytitanium phthalocyanine prepared in Comparative Preparation Example 1-2 was used as the charge-generating material, instead of the oxytitanium phthalocyanine prepared in Preparation Example 1-1.

Comparative Example 1-3

Rutile titanium oxide having an average primary particle diameter of 40 nm ("TTO55N", manufactured by Ishihara Sangyo Co., Ltd.) and methyldimethoxysilane in an amount of 3 wt % on the basis of the amount of the titanium oxide were mixed in a ball mill to prepare slurry. After the slurry was dried, the residue was washed with methanol and dried to yield hydrophobic-treated titanium oxide. This hydrophobic-treated titanium oxide was dispersed in a mixture solvent of methanol/1-propanol in a ball mill to give dispersion slurry of hydrophobic-treated titanium oxide. This dispersion slurry, a solvent mixture of methanol/1-propanol/toluene (weight ratio: 7/1/2), and a pelletized copolymerized polyamide composed of ϵ-caprolactam/bis(4-amino-3-methylcyclohexyl) methane/hexamethylene diamine/decamethylenedicarboxylic acid/octadecamethylenedicarboxylic acid (molar %: 75/9.5/3/9.5/3) were mixed with agitation under heat, thereby dissolving the pelletized polyamide. The resulting solution was subjected to ultrasonic dispersion treatment to give a coating liquid 1-D for forming an undercoat layer containing the hydrophobic-treated titanium oxide/copolymerized polyamide at a weight ratio of 3/1 and having a solid content of 18.0%.

An undercoat layer was formed on an aluminum cylinder by dip coating as in Example 1-1 using this coating liquid 1-D for forming an undercoat layer.

This undercoat layer (94.2 $cm^2$) was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 1-1. The volume average particle diameter was 0.11 μm, and the 90% cumulative particle diameter was 0.20 μm.

A photoreceptor 1-P3 was produced as in Example 1-1 except that the coating liquid 1-D for forming an undercoat layer was used.

The photosensitive layer (94.2 $cm^2$) of the resulting photoreceptor 1-P3 was removed by dissolving the layer in 100 $cm^3$ of tetrahydrofuran by sonication with an ultrasonic oscillator at an output of 600 W for 5 minutes, and then the photoreceptor 1-P3 after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 1-1. The volume average particle diameter was 0.11 μm, and the 90% cumulative particle diameter was 0.18 μm.

Comparative Example 1-4

A photoreceptor 1-P4 was produced as in Comparative Example 1-3 except that the oxytitanium phthalocyanine prepared in Preparation Example 1-3 was used as the charge-transporting material, instead of the oxytitanium phthalocyanine prepared in Preparation Example 1-1.

Comparative Example 1-5

A photoreceptor 1-P5 was produced as in Comparative Example 1-3 except that the oxytitanium phthalocyanine prepared in Preparation Example 1-4 was used as the charge-transporting material, instead of the oxytitanium phthalocyanine prepared in Preparation Example 1-1.

[Evaluation of Electric Characteristics]

The electrophotographic photoreceptors produced in Examples and Comparative Example were mounted on an electrophotographic characteristic evaluation device produced according to a standard of The Society of Electrophotography of Japan (Denshi Shashin Gizyutsu no Kiso to Oyo Zoku (Fundamentals and Applications of Electrophotography II) edited by The Society of Electrophotography of Japan, published by Corona Publishing Co., Ltd., pp. 404-405) and subjected to evaluation of electric characteristics through the following cycle of charging (negative polarity), exposure, potential measurement, and charge elimination.

The photoreceptor was charged such that the initial surface potential was −700 V and then was irradiated with monochromatic light of 780 nm, which emitted from a halogen lamp and was monochromatized through an interference filter. The irradiation energy (half-decay exposure energy) required until the surface potential reaches −350 V was measured (μJ/$cm^2$) as sensitivity (E1/2). In addition, the surface potential (VL1) at 100 ms after the irradiation with exposure light having an intensity of 1.0 μJ/$cm^2$ was measured (−V). Furthermore, the photoreceptor was charged to an initial surface potential of −700 V, and after leaving in a dark place for 5 seconds, the surface potential was measured. The difference was used as the dark decay (DD).

Furthermore, after the cycle of charging (negative polarity), exposure, potential measurement, and charge elimination for evaluation of electric characteristics was repeated 10000 times, the electric characteristics were similarly measured. These results are shown in Table 4.

In the charge-generating material column of Table 4 (and Table 5 shown below), "D" represents D-type oxytitanium phthalocyanine, "B" represents B-type oxytitanium phthalocyanine, and "A" represents A-type titanyl phthalocyanine. In the undercoat layer column, "α" represents the coating liquid 1-A, 1-B, or 1-C for forming an undercoat layer, and "β" represents the coating liquid 1-D for forming an undercoat layer.

TABLE 3

| | Coating liquid | Volume average particle diameter (μm) | 90% cumulative particle diameter (μm) |
|---|---|---|---|
| Example 1-1 | 1-A | 0.09 | 0.13 |
| Example 1-6 | 1-B | 0.08 | 0.12 |
| Example 1-7 | 1-C | 0.08 | 0.11 |
| Comparative Example 1-3 | 1-D | 0.13 | 0.20 |

TABLE 4

| | | Specification of photoreceptor | | Electric Characteristics (initial) | | | Electric Characteristics (after 10000 times) | | |
|---|---|---|---|---|---|---|---|---|---|
| | Photoreceptor | Charge-generating material | Undercoat layer | E½ (μJ/$cm^2$) | VL1 (−V) | DD (V) | E½ (μJ/$cm^2$) | VL1 (−V) | DD (V) |
| Example 1-1 | 1-E1 | D | α | 0.088 | 68 | 33 | 0.089 | 68 | 35 |
| Example 1-2 | 1-E2 | D | α | 0.090 | 72 | 35 | 0.092 | 75 | 37 |
| Example 1-3 | 1-E3 | D | α | 0.085 | 82 | 38 | 0.088 | 85 | 55 |
| Example 1-4 | 1-E4 | D | α | 0.088 | 82 | 41 | 0.091 | 84 | 47 |
| Example 1-5 | 1-E5 | D | α | 0.091 | 90 | 39 | 0.093 | 93 | 43 |

TABLE 4-continued

| | Photoreceptor | Specification of photoreceptor: Charge-generating material | Specification of photoreceptor: Undercoat layer | Electric Characteristics (initial): E½ (μJ/cm²) | Electric Characteristics (initial): VL1 (−V) | Electric Characteristics (initial): DD (V) | Electric Characteristics (after 10000 times): E½ (μJ/cm²) | Electric Characteristics (after 10000 times): VL1 (−V) | Electric Characteristics (after 10000 times): DD (V) |
|---|---|---|---|---|---|---|---|---|---|
| Example 1-6 | 1-E6 | D | α | 0.088 | 69 | 32 | 0.090 | 69 | 34 |
| Example 1-7 | 1-E7 | D | α | 0.089 | 67 | 33 | 0.091 | 68 | 36 |
| Example 1-8 | 1-E8 | GaOH Pc | α | 0.12 | 76 | 50 | 0.12 | 79 | 53 |
| Comparative Example 1-1 | 1-P1 | B | α | 0.30 | 70 | 42 | 0.35 | 76 | 50 |
| Comparative Example 1-2 | 1-P2 | A | α | 0.41 | 80 | 51 | 0.44 | 83 | 54 |
| Comparative Example 1-3 | 1-P3 | D | β | 0.088 | 68 | 41 | 0.090 | 69 | 50 |
| Comparative Example 1-4 | 1-P4 | D | β | 0.087 | 82 | 46 | 0.093 | 85 | 65 |
| Comparative Example 1-5 | 1-P5 | D | β | 0.089 | 82 | 47 | 0.094 | 82 | 59 |

[Evaluation of Image]

The electrophotographic photoreceptors (photoreceptors having a sensitivity better than 0.15 μJ/cm² were selected) produced in Examples and Comparative Examples were each provided with a gear and mounted in a drum cartridge (including an integrated cartridge consisting of a contact-type charging roller member, a blade cleaning member, and a development member) of a printer ("LaserJet 4200", manufactured by Hewlett Packard) that can output 33 A4 pages per minute. Commercially purchased recycled toner was set, and images were printed out and were tested.

Subsequently, immediately after the continuous printing of 10000 copies of a 5% print image, the image was evaluated.

The results are shown in Table 5. In Table 5, "○" denotes that the defect indicated in each column was not observed at all, "Δ" denotes that the defect indicated in the column was observed at an acceptable level for use, and "x" denotes that the defect indicated in the column was observed at an unacceptable level for use. A hyphenated rank denotes a middle level therebetween.

TABLE 5

| | Photoreceptor | Specification of photoreceptor: Charge-generating material | Specification of photoreceptor: Undercoat layer | Image characteristics: Initial black spots | Image characteristics: Initial fog | Image characteristics: Black spots after printing durability | Image characteristics: Fog after printing durability |
|---|---|---|---|---|---|---|---|
| Example 1-1 | 1-E1 | D | α | ○ | ○ | ○ | ○ |
| Example 1-2 | 1-E2 | D | α | ○ | ○ | ○ | ○ |
| Example 1-3 | 1-E3 | D | α | ○ | ○ | ○ | ○ |
| Example 1-4 | 1-E4 | D | α | ○ | ○ | ○ | ○ |
| Example 1-5 | 1-E5 | D | α | ○ | ○ | ○ | ○ |
| Example 1-6 | 1-E6 | D | α | ○ | ○ | ○ | ○ |
| Example 1-7 | 1-E7 | D | α | ○ | ○ | ○ | ○ |
| Example 1-8 | 1-E8 | GaOH Pc | α | ○ | ○ | ○ | ○-Δ |
| Comparative Example 1-3 | 1-P3 | D | β | Δ | ○ | Δ | x |
| Comparative Example 1-4 | 1-P4 | D | β | Δ-x | ○ | x | x |
| Comparative Example 1-5 | 1-P5 | D | β | Δ-x | ○ | x | x |

These results elucidate that the photoreceptors of the present invention have excellent electric characteristics and, in particular, a small decrease in dark decay after repeated use. Furthermore, it was confirmed that the image-forming apparatuses employing the photoreceptors of the present invention have advantages that black spots are low both at an initial stage and after printing durability and fogs after printing durability are significantly low.

Example Group 2

Example 2-1

Coating Liquid for an Undercoat Layer

A coating liquid 2-A for forming an undercoat layer that was identical to the coating liquid 1-A for forming an undercoat layer was prepared as in Example 1-1.

The particle size distribution of this coating liquid 2A for forming an undercoat layer was measured with the UPA, and the results are shown in Table 6.

This coating liquid 2-A for forming an undercoat layer was applied to a non-anodized aluminum cylinder (outer diameter: 30 mm, length: 260.5 mm, thickness: 1.0 mm) by dipping to form an undercoat layer with a dried thickness of 1.5 μm.

The undercoat layer (94.2 cm²) was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA. The volume average particle diameter was 0.09 μm, and the 90% cumulative particle diameter was 0.12 μm.

Then, as a charge-generating material, 20 parts of D-type oxytitanium phthalocyanine and 280 parts of 1,2-dimethoxy-ethane were mixed and pulverized in a sand grind mill for 2 hours for microparticle dispersion treatment.

Then, this microparticle treatment liquid was mixed with a binder solution prepared by dissolving polyvinyl butyral (trade name "Denka Butyral" #6000C, manufactured by Denki Kagaku Kogyo K.K.) in a solvent mixture of 253 parts of 1,2-dimethoxyethane and 85 parts of 4-methoxy-4-methyl-2-pentanone, and 230 parts of 1,2-dimethoxyethane to prepare a dispersion (charge-generator).

This dispersion (charge generator) was applied to the aluminum cylinder provided with the undercoat layer by dipping to form a charge-generating layer having a dried thickness of 0.3 μm (0.3 g/m$^2$).

Then, a charge-transporting layer was formed on the charge-generating layer as in Example 1-1 except that the charge-transporting material was the following compound (CT-2) and the dried thickness was 20 μm to give a photoreceptor drum 2-E1 having a laminated photosensitive layer.

[Chemical Formula 25]

CT-2

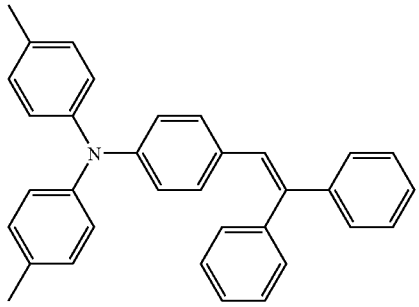

The photosensitive layer (94.2 cm$^2$) of this photoreceptor 2-E1 was removed by dissolving the layer in 100 cm$^3$ of tetrahydrofuran by sonication with an ultrasonic oscillator at an output of 600 W for 5 minutes, and then the photoreceptor after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA. The volume average particle diameter was 0.08 μm, and the 90% cumulative particle diameter was 0.11 μm.

Example 2-2

A photoreceptor 2-E2 was produced as in Example 2-1 except that the charge-transporting material was the following compound (CT-3) instead of the compound (CT-2).

[Chemical Formula 26]

CT-3

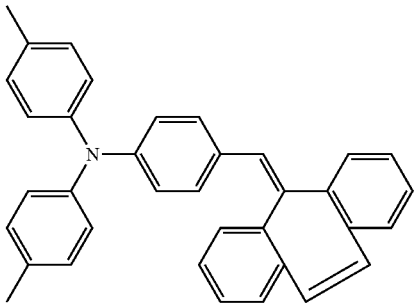

Example 2-3

A photoreceptor 2-E3 was produced as in Example 2-1 except that the charge-transporting material was the following compound (CT-4) instead of the compound (CT-2).

[Chemical Formula 27]

CT-4

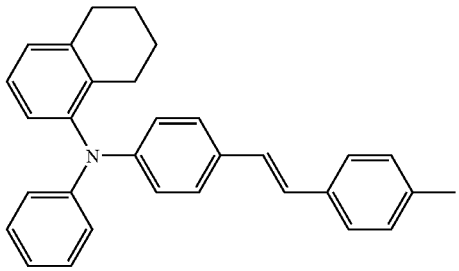

Example 2-4

A photoreceptor 2-E4 was produced as in Example 2-1 except that the charge-transporting material was a composition (CT-5) of an arylamine compound having the following structure described in Example 1 of Japanese Unexamined Patent Application Publication No. 2002-080432 instead of the compound (CT-2).

[Chemical Formula 28]

CT-5

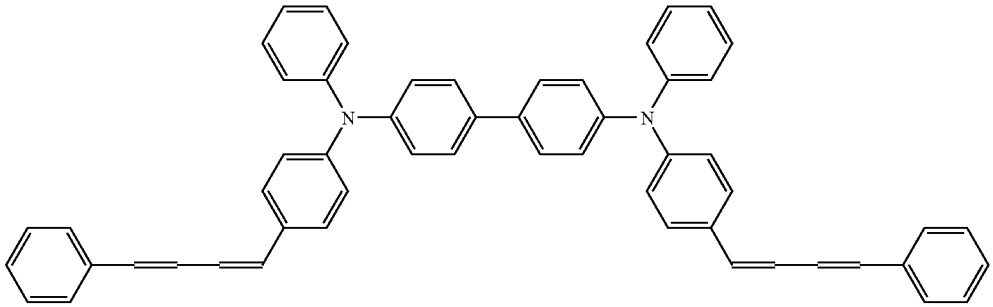

Example 2-5

A coating liquid 2-B for forming an undercoat layer was prepared as in Example 2-1 except that the dispersion medium used in the Ultra Apex Mill was zirconia beads having a diameter of about 50 μm (YTZ, manufactured by Nikkato Corp.), and the physical properties thereof were measured as in Example 2-1. The results are shown in Table 6.

The coating liquid 2-B for forming an undercoat layer was applied to a non-anodized aluminum cylinder (outer diameter: 30 mm, length: 260.5 mm, thickness: 1.0 mm) by dipping to form an undercoat layer with a dried thickness of 1.5 μm.

This undercoat layer (94.2 $cm^2$) was immersed in a solvent mixture of 70 g of methanol and 30 g of 1-propanol and was sonicated with an ultrasonic oscillator at an output of 600 W for 5 minutes to prepare an undercoat layer dispersion. The particle size distribution of the metal oxide particles in this dispersion was measured with the UPA as in Example 2-1. The volume average particle diameter was 0.08 μm, and the 90% cumulative particle diameter was 0.12 μm.

A charge-generating layer and a charge-transporting layer were formed on the resulting undercoat layer as in Example 2-1 to produce a photoreceptor 2-E5.

The photosensitive layer (94.2 $cm^2$) of this photoreceptor 2-E5 was removed by dissolving the layer in 100 $cm^3$ of tetrahydrofuran by sonication with an ultrasonic oscillator at an output of 600 W for 5 minutes, and then the photoreceptor after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 2-1. The volume average particle diameter was 0.08 μm, and the 90% cumulative particle diameter was 0.12 μm.

Example 2-6

A coating liquid 2-C for forming an undercoat layer was prepared as in Example 2-5 except that the rotor peripheral velocity of the Ultra Apex Mill was 12 m/sec, and physical properties thereof were measured as in Example 2-1. The results are shown in Table 6.

Using this coating liquid 2-C for forming an undercoat layer, an undercoat layer was formed on an aluminum cylinder by dipping as in Example 2-1.

This undercoat layer (94.2 $cm^2$) was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 2-1. The volume average particle diameter was 0.08 μm, and the 90% cumulative particle diameter was 0.11 μm.

A photoreceptor 2-E6 was produced as in Example 2-1 except that the coating liquid 2-C for forming an undercoat layer was used.

The photosensitive layer (94.2 $cm^2$) of the resulting photoreceptor 2-E6 was removed by dissolving the layer in 100 $cm^3$ of tetrahydrofuran by sonication with an ultrasonic oscillator at an output of 600 W for 5 minutes, and then the photoreceptor 2-E6 after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 2-1. The volume average particle diameter was 0.08 μm, and the 90% cumulative particle diameter was 0.11 μm.

Example 2-7

A photoreceptor 2-P1 was produced as in Example 2-1 except that the charge-transporting material was the following compound (CT-6) instead of the compound (CT-2).

[Chemical Formula 29]

CT-6

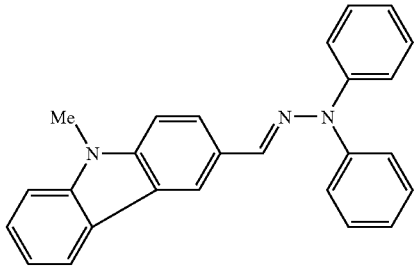

Example 2-8

A photoreceptor 2-P2 was produced as in Example 2-1 except that the charge-transporting material was the following compound (CT-7) instead of the compound (CT-2).

[Chemical Formula 30]

CT-7

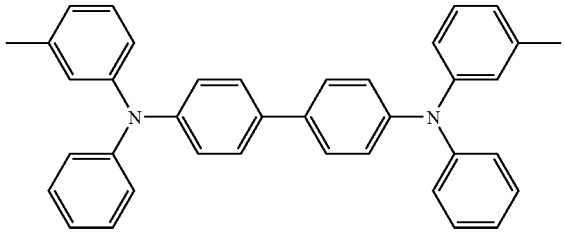

Comparative Example 2-1

Rutile titanium oxide having an average primary particle diameter of 40 nm ("TTO55N", manufactured by Ishihara Sangyo Co., Ltd.) and methyldimethoxysilane in an amount of 3 wt % on the basis of the amount of the titanium oxide were mixed in a ball mill to prepare slurry. After the slurry was dried, the residue was washed with methanol and dried to yield hydrophobic-treated titanium oxide. This hydrophobic-treated titanium oxide was dispersed in a mixture solvent of methanol/1-propanol in a ball mill to give dispersion slurry of hydrophobic-treated titanium oxide. This dispersion slurry, a solvent mixture of methanol/1-propanol/toluene (weight ratio: 7/1/2), and a pelletized copolymerized polyamide composed of ϵ-caprolactam/bis(4-amino-3-methylcyclohexyl) methane/hexamethylene diamine/decamethylenedicarboxylic acid/octadecamethylenedicarboxylic acid (molar %: 60/15/5/15/5) were mixed with agitation under heat, thereby dissolving the pelletized polyamide. The resulting solution was subjected to ultrasonic dispersion treatment to give a coating liquid 2-D for forming an undercoat layer containing the hydrophobic-treated titanium oxide/copolymerized polyamide at a weight ratio of 3/1 and having a solid content of 18.0%.

Using this coating liquid 2-D for forming an undercoat layer, an undercoat layer was formed on an aluminum cylinder by dipping as in Example 2-1.

This undercoat layer (94.2 $cm^2$) was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 2-1. The volume average particle diameter was 0.11 μm, and the 90% cumulative particle diameter was 0.20 μm.

A photoreceptor 2-P3 was produced as in Example 2-1 except that the coating liquid 2-D for forming an undercoat layer was used.

The photosensitive layer (94.2 $cm^2$) of the resulting photoreceptor 2-P3 was removed by dissolving the layer in 100 $cm^3$ of tetrahydrofuran by sonication with an ultrasonic oscillator at an output of 600 W for 5 minutes, and then the photoreceptor 2-P3 after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 2-1. The volume average particle diameter was 0.11 μm, and the 90% cumulative particle diameter was 0.18 μm.

Comparative Example 2-2

A photoreceptor 2-P4 was produced as in Comparative Example 2-1 except that the charge-transporting material was the compound (CT-4) instead of the compound (CT-2).

[Evaluation of Electric Characteristics]

The electrophotographic photoreceptors produced in Examples and Comparative Example were mounted on an electrophotographic characteristic evaluation device produced according to a standard of The Society of Electrophotography of Japan (Denshi Shashin Gizyutsu no Kiso to Oyo Zoku (Fundamentals and Applications of Electrophotography II) edited by The Society of Electrophotography of Japan, published by Corona Publishing Co., Ltd., pp. 404-405) and subjected to evaluation of electric characteristics through the following cycle of charging (negative polarity), exposure, potential measurement, and charge elimination.

Under an environment of a temperature of 25° C. and a humidity of 50% and under an environment of a temperature of 5° C. and a humidity of 10%, the photoreceptor was charged such that the initial surface potential was −700 V and then was irradiated with monochromatic light of 780 nm, which emitted from a halogen lamp and was monochromatized through an interference filter. The irradiation energy (half-decay exposure energy) required until the surface potential reaches −350 V was measured (μJ/$cm^2$) as sensitivity (E1/2). In addition, the surface potential (VL1) at 100 ms after the irradiation with exposure light having an intensity of 1.0 μJ/$cm^2$ was measured (−V). Furthermore, the photoreceptor was charged to an initial surface potential of −700 V, and after leaving in a dark place for 5 seconds, the surface potential was measured. The difference was used as the dark decay (DD).

The results are shown in Table 7A (temperature: 25° C., humidity: 50%) and Table 7B (temperature: 5° C., humidity: 10%). In the undercoat layer columns of Tables 7A and 7B, "α" represents the coating liquid 2-A, 2-B, or 2-C for forming an undercoat layer, and "β" represents the coating liquid 2-D for forming an undercoat layer.

TABLE 6

| | Coating liquid | Volume average particle diameter (μm) | 90% cumulative particle diameter (μm) |
|---|---|---|---|
| Example 2-1 | 2-A | 0.09 | 0.13 |
| Example 2-5 | 2-B | 0.08 | 0.12 |
| Example 2-6 | 2-C | 0.08 | 0.11 |
| Comparative Example 2-1 | 2-D | 0.13 | 0.20 |

TABLE 7A

[Evaluation results at a temperature of 25° C. and a humidity of 50%]

| | Specification of photoreceptor | | | Electric Characteristics | | |
|---|---|---|---|---|---|---|
| | Photoreceptor | Charge-transporting material | Undercoat layer | E½ (μJ/$cm^2$) | VL1 (−V) | DD (V) |
| Example 2-1 | 2-E1 | CT-2 | α | 0.093 | 55 | 38 |
| Example 2-2 | 2-E2 | CT-3 | α | 0.098 | 63 | 39 |
| Example 2-3 | 2-E3 | CT-4 | α | 0.101 | 64 | 36 |
| Example 2-4 | 2-E4 | CT-5 | α | 0.091 | 49 | 34 |
| Example 2-5 | 2-E5 | CT-2 | α | 0.092 | 56 | 35 |
| Example 2-6 | 2-E6 | CT-2 | α | 0.094 | 58 | 38 |
| Example 2-7 | 2-P1 | CT-6 | α | 0.128 | 138 | 52 |
| Example 2-8 | 2-P2 | CT-7 | α | 0.098 | 67 | 38 |
| Comparative Example 2-1 | 2-P3 | CT-2 | β | 0.095 | 60 | 46 |
| Comparative Example 2-2 | 2-P4 | CT-4 | β | 0.102 | 72 | 49 |

TABLE 7B

[Evaluation results at a temperature of 5° C. and a humidity of 10%]

| | | Specification of photoreceptor | | Electric Characteristics | | |
|---|---|---|---|---|---|---|
| | Photoreceptor | Charge-transporting material | Undercoat layer | E½ (μJ/cm²) | VL1 (−V) | DD (V) |
| Example 2-1 | 2-E1 | CT-2 | α | 0.107 | 96 | 30 |
| Example 2-2 | 2-E2 | CT-3 | α | 0.116 | 108 | 31 |
| Example 2-3 | 2-E3 | CT-4 | α | 0.118 | 111 | 29 |
| Example 2-4 | 2-E4 | CT-5 | α | 0.103 | 85 | 27 |
| Example 2-5 | 2-E5 | CT-2 | α | 0.106 | 96 | 28 |
| Example 2-6 | 2-E6 | CT-2 | α | 0.109 | 98 | 30 |
| Example 2-7 | 2-P1 | CT-6 | α | Not detectable | 356 | 32 |
| Example 2-8 | 2-P2 | CT-7 | α | 0.129 | 184 | 25 |
| Comparative Example 2-1 | 2-P3 | CT-2 | β | 0.110 | 109 | 37 |
| Comparative Example 2-2 | 2-P4 | CT-4 | β | 0.119 | 121 | 39 |

As obvious from the results shown in Tables 6, 7A, and 7B, the photoreceptors of the present invention can maintain high responsibility under ambient temperature, and exhibits relatively small changes in electric characteristics.

[Evaluation of Image]

The electrophotographic photoreceptors produced in Examples and Comparative Examples were each provided with a gear and mounted in a drum cartridge of a printer ("LaserJet 4200", manufactured by Hewlett Packard) that can output 33 pages per minute. Commercially available recycled toner was mounted, and images were printed out. Image concentrations of black solid parts and image defects in black solid images and white solid images were visually evaluated.

The results are shown in Table 8.

TABLE 8

| | | Temperature: 25° C., Humidity: 50% | | Temperature: 5° C., Humidity: 10% | |
|---|---|---|---|---|---|
| | Photoreceptor | Black solid concentration | Image defect | Black solid concentration | Image defect |
| Example 2-1 | 2-E1 | 1.45 | None | 1.39 | None |
| Example 2-2 | 2-E2 | 1.43 | None | 1.35 | None |
| Example 2-3 | 2-E3 | 1.41 | None | 1.33 | None |
| Example 2-4 | 2-E4 | 1.43 | None | 1.34 | None |
| Example 2-5 | 2-E5 | 1.45 | None | 1.35 | None |
| Example 2-6 | 2-E6 | 1.42 | None | 1.32 | None |
| Example 2-7 | 2-P1 | 1.23 | None | 1.07 | Back ground |
| Example 2-8 | 2-P2 | 1.39 | None | 1.15 | Back ground |
| Comparative Example 2-1 | 2-P3 | 1.42 | Black spots | 1.35 | Back ground, Black spots |
| Comparative Example 2-2 | 2-P4 | 1.40 | Black spots | 1.32 | Back ground, Black spots |

As obvious from the results shown in Table 8, an image formed with the photoreceptor of the present invention can have high quality without fogs and black spots under ambient temperature. Furthermore, when the photosensitive layer contains the arylamine compound according to the present invention, the formed image can have high quality without fogs and black spots under both environments of ambient temperature and low temperature.

INDUSTRIAL APPLICABILITY

The present invention can be applied to any industrial field, in particular, can be preferably applied to, for example, printers, facsimile machines, and copiers of electrophotographic systems.

Although the present invention has been described in detail with reference to certain preferred embodiments, those skilled in the art will recognize that various modifications will be made without departing from the purpose and scope of the present invention.

The present application is based on Japanese Patent Application (Patent Application No. 2006-139529) filed on May 18, 2006 and Japanese Patent Application (Patent Application No. 2006-139533) filed on May 18, 2006, the entire contents of which are hereby incorporated by reference.

The invention claimed is:

1. An electrophotographic photoreceptor comprising an undercoat layer comprising metal oxide particles and a binder resin on an electroconductive substrate, and a photosensitive layer disposed on the undercoat layer, wherein the metal oxide particles are present in the form of primary particles and aggregated secondary particles and have a volume average particle diameter of 0.1 μm or less and a 90% cumulative particle diameter of 0.3 μm or less which are measured by a dynamic light-scattering method in a liquid of the undercoat layer dispersed in a solvent mixture of methanol and 1 propanol at a weight ratio of 7:3; and the photosensitive layer comprises an oxytitanium phthalocyanine having a distinct main diffraction peak at a Bragg angle (2θ±0.2°) of 27.3° in an X-ray diffraction spectrum.

2. The electrophotographic photoreceptor according to claim 1, wherein the photosensitive layer comprises an oxytitanium phthalocyanine having a distinct diffraction peak at a Bragg angle (2θ±0.2°) of 9.0° in an X-ray diffraction spectrum.

3. The electrophotographic photoreceptor according to claim 1, wherein the photosensitive layer comprises an oxytitanium phthalocyanine having a distinct diffraction peak at a Bragg angle (2θ±0.2°) of 9.6° in an X-ray diffraction spectrum.

4. The electrophotographic photoreceptor according to claim 1, wherein the photosensitive layer comprises an oxytitanium phthalocyanine having distinct diffraction peaks at Bragg angles (2θ±0.2°) of 9.5° and 9.7° in an X-ray diffraction spectrum.

5. The electrophotographic photoreceptor according to claim 1, wherein chlorine content in the oxytitanium phthalocyanine is 1.5 wt % or less.

6. The electrophotographic photoreceptor according to claim 1, wherein the ratio of mass spectral intensity of chlorinated oxytitanium phthalocyanine in the oxytitanium phthalocyanine to that of non-substituted oxytitanium phthalocyanine is 0.070 or less.

7. The electrophotographic photoreceptor according to claim 1, wherein the photosensitive layer comprises a compound represented by Formula (I):

(I)

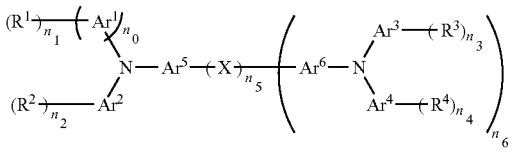

wherein, in Formula (I), $Ar^1$ to $Ar^6$ each independently represent an aromatic moiety or an aromatic moiety having a substituent;

X represents an organic moiety or an organic moiety having a substituent;

$R^1$ to $R^4$ each independently represent an unsaturated group or an unsaturated group having a substituent;

$n_1$ represents 1 or 2; and $n_o$ and $n_2$ to $n_6$ represent integers of 0 to 2.

8. The electrophotographic photoreceptor according to claim 7, wherein all of $Ar^1$ to $Ar^6$ in Formula (I) are benzene moieties.

9. The electrophotographic photoreceptor according to claim 7, wherein $R^1$ to $R^4$ in Formula (I) are represented by Formula (II):

(II)

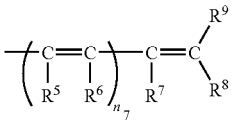

wherein, in Formula (II), $R^5$ to $R^9$ each independently represent a hydrogen atom, an alkyl group, an aryl group, or an aryl group having a substituent; and $n_7$ represents an integer of 0 to 5.

10. An image-forming apparatus comprising an electrophotographic photoreceptor according to claim 1;

a charger that charges the electrophotographic photoreceptor;

an image exposing device that forms an electrostatic latent image by conducting image exposure to the charged electrophotographic photoreceptor;

a developer that develops the electrostatic latent image with toner; and a unit that transfers the toner to a transfer object.

11. An electrophotographic cartridge comprising:

an electrophotographic photoreceptor according to claim 1; and at least one of a charger that charges the electrophotographic photoreceptor, an image exposing device that forms an electrostatic latent image by conducting image exposure to the charged electrophotographic photoreceptor, a developer that develops the electrostatic latent image with toner, a unit that transfers the toner to a transfer object, a fixer that fixes the toner transferred to the transfer object, and a cleaner that recovers the toner adhering to the electrophotographic photoreceptor.

12. The electrophotographic photoreceptor according to claim 1, wherein the metal oxide particles comprise at least one member selected from the group titanium oxide, aluminum oxide, silicon oxide, zirconium oxide, zinc oxide, iron oxide, calcium titanate, strontium titanate, and barium titanate.

13. The electrophotographic photoreceptor according to claim 1, wherein the metal oxide particles comprise titanium oxide wherein a surface thereof is treated with a silane represented by formula (i)

(i)

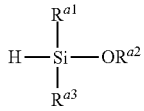

where $R^{a1}$ and $R^{a2}$ each independently represent an alkyl group having at most 18 carbon atoms, and $R^{a3}$ represents an alkyl group having at most 18 carbon atoms or an alkoxy group.

14. The electrophotographic photoreceptor according to claim 1, wherein the metal oxide particles have a volume average particle diameter of from 20 nm to 0.1 μm.

15. The electrophotographic photoreceptor according to claim 1, wherein the metal oxide particles have a volume average particle diameter of from nm to 0.09 μm.

16. The electrophotographic photoreceptor according to claim 1, wherein the 90% cumulative particle diameter is from 10 nm to 0.3 μm.

17. The electrophotographic photoreceptor according to claim 1, wherein chlorine content in the oxytitanium phthalocyanine is from 0.6 wt % to 1.5 wt %.

18. The electrophotographic photoreceptor according to claim 1, wherein a ratio of a chlorinated oxytitanium phthalocyanine compound represented by formula (1) to an unsubstituted oxytitanium phthalocyanine compound represented by formula (2)

(1)

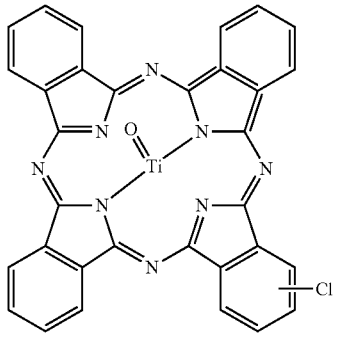

-continued (2)

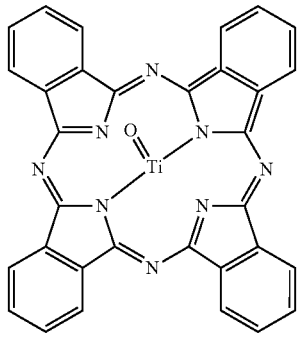

is from 0.02 to 0.070.

19. The electrophotographic photoreceptor according to claim 1, wherein the photosensitive layer comprises at least one compound selected from the group consisting of

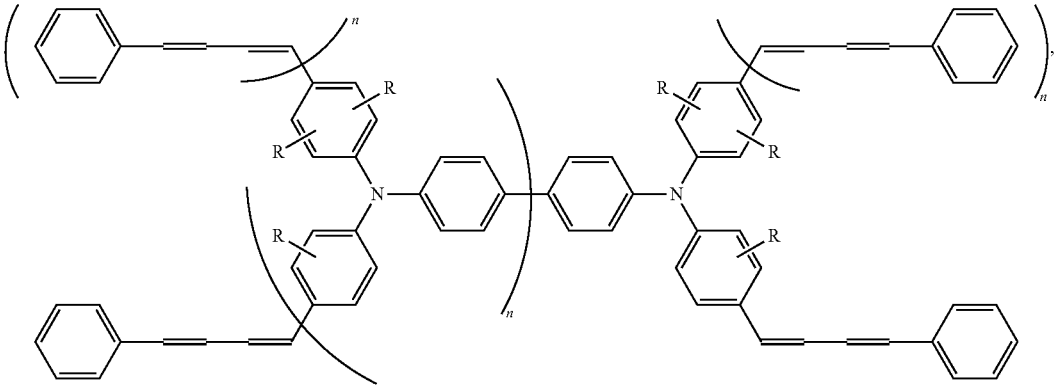

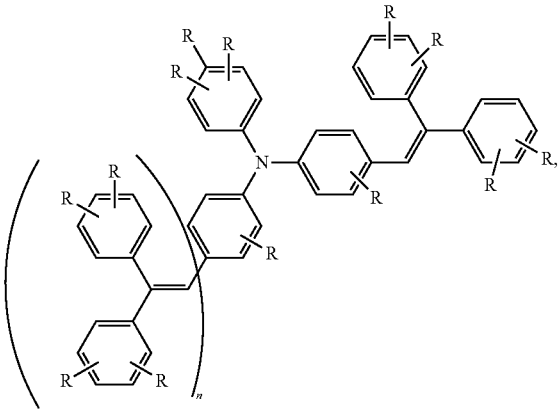

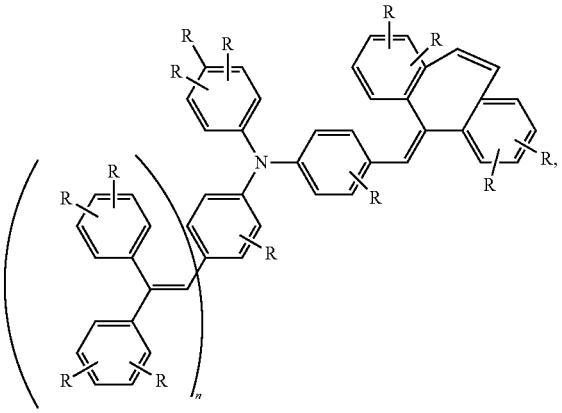

-continued
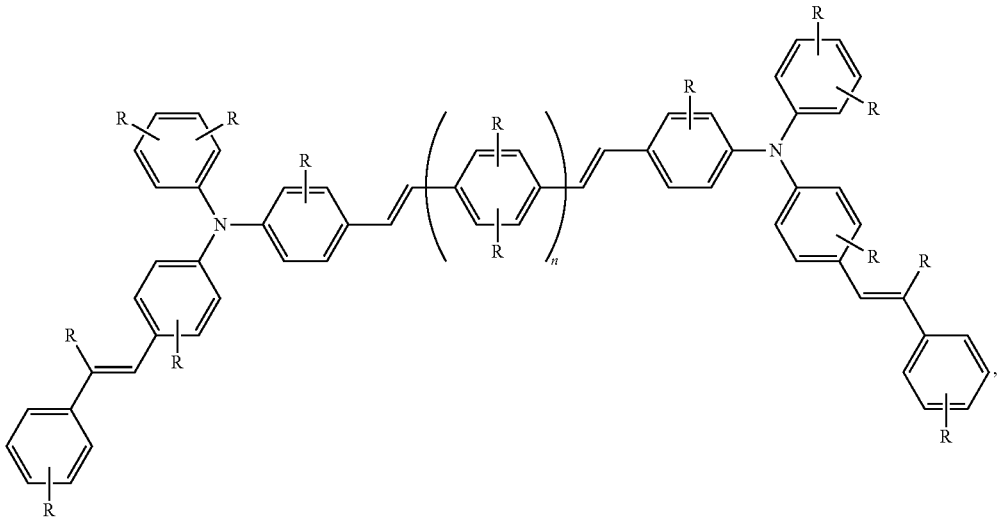
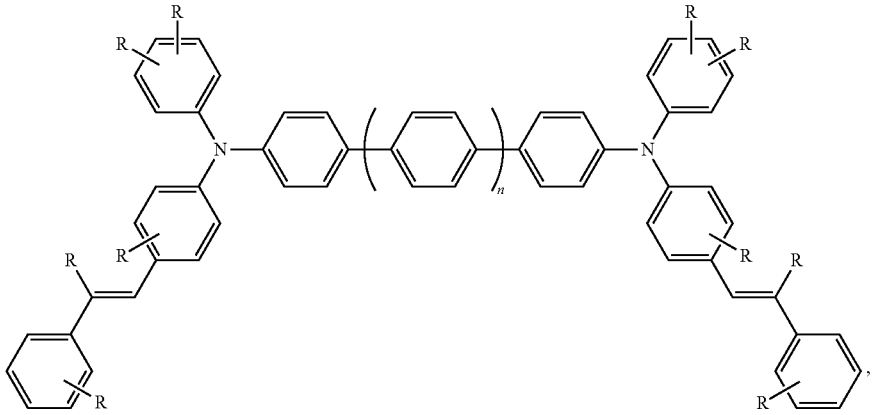
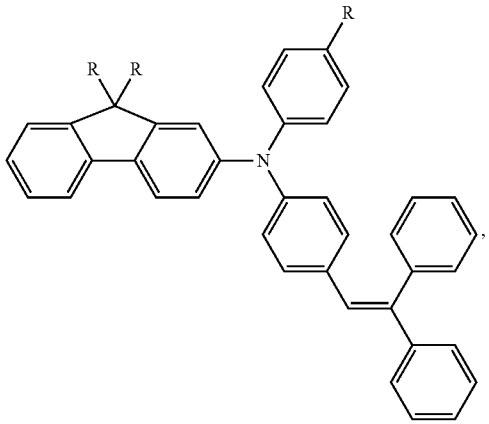
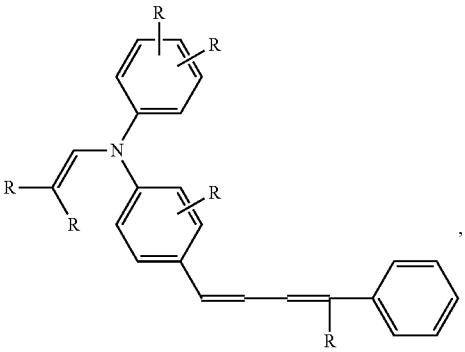

-continued
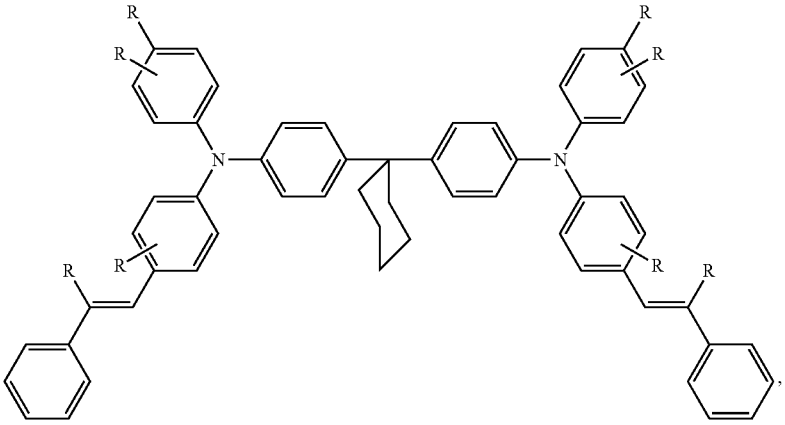
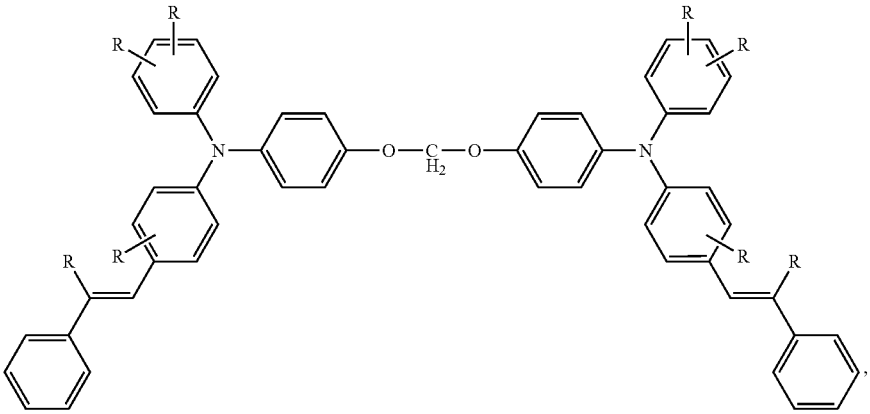
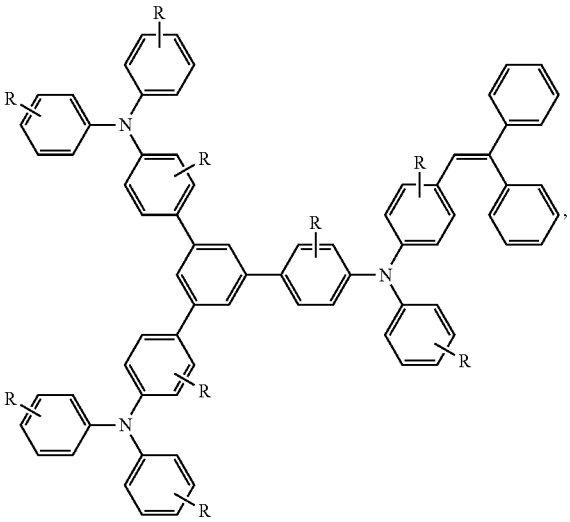
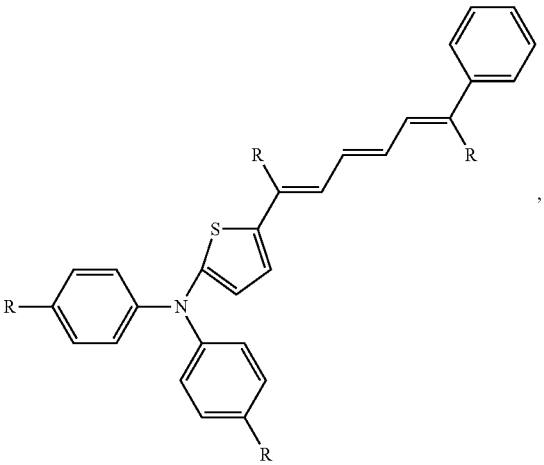
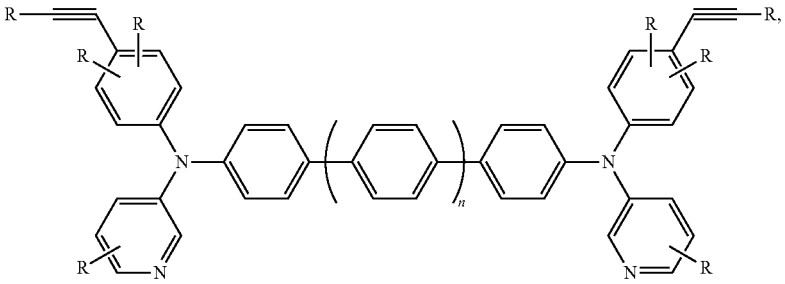
and

-continued
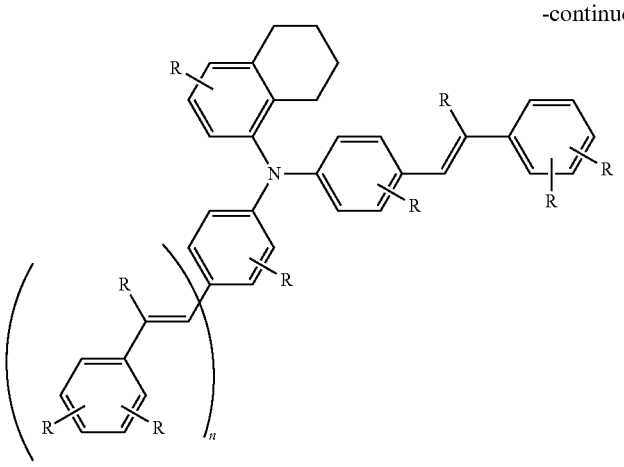
where each R represents, individually, a hydrogen atom, an alkyl group, an alkoxy group, or an aryl group and n represents an integer of 0 to 2 for each compound.
* * * * *